US007303271B2

(12) United States Patent
Shimizu et al.

(10) Patent No.: US 7,303,271 B2
(45) Date of Patent: Dec. 4, 2007

(54) INK JET PRINTER

(75) Inventors: Yoichiro Shimizu, Kasugai (JP); Takamasa Usui, Nagoya (JP); Masayuki Takata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 304 days.

(21) Appl. No.: 10/968,070

(22) Filed: Oct. 20, 2004

(65) Prior Publication Data

US 2005/0088494 A1 Apr. 28, 2005

(30) Foreign Application Priority Data

| | | |
|---|---|---|
| Oct. 24, 2003 | (JP) | 2003-364368 |
| Oct. 24, 2003 | (JP) | 2003-364369 |
| Oct. 24, 2003 | (JP) | 2003-364370 |
| Dec. 4, 2003 | (JP) | 2003-406358 |
| Dec. 12, 2003 | (JP) | 2003-414337 |
| Mar. 30, 2004 | (JP) | 2004-098154 |

(51) Int. Cl.
*B41J 2/17* (2006.01)
*B41J 2/175* (2006.01)

(52) U.S. Cl. ..... 347/94; 347/85

(58) Field of Classification Search ..... 347/85, 347/86, 87, 92, 94

See application file for complete search history.

(56) References Cited

U.S. PATENT DOCUMENTS

| | | | | |
|---|---|---|---|---|
| 4,149,172 | A * | 4/1979 | Heinzl et al. | 347/92 |
| 5,777,649 | A * | 7/1998 | Otsuka et al. | 347/94 |
| 5,936,650 | A * | 8/1999 | Ouchida et al. | 347/89 |
| 6,007,193 | A * | 12/1999 | Kashimura et al. | 347/92 |
| 6,729,717 | B2 | 5/2004 | Ito et al. | |
| 6,863,390 | B2 * | 3/2005 | Arai et al. | 347/94 |

FOREIGN PATENT DOCUMENTS

| | | |
|---|---|---|
| EP | 0 684 136 A2 | 11/1995 |
| EP | 0 855 274 A2 | 7/1998 |
| EP | 1 055 520 A1 | 11/2000 |
| EP | 1 199 178 A1 | 4/2002 |
| EP | 1 285 761 A1 | 2/2003 |
| JP | A 63-17056 | 1/1988 |
| JP | 03-182361 A | 8/1991 |
| JP | A 3-258554 | 11/1991 |
| JP | A 05-201015 | 8/1993 |
| JP | A 2000-103084 | 4/2000 |
| JP | A 2001-219560 | 8/2001 |
| JP | A 2002-067312 | 3/2002 |
| JP | A 2002-240310 | 8/2002 |
| WO | WO99/21721 | 5/1999 |

* cited by examiner

*Primary Examiner*—Anh T. N. Vo
(74) *Attorney, Agent, or Firm*—Olifff & Berridge, PLC

(57) ABSTRACT

An ink jet printer including a housing; a carriage which is movable in the housing relative thereto; an ink jet recording head which is mounted on the carriage and which has a plurality of ink supply channels; a damping device which is mounted on the carriage and which includes a plurality of damping chambers corresponding to the ink supply channels, respectively; an ink-tank supporting portion which is provided in the housing and which supports a plurality of ink tanks; and a plurality of ink supply tubes each of which supplies an ink from a corresponding one of the ink tanks to a corresponding one of the ink supply channels of the ink jet recording head via a corresponding one of the ink supply tubes and a corresponding one of the damping chambers. The damping device further includes a primary partition wall which separates at least one first damping chamber of the damping chambers, from at least one second damping chamber of the damping chambers.

43 Claims, 35 Drawing Sheets

FIG.20A
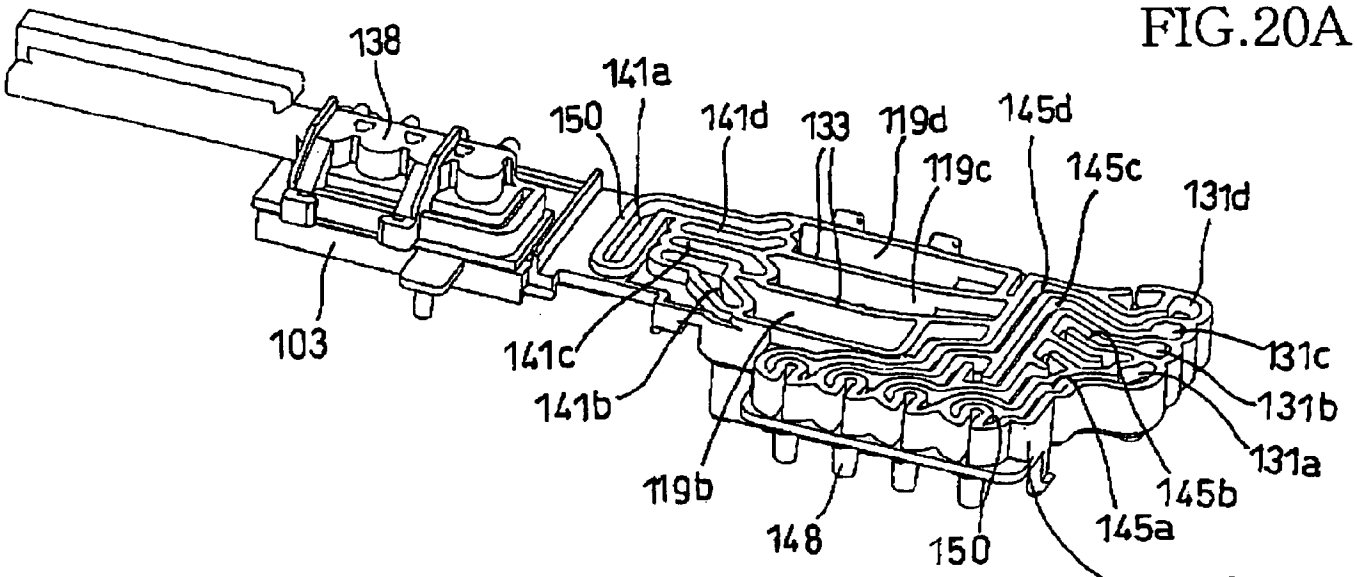
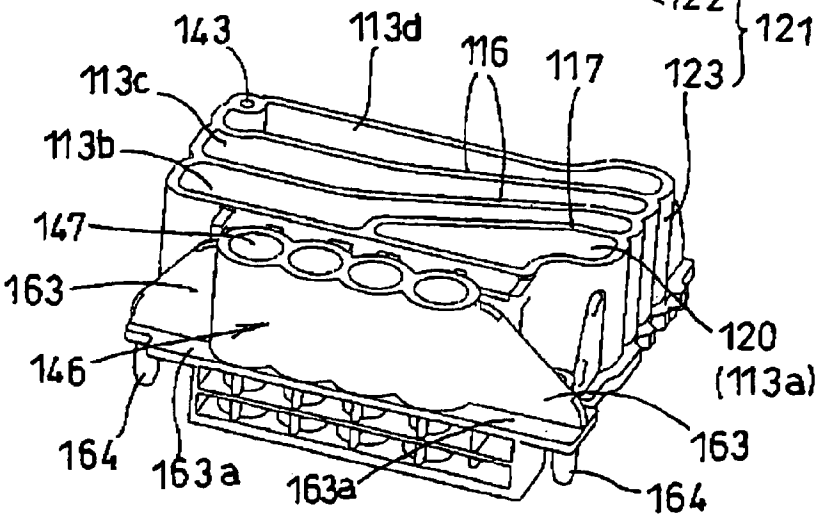
FIG.20B

INK JET PRINTER

The present application is based on six Japanese Patent Applications No. 2003-364370 filed on Oct. 24, 2003, No. 2003-364368 filed on Oct. 24, 2003, No. 2003-364369 filed on Oct. 24, 2003, No. 2003-406358 filed on Dec. 4, 2003, No. 2003-414337 filed on Dec. 12, 2003, and No. 2004-098154 filed on Mar. 30, 2004, the contents of which are incorporated herein by reference.

BACKGROUND OF THE INVENTION

1. Field of the Invention

The present invention relates to an ink jet printer and particularly to such an ink jet printer in which ink is supplied from an ink tank via a flexible tube (i.e., a flexible ink supply tube) to a recording head mounted on a movable carriage. The present invention also relates to such an ink jet printer which can collect air bubbles produced in an ink flow channel and discharge the air bubbles.

2. Discussion of Related Art

Patent Document 1 (Japanese Patent Application Publication No. 63-17056 A) or Patent Document 2 (Japanese Patent Application Publication No. 7-121583 B2) discloses a tube-supply-type ink jet printer in which ink is supplied from an ink tank provided in a housing, via a flexible tube, to a recording head mounted on a carriage movable in the housing.

More specifically described, in the ink jet printer disclosed by Patent Document 1, the recording head has a plurality of ink ejection nozzles vertically arranged in an array, a plurality of ink supply channels communicating with the ink ejection nozzles, respectively, and a common ink chamber (i.e., a damping chamber) communicating with each of the ink supply channels. The ink supply channels and the common ink chamber are formed in the recording head, such that the common ink chamber opens in one vertical side surface of the head. The ink is supplied from the ink tank provided in the housing, via the flexible tube, to the common ink chamber of the recording head. A portion of the side surface of the recording head in which the common ink chamber opens is liquid-tightly closed by a flexible membrane (i.e., a pressure-change damping membrane). An ink flow inlet opens in the bottom race of the common ink chamber (the damping chamber) and is opposed to the flexible membrane.

A plurality of actuators in the form of piezoelectric elements are fixed to another potion of the side surface of the recording head, such that the actuators are aligned with the ink supply channels, respectively. When an arbitrary one of the actuators is driven or operated, a pressure is applied to the ink present in a corresponding one of the ink supply channels, so that a droplet of ink is ejected from a corresponding one of the ink ejection nozzles toward a recording sheet.

In the ink jet printer disclosed by Patent Document 2, the recording head has a plurality of ink ejection nozzles vertically arranged in an array, a plurality of ink supply channels vertically arranged in an array, and a plurality of piezoelectric elements fixed to two opposite, vertical side surfaces of the head. When an electric voltage is applied to an arbitrary one of the piezoelectric elements, the one piezoelectric element is deformed, so that a droplet of ink is ejected from a corresponding one of the ink ejection nozzles via a corresponding one of the ink supply channels. The ink is supplied from the ink tank provided in the housing, via the flexible tube, to a damper case (i.e., a damping chamber) which is mounted on the carriage and which supplies the ink to each of the ink supply channels of the recording head The damper case includes a first member having an opening in one vertical side surface thereof, a second member having respective openings in two opposite, vertical side surfaces thereof and a filter sheet sandwiched by the open side surface of the first member and one of the two open side surfaces of the second member. The other open side surface of the second member is liquid-tightly closed by a flexible membrane. The first member has, in a lower end portion thereof an ink flow inlet communicating with the flexible tube connected at one end thereof to the stationary ink tank, and the second member has, in a lower end portion thereof an ink flow outlet communicating with each of the ink supply channels of the recording head.

In each of the ink jet printers disclosed by Patent Documents 1, 2, when the carriage is reciprocated, in particular, when the carriage is returned, inertia is exerted to the ink flowing in the flexible tube connecting between the stationary ink tank and the movable carriage, and accordingly the pressure of the ink supplied to,the recording head (or each of the ink ejection nozzles) is largely changed. This change of pressure of the ink is damped or absorbed by the deformation of the flexible membrane of the damping chamber, so that respective droplets of ink can be ejected from the respective nozzles with respective uniform ejection pressures and a recording quality of the recording head can be maintained.

However, in each of the ink jet printers disclosed by Patent Documents 1, 2, the damping chamber is vertical and one vertical side surface of the damping chamber is liquid-tightly closed by the flexible membrane. Thus, in the case where the ink jet printer employs a plurality of recording heads for the purpose of ejecting a plurality of sorts of color inks, respectively, and respective damper cases of the recording heads that define respective damping chambers corresponding to the color inks are arranged such that the damper cases are arranged parallel to each other it is required that the damper cases he appropriately spaced from each other so as to allow the flexible membrane of each damper case to deform by an appropriate amount. However, this leads to increasing the size of the apparatus mounted on the carriage and the total number of components of the apparatus, thereby increasing the production cost of the ink jet printer.

In addition, in the ink jet printer disclosed by Patent Document 2, a plane on which the ink flow inlet opens in the damping chamber is perpendicular to a plane on which the filter sheet or the flexible membrane extends, that is, a direction in which the ink flows from the ink flow inlet is parallel to the plane on which the filter sheet or the flexible membrane extends. In addition, the ink flow inlet opens at a position remote from the flexible membrane. Thus, the ink flowing at increased speeds out of the ink flow inlet does not directly act on the flexible membrane. More specifically described, first, the pressure increase of the ink, caused by inertia, directly acts on the flexible filter sheet, and the filter sheet is largely flexed because it cannot instantaneously allow all the increased amount of the ink to pass therethrough. Consequently the pressure of the ink present on the downstream side of the filter sheet is quickly increased, and then the flexible membrane is elastically deformed to increase the volume of the downstream-side chamber and thereby lower the increased pressure of the ink. Thus, the ink present in each ink ejection nozzle may be largely influenced by the pressure change of the ink caused by the inertia Also, in the ink jet printer disclosed by Patent Document 1, a great distance is present between a plane on which the ink flow inlet opens in the damper chamber and a plane on which the flexible membrane extends. Thus, the pressure increase of the ink, caused by inertia, does not directly act on the flexible membrane, and accordingly the flexible membrane cannot efficiently damp or absorb the pressure change of the ink.

In the above-indicated tube-supply-type ink jet printer, if air bubbles (i.e., air) are contained in the ink present in the recording head, the recording head may fail to eject the ink, or otherwise the recording quality of the head may lower. In this type of ink jet printer, however, air cannot be avoided from permeating the flexible tube and dissolving in the ink, because of the natural property of the material used to form the tube. Thus, it has been needed to provide an air-bubble collecting chamber on an upstream side of the recording head, collect or accumulate the air bubbles in the collecting chamber, and remove the thus collected air bubbles.

Hence, in a tube-supply-type ink jet printer disclosed by Patent Document 3 (Japanese Patent Application Publication No. 2000-103084 A), a recording head has, in an upper portion thereof an ink manifold (i.e., an air-bubble collecting chamber), and an ink tank and a circulating pump are fixed in position in a housing. The circulating pump is driven or operated to circulate the ink from the ink tank to a first ink flow passage, then the manifold, a second ink flow passage, and again the ink tank, so that the air bubbles produced in the circulation channel are returned to the ink tank and are removed. Meanwhile, at a waiting position in the housing, a sucking and purging device sucks ink from an ink ejection nozzle of the recording head.

However, in the above-indicated ink jet printer, it is needed to employ an ink returning tube for circulating the ink from the circulating pump back to the ink tank. Thus, the ink jet printer is complicated and is increased in size.

Furthermore, Patent Document 4 (Japanese Patent Application Publication No. 2002-240310 A) discloses an ink jet printer in which air produced in the form of air bubbles in an ink supply tube is accumulated in an upper portion of a tank mounted on a carriage, is discharged through a communication port by an air discharging pump, and then the communication port is air-tightly closed by an air discharging valve. However, the construction of the air discharging valve is not described in detail.

When the air discharging pump does not suck the air from the air-bubble collecting chamber, for example, when the recording head records images (e.g., letters and/or symbols) on a recording medium, the air discharging valve needs to air-tightly close the communication port and thereby stably keep the ink and the air bubbles in the air-bubble collecting chamber. On the other hand, when the recording head is checked for its maintenance, the air discharging valve needs to quickly open the communication port so as to communicate with an outside space and thereby discharge the air bubbles from the air-bubble collecting chamber.

In addition, since the air discharging valve is mounted on the carriage, the valve is repeatedly reciprocated with the carriage, during the recording operation of the ink jet printer. Therefore, the air discharging valve needs to have a small size, a light weight, and a simple construction.

DISCLOSURE OF THE INVENTION

It is therefore an object of the present invention to provide an ink jet printer which is free from at least one of the above-identified problems.

It is another object of the present invention to provide an ink jet printer employing a damping device which is mounted together with a recording head on a carriage and which enjoys at least one of a low production cost and a small overall size.

It is another object of the present invention to provide an ink jet printer employing an air discharging valve device which discharges air bubbles produced in an ink flow channel and which enjoys at least one of a simple construction and a stable operability.

According to a first aspect of the present invention, there is provided an ink jet printer, comprising a housing; a carriage which is movable in the housing relative thereto; an ink jet recording head which is mounted on the carriage and which has a plurality of ink supply channels; a damping device which is mounted on the carriage and which includes a plurality of damping chambers corresponding to the ink supply channels, respectively; an ink-tank supporting portion which is provided in the housing and which supports a plurality of ink tanks; and a plurality of ink supply tubes each of which supplies an ink from a corresponding one of the ink tanks to a corresponding one of the ink supply channels of the ink jet recording head via a corresponding one of the ink supply tubes and a corresponding one of the damping chambers, wherein the damping device further includes a primary partition wail which separates at least one first damping chamber of the damping chambers, from at least one second damping chamber of the damping chambers.

The ink tanks may be supported by the ink-tank supporting portion, in such a manner that the ink tanks are permanently fixed to the supporting portion, or in such a manner that the ink tanks are detachably attached to the supporting portion. The ink supply tubes have such a flexibility that allows the ink jet recording head and the damping device to be moved with the carriage. The carriage is movable relative to a recording medium such as a recording sheet.

In the ink jet printer in accordance with the first aspect of the present invention, the primary partition wall separates the at least one first damping chamber from the at least one second damping chamber. That is, the first and second damping chambers share the primary partition wall. Therefore, the damping device as a whole can enjoy a reduced size.

According to a second aspect of the present invention, there is provided an ink jet printer, comprising a housing: a carriage which is movable in the housing relative thereto; an ink jet recording head which is mounted on the carriage and which has at least one ink supply channel; a damping device which is mounted on the carriage and which includes a damper case having at least one damping chamber communicating with the at least one ink supply channel; an ink-tank supporting portion which is provided in the housing and which supports at least one ink tank and at least one ink supply tube which supplies an ink from the at least one ink tank to the at least one ink supply channel of the ink jet recording head via the at least one ink supply tube and the at least one damping chamber. The damping device further includes at least one flexible sheet which is spaced from, and is opposed to, at least one wall surface of the damper case so as to define the at least one damping chamber having at least one ink flow inlet to which the ink is supplied from the at least one ink supply tube, and at least one ink flow outlet from which the ink is supplied to the at least one ink supply channel of the ink jet recording head. The damping device has at least one ink introducing passage with which the at least one flow inlet communicates, which extends in a direction having a component perpendicular to the at least one flexible sheet, and which opens in the at least one damping chamber at a position nearer to the at least one flexible sheet than the at least one wall surface of the damper case, so that the at least one flexible sheet damps a change of pressure of the ink flowing form the at least one ink introducing passage into the at least one damping chamber.

When the carriage is reciprocated during an image recording or printing operation, the ink supply tube is also moved to flow the carriage. In particular, when the carriage is returned, the pressure of ink present in the ink supply tube is largely changed by inertia. This pressure change is propagated from the open end of the ink introducing passage opening in the damping chamber, to the flexible sheet defining the damping chamber. According to the second aspect of the present invention, the ink introducing passage which extends in a direction having a component perpendicular to the flexible sheet and is opposed to the flexible sheet, opens in the damping chamber at a position nearer to the flexible sheet than the wall surface of the damper case. That is, the open end of the ink introducing passage is located at a position near to the flexible sheet, so that the ink flow can directly act on the flexible sheet and the pressure change of the ink in the ink supply tube can be efficiently damped or absorbed by the flexible sheet. Though the open end of the ink introducing passage is near to the flexible sheet, an appropriate volume of damping chamber can be provided between the flexible sheet and the wall surface of the damper case. Thus, the flexible sheet can exhibit an excellent pressure-change damping effect, According to a third aspect of the present invention, there is provided an ink jet printer, comprising; a housing; a carriage which is movable in the housing relative thereto; an ink jet recording head which is mounted on the carriage and which has at least one ink supply channel; a damping device which is mounted on the carriage and which includes at least one damping chamber communicating with the at least one ink supply channel; an ink-tank supporting portion which is provided in the housing and which supports at least one ink tank; and at least one ink supply tube which supplies an ink from the at least one ink tank to the at least one ink supply channel of the ink jet recording head via the at least one ink supply tube and the at least one damping chamber. The at least one damping chamber has at least one ink flow inlet to which the ink is supplied from the at least one ink supply tube, and at least one ink flow outlet from which the ink is supplied to the at least one ink supply channel of the ink jet recording head. The damping device further includes at least one pressure-change damping portion which at least partly defines the at least one damping chamber and which damps a change of pressure of the ink flowing from the at least one ink flow inlet into the at least one damping chamber, and at least one flow restricting portion which restricts a flow of the ink from the at least one ink flow inlet toward the at least one ink flow outlet. The at least one pressure-change damping portion is located on an upstream side of the at least one flow restricting portion in a direction of the flow of the ink from the at least one ink flow inlet toward the at least one ink flow outlet.

When the carriage is reciprocated during an image recording operation, the ink supply tube is also moved to follow the carriage in particular, when the carriage is returned, the pressure of the ink present in the ink supply tube is largely changed by inertia. This pressure change is propagated from the ink flow inlet to the damping chamber. According to the third aspect of the present invention, the pressure change of the ink, directed toward the ink flow outlet, is restricted by the flow restricting portion, and is sufficiently damped or absorbed by the pressure-change damping portion located on the upstream side of the flow restricting portion. Then, after the pressure change of the ink (or the flow-velocity change of the ink) is further attenuated by the flow restricting portion, the ink is supplied from the ink flow outlet to the recording head. Thus, ink ejection nozzles of the recording head is freed of the problem of pressure change of ink, and the recording head can enjoy a high recording quality.

According to a fourth aspect of the present invention, there is provided an ink jet printer, comprising a recording head which has at least one ink ejection nozzle and which ejects, from the at least one ink ejection nozzle, a droplet of at least one sort of ink toward a recording medium so as to record an image on the recording medium; a carriage on which the recording head is mounted; an ink-tank supporting portion which supports at least one ink tank which stores the at least one sort of ink to be supplied to the recording head; at least one ink flow channel which supplies the at least one sort of ink from the at least one ink tank to the recording head; at least one air-bubble collecting chamber which collects air bubbles produced in the at least one ink flow channel and which is mounted on the carriage; and an air discharging valve device which discharges the air bubbles collected by the at least one air-bubble collecting chamber and which is mounted on the carriage. The air discharging valve device includes at least one valve hole which has, at one of axially opposite ends thereof a communication port via which the at least one air-bubble collecting chamber communicates with an outside space, and at least one valve member which is displaceable in the at least one valve hole in an axial direction thereof so as to open and close the communication port thereof. The at least one valve hole includes a small-inner-diameter portion and a large-inner-diameter portion which are opposed to an outer circumferential surface of the at least one valve member. The small-inner-diameter portion is nearer to the communication port than the large-inner-diameter portion, and a first clearance between the at least one valve member and the small-inner-diameter portion is smaller than a second clearance between the at least one valve member and the large-inner-diameter portion, such that the small-inner-diameter portion guides the at least one valve member and the large-inner-diameter portion does not guide the at least one valve member.

In the ink jet printer according to the fourth aspect of the present invention, the valve member is displaceable in the valve hole in the axial direction thereof so as to open and close the communication port thereof. Therefore, the air discharging valve device which discharges the air bubbles from the air-bubble collecting chamber into the outside space via the communication port, can enjoy a small size and a simple structure. In addition, the inner circumferential surface of the valve hole that is opposed to the outer circumferential surface of the valve member includes the small-inner-diameter portion that is near to the communication port and has the small inner diameter assuring that the small-inner-diameter portion can contact the valve member. Therefore, the small-inner-diameter portion can smoothly guide the valve member to the communication port, such that the valve member can completely close the communication port. In addition, in a state in which the valve member is held at an open position thereof where the valve member opens the communication port, the outer circumferential surface of the valve member is opposed to the inner circumferential surface of the small-inner-diameter portion over an a length of the valve member that assures that an air flow passage (the first clearance) is provided between the small-inner-diameter portion and the valve member. The inner circumferential surface of the valve hole additionally includes the large-inner-diameter portion that is remote from the communication port and has the large inner diameter assuring that the clearance (the second clearance) is provided between the large-inner-diameter portion and the valve member. Thus, the large-inner-diameter portion does not disturb the flow of air in the valve hole or damage the movability or slideability of the valve member in the valve hole.

According to a fifth aspect of the present invention, there is provided an ink jet printer, comprising a recording head which has at least one ink ejection nozzle and which ejects, from the at least one ink ejection nozzle, a droplet of at least one sort of ink toward a recording medium so as to record an image on the recording medium; a carriage on which the recording head is mounted; an ink-tank supporting portion which supports at least one ink tank which stores the at least one sort of ink to be supplied to the recording head; at least one ink flow channel which supplies the at least one sort of ink from the at least one ink tank to the recording head; at least one air-bubble collecting chamber which collects air bubbles produced in the at least one ink flow channel and which is mounted on the carriage; and an air discharging valve device which discharges the air bubbles collected by the at least one air-bubble collecting chamber and which is mounted on the carriage. The air discharging valve device includes at least one valve seat which has a communication port via which the at least one air-bubble collecting chamber communicates with an outside space, and further includes at least one valve member which is contactable with, and separable from, the at least one valve seat so as to open and close the communication port and which is biased in a direction to close the communication port. The at least one valve member and the at least one valve seat have respective contactable surfaces which are contactable with, and separable from, each other and at least one of which has a pre-selected roughness.

In the ink jet printer according to the fifth aspect of the present invention, the air-bubble collecting chamber located on the upstream side of the recording head can collect the air bubbles produced in the ink flow passage and prevent the air bubbles from entering the recording head. The air discharging valve device can be opened to discharge the air bubbles from the air-bubble collecting chamber into the outside space. In addition, since at least one of the respective contactable surfaces of the valve member and the valve seat is formed to have a predetermined roughness, the valve member and the valve seat can be easily separated from each other. That is, the valve member is prevented from being stuck to the valve seat or thereby fixedly closing the communication port Thus, the valve member can be quickly and reliably operated relative to the communication port in the valve hole.

According to a sixth aspect of the present invention, there is provided an ink jet printer, comprising a recording head which has at least one ink ejection nozzle and which ejects, from the at least one ink ejection nozzle, a droplet of at least one sort of ink toward a recording medium so as to record an image on the recording medium; a carriage on which the recording head is mounted; an ink-tank supporting portion which supports at least one ink tank which stores the at least one sort of ink to be supplied to the recording head; at least one ink flow channel which supplies the at least one sort of ink from the at least one ink tank to the recording head; at least one air-bubble collecting chamber which collects air bubbles produced in the at least one ink flow passage and which is mounted on the carriage; and an air discharging valve device which can discharge the air babbles collected by the at least one air-babble collecting chamber and which is mounted on the carriage. The air discharging valve device includes at least one valve seat which has a communication port via which the at least one air-bubble collecting chamber communicates with an outside space, and farther includes at least one valve member which is contactable with, and separable from, the at least one valve seat so as to open and close the communication port thereof and which is biased in a direction to close the communication port. The at least one valve member and the at least one valve seat have respective contactable surfaces which are contactable with, and separable from, each other, the contactable surface of the at least one valve seat is formed of an acetal resin, and at least the contactable surface of the at least one valve member is formed of an elastic material.

In the ink jet printer according to the sixth aspect of the present invention, the valve member can be prevented from being stuck to the valve seat or thereby fixedly closing the communication port. Thus, the valve member can be quickly and reliably operated in the valve hole, so as to discharge the air bubbles from the air-bubble collecting chamber into the outside space.

According to a seventh aspect of the present invention, there is provided an ink jet printer, comprising a recording head which has at least one ink ejection nozzle and which ejects, from the at least one ink ejection nozzle, a droplet of at least one sort of ink toward a recording medium so as to record an image on the recording medium; a carriage on which the recording head is mounted; an ink-tank supporting portion which supports at least one ink tank which stores the at least one sort of ink to be supplied to the recording head; at least one ink flow channel which supplies the at least one sort of ink from the at least one ink tank to the recording head; at least one air-bubble collecting chamber which collects air bubbles produced in the at least one ink flow channel and which is mounted on the carriage; and an a discharging :valve device which discharges the air bubbles collected by the at least one air-bubble collecting chamber and which is mounted on the carriage. The air discharging valve device includes at least one valve seat which has a communication port via which the at least one air-bubble collecting chamber communicates with an outside space, and further includes at least one valve member which is contactable with, and separable from, the at least one valve seat so as to open and close the communication port and which is biased in a direction to close the communication port The at least one valve member and the at least one valve seat have respective contactable surfaces which are contactable with, and separable from, each other, at least the contactable surface of the at least one valve member is formed of an elastic material, and the contactable surface of the at least one valve seat has a roughness Rz of not lower than 0.8 μm and not higher than 1.6 μm.

In the ink jet printer according to the seventh aspect of the present invention, the valve member and the valve seat can be easily separated from, and be easily sealed to, each other, irrespective of which material may be used to form each of the valve member and the valve seat.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 20A is a perspective top view of an upper case of a damper case of a damping device of the recording head unit;

FIG. 20B is a perspective top view of a lower case of the damper case;

DETAILED DESCRIPTION OF THE PREFERRED EMBODIMENTS

Figure 1:
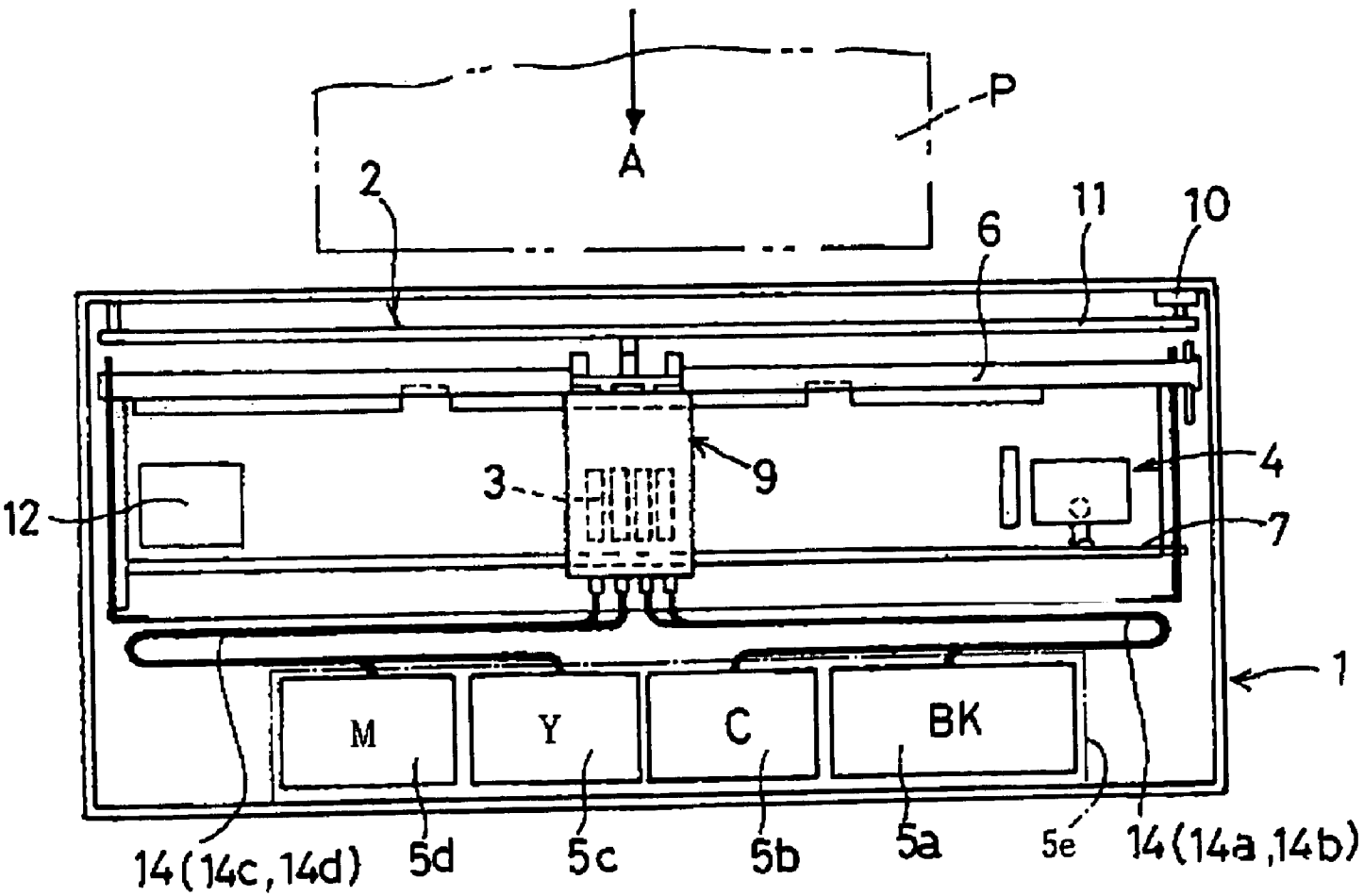
FIG. 1 is a plan view of an ink jet printer as a first embodiment of the present invention.

Hereinafter, there will be described a preferred embodiment of the present invention by reference to the drawings. As shown in FIG. 1, an ink jet printer as an embodiment of the present invention includes a recording portion 2, a maintenance unit 4, and four ink tanks 5 (5*a*, 5*b*, 5*c*, 5*d*) each of which is detachably attached to an ink-tank supporting member 5*e*. The recording portion 2 is incorporated in a housing 1, and includes a recording head unit 3 that ejects a droplet of ink toward a recording sheet P as a sort of recording medium so as to record or print images (e.g., characters, symbols, etc) thereon. The maintenance unit 4 performs maintenance of the recording head unit 3 of the recording portion 2. The four ink tanks 5 store respective different sorts of color inks to be supplied to the recording head unit 3.

The four ink tanks 5*a*, 5*b*, 5*c*, 5*d* store, for recording a full-color image on the recording sheet P, a black ink (BK), a cyan ink (C), a yellow ink (Y), and a magenta (M) ink, respectively. When the ink stored in each of the ink tanks 6 is used out, a user can replace the each ink tank 5 with a new one.

In the recording portion 2, a rear guide bar 6 and a front guide bar 7 are provided such that the two guide bars 6, 7 are each elongate in a lengthwise direction of the housing 1 and extend parallel to each other; and a carriage 9 is placed on the two guide bars 6, 7, such that the carriage 9 is movable relative the same 6, 7. The recording head unit 3 is integrally attached to the carriage 9 and is thus mounted on the same 9.

A carriage drive motor 10, provided in a rear, right corner of the housing 1, and an endless, timing belt 11 cooperate with each other to reciprocate the carriage 9 on the front and rear guide bars 7, 6, in the lengthwise direction of the housing 1. A well-known sheet ceding device, not shown, feeds the recording sheet P such that the paper P passes in its horizontal posture under a lower surface of the recording head unit 3, in a direction, indicated by arrow "A" in FIG. 1, that is perpendicular to the directions in which the carriage 9 is reciprocated.

At an ink flushing position in one of opposite side areas outside the width of the recording sheet P being fed (i.e., the left-hand side area shown in FIG. 1), an ink collecting portion 12 is provided; and, at a head waiting position in the other side area (i.e., the right-hand side area shown in FIG. 1), the maintenance unit 4 is provided. Thus, during a recording operation of the ink jet printer, the recording head unit 3 is periodically moved to the ink flushing position where the head unit 3 is controlled to eject ink to prevent clogging of nozzles 22 (22*a*, 22*b*, 22*c*, 22*d*, FIG. 2), and the ink collecting portion 12 collects the thus ejected ink. At the head waiting position the maintenance unit 4 performs a cleaning operation to clean a nozzle supporting surface of the head unit 3 that supports the nozzles 22. In addition, the maintenance unit 4 performs a recovering operation to suck an arbitrary one of the four color inks, and a removing operation to remove air bubbles (i.e., air) from a damping device 13 FIG. 3), described later.

At a height position lower than the nozzle supporting surface (.e., the lower surface) of the recording head unit 3, each of the four ink tanks 5 can be inserted, in a direction from the front side to the rear side, into a corresponding one of four ink-tank holding portions of the ink-tank supporting member 5*e*. as shown in FIG. 1, the black ink (BK) tank 5*a*, the cyan ink (C) tank 5*b*, the yellow ink (Y) tank 5*d*, and the magenta ink (M) tank 5*c* are provided such that the four ink tanks 5 are arranged in an array in the order of description in a direction from the right-hand side, to the left-hand side, extend along a straight line, and each take a horizontal posture.

Each of the four ink-tank holding portions of the ink-tank supporting member 5*e* has an ink supply hollow needle, not shown, that projects horizontally from a rear wall of the supporting member 5*e*, in a frontward direction opposite to the direction in which a corresponding one of the four ink tanks 5 is inserted. Respective base end portions of the four hollow needles are connected to the recording head unit 3 via respective highly flexible ink supply tubes 14 (14*a*, 14*b*, 14*c*, 14*d*). Respective intermediate portions of the black ink supply tube 14*a* and the cyan ink supply tube 14*b* are superposed on each other and are bound together; and respective intermediate portions of the yellow ink supply tube 14*c* and the magenta ink supply tube 14 are superposed on each other and are bound together.

Next, the recording head unit 3 mounted on the carriage 9 will be described by reference to FIGS. 2 and 8. In the present embodiment, the full color image recording head unit 3 includes a head holder 20, an ink jet recording head 21, the damping device 13, and an air discharging valve device 26. The head holder 20 has a box-like configuration. The recording head 21 is fixed to a lower surface of a bottom wall 20*a* of the head holder 20; and the damping device 13 is fixed to an upper surface of the bottom wall 20*a*.

Figure 2:
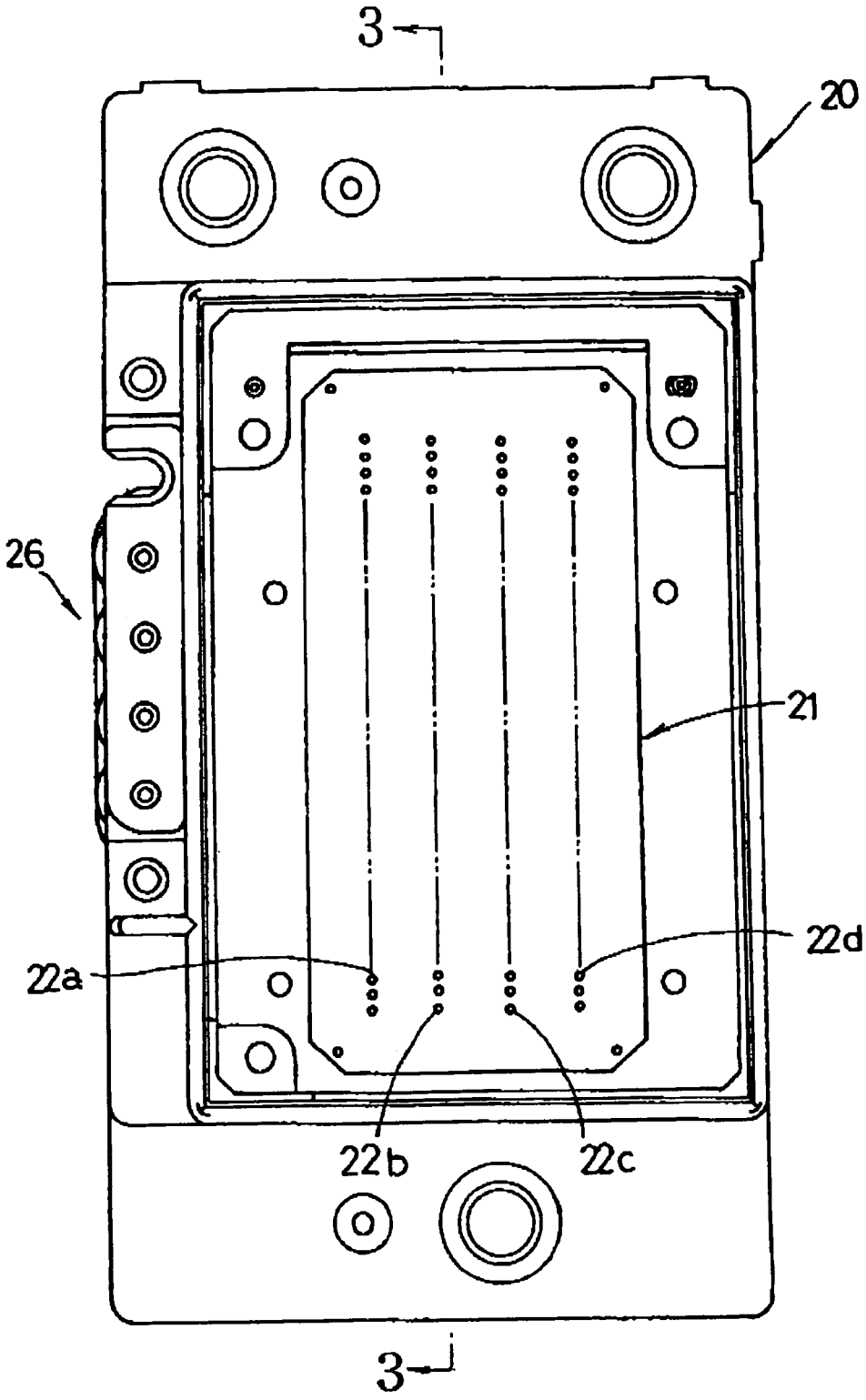
FIG. 2 is a bottom view of a recording head unit of the ink jet printer.

FIG. 2 is a bottom view of the recording head 21. As shown in the figure, a lower surface of the recording head 21 supports four arrays of nozzles 22*a*, 22*b*, 22*c*, 22*d* corresponding to the black ink (BK), the cyan ink (C), the yellow ink (Y), and the magenta ink (M), respectively, in the order of description, in the direction from the left-hand side to the right-hand side, such that each array of the four arrays of nozzles 22 extends in a direction perpendicular to the directions (i.e., a recording direction) in which the carriage 9 is reciprocated Each of the nozzles 22 opens downward so as to face an upper surface of the recoding sheet P.

Like a known recording head disclosed by Japanese Patent Application Publication No. 2002-67312 or Japanese Patent Application Publication No. 2001-219560, the recording head 21 has, in a portion of an upper surface thereof, four ink supply holes, not shown, which correspond to the four color inks, respectively, and which communicate with four ink supply channels, not shown, respectively. Each of the four color inks is supplied to a plurality of pressure chambers, not shown, via a corresponding one of the four ink supply channels. Thus, the recording head 21 has four arrays of pressure chambers corresponding to the four arrays of nozzles 22, respectively, and four arrays of actuators, such as piezoelectric elements, corresponding to the four arrays of pressure chambers, respectively. The recording head 21 ejects a droplet of ink from an arbitrary one of the nozzles 22 when a corresponding one of the pressure chambers is actuated by a corresponding one of the actuators. A nozzle unit includes the four arrays of nozzles 22*a*, 22*b*, 22*c*, 22*d*, and an actuator unit 23 includes the four arrays of actuators. A flexible flat cable 24 that applies an electric voltage to each of the actuators is fixed to an upper surface of the actuator unit 23. The four color inks are supplied from the four ink tanks 5 to the four ink supply inlets of the recording head 21 via the four ink supply tubes 14 and the damping device 13. Thus, the four ink supply tubes 14 and the damping device 13 cooperate with each other to provide four ink flow channels.

Next, respective constructions of the damping device 13 and the air discharging valve device 26 will be described in detail by reference to FIGS. 3 to 6, 7A, 7B, 8A, 8B, and 8C. The damping device 13 has four damping chambers 27 (27*a*, 27*b*, 27*c*, 27*d*) which correspond to the four color inks, respectively, and which are independent of each other. The damping device 13 has a primary partition wall 35 and secondary partition walls 35*a*, 35*b*, 30 which cooperate with each other to separate the four damping chambers 27 from each other. In the present embodiment, a portion (ie., a first chamber) 27*a*-1 of the black ink (BK) damping chamber 27*a* is located under the primary partition wall 35; and other portions (ie., second and third chambers) 39*a*, 55*a* of the black ink (BK) damping chamber 27*a*, and the cyan ink (C), yellow ink (Y), and magenta ink (M) damping chambers 27*b*, 27*c*, 27*d* are located above the primary partition wall 35, and are separated from each other by the secondary partition walls 35*a*, 35*b*, 30. Thus, the four damping chambers 27 are provided in two layers, ie., upper and lower layers.

More specifically described, a damper case 25 of the damping device 13 has a generally rectangular, box-like outer wall, and includes an upper case 81 and a lower case 32 each of which is formed, by injection, of a synthetic resin. The lower case 32 opens upward and downward; and the upper case 31 is fixed to the lower case 32 so as to close the upper open end thereof. The upper case 31 is liquid-tightly bonded by, e.g., ultrasonic welding to the lower case 32.

The lower case 32 includes a damping-device supporting portion 33 that supports the damping device 13 including the four damping chambers 27; and an air-discharging-valve-device supporting portion as an accommodating portion 34 that accommodates the air discharging valve device 26 including four air discharging valve members 57, described later. The damping-device supporting portion 33 and the accommodating portion 34 are integral with each other. The lower case 32 has a lower opening which occupies a major portion of a:lower surface thereof, and the primary partition wall 35 of the lower case 32 is distant inward from, and is parallel to, each of the upper and lower open ends thereof The lower open end of the lower case 32 is fluid-tightly closed by a flexible membrane 36 as a flexible sheet that is constituted by a thin film formed of a synthetic resin and does not allow permeation of air or liquid. The flexible membrane 36 functions as a pressure-change damping portion, as described later. More specifically described, an outer periphery of the flexible membrane 36 is bonded by, e.g., adhesion or ultrasonic welding to a lower end of a side wall 87 of the lower case 82 that defines the lower opening of the lower case 32. The flexible membrane 36 and the primary partition wall 35 cooperate with each other to define the first chamber 27*a*-1 of the black ink (BK) damping chamber 27*a*. The damping device 13 is fixed to the head holder 20, such that between the flexible membrane 36 and the bottom wall 20*a* of the head holder 20, there is left a clearance which allows deformation of the flexible membrane 36.

Figure 6:
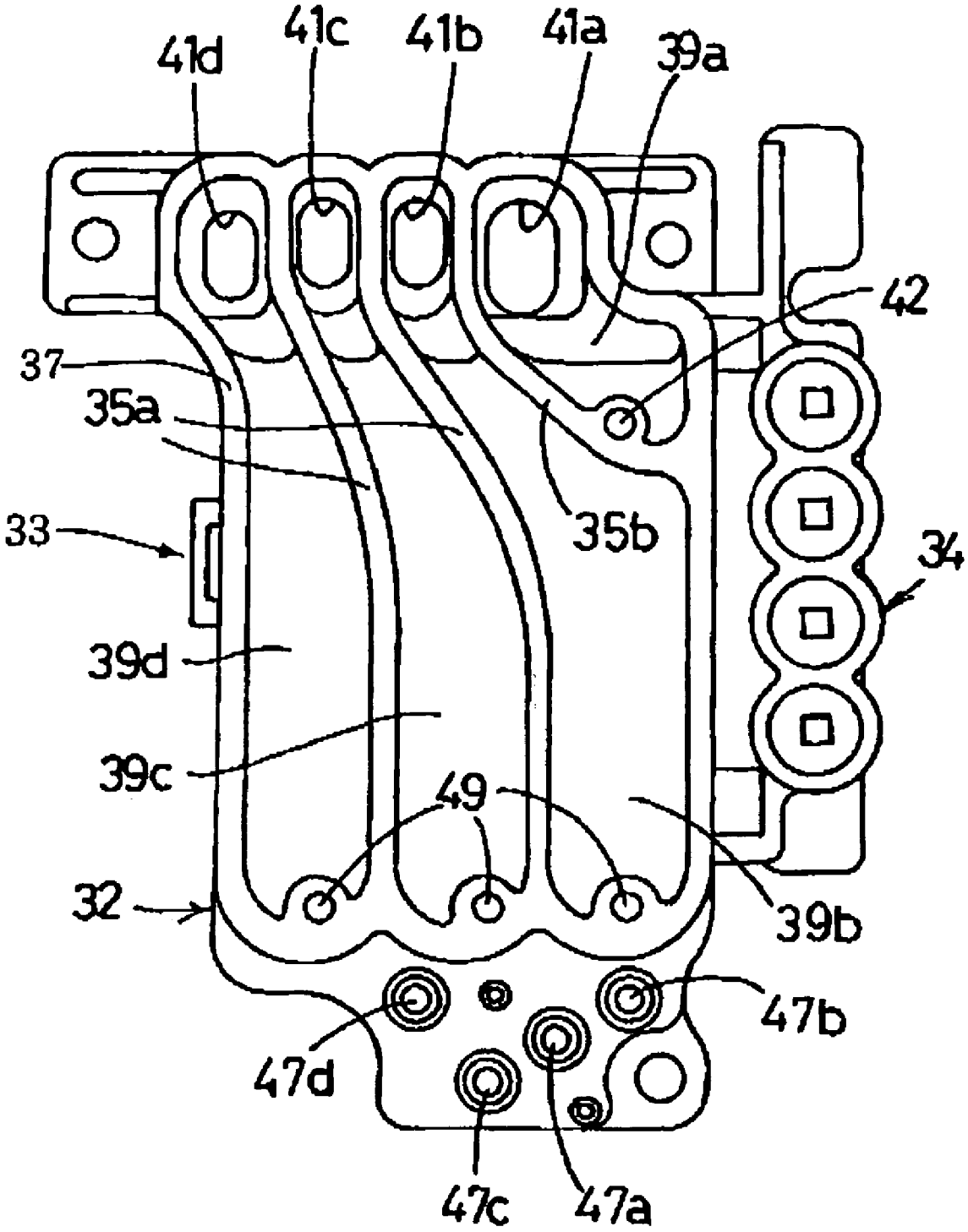
FIG. 6 is a plan view of a lower case of a damper case of the damping device.
Figure 7A:
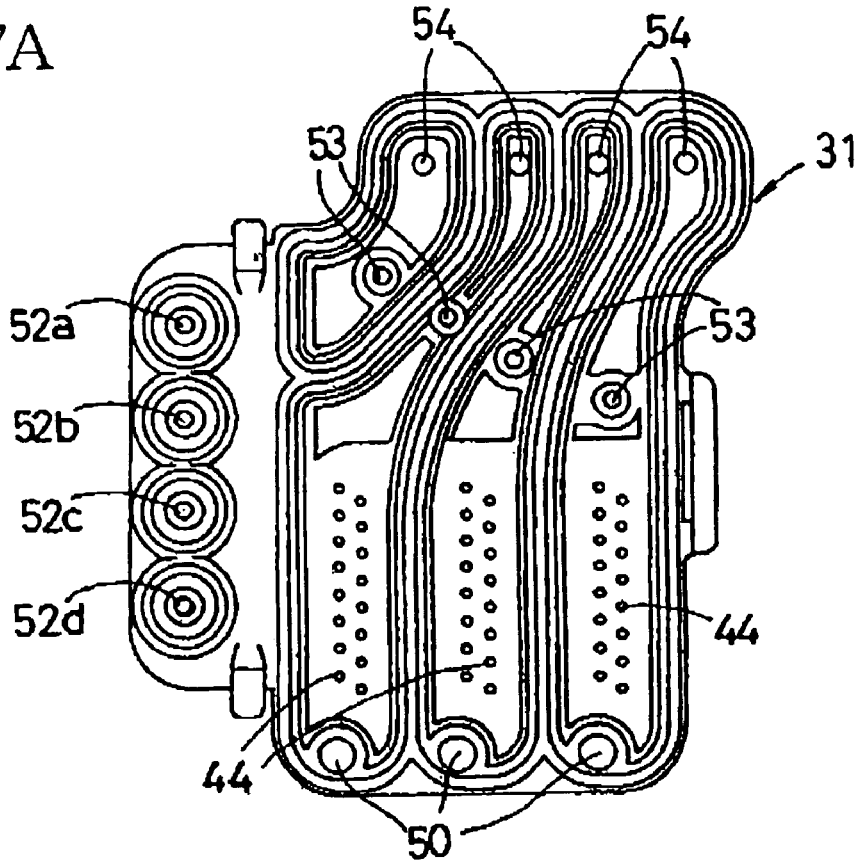
FIG. 7A is a bottom view of an upper case of the damper case of the damping device.
Figure 7B:
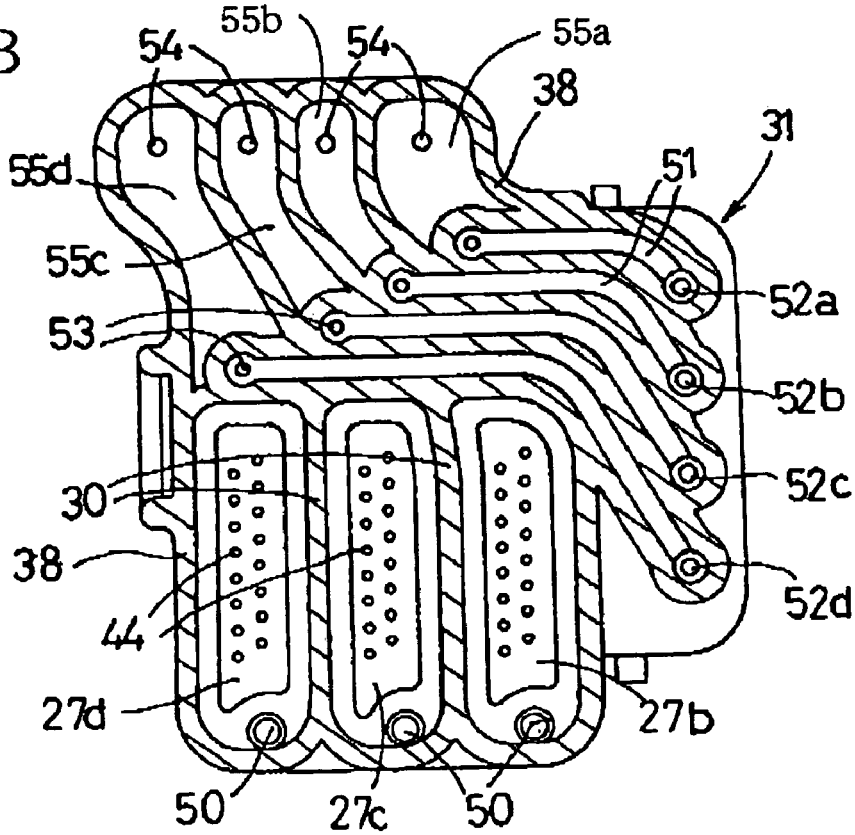
FIG. 7B is a plan view of the upper case of the damper case of the damping device.

The two secondary partition walls 35*a* and the one secondary partition wall 35*b* extend upward from the upper surface of the primary partition wall 35, as shown in FIG. 6. Thus, an upper portion of the lower case 32 that is located above the primary partition wall 35, cooperate with the upper case 31 to define respective portions (i.e., second chambers) 39 (39*a*, 39*b*, 39*c*, 39*d*) of the four damping chambers 27. In the present embodiment, the two secondary partition walls 35*a* which are distant from each other cooperate with the side wall 37 of the lower case 32 and the secondary partition wall 35*b* to define the respective portions (i.e., second chambers) 39*b*, 39*c*, 39*d* of the cyan ink (C), yellow ink (Y), and magenta ink (M) damping chambers 27*b*, 27*c*, 27*d*. Respective first chambers 27*b*-1, 27*c*-1, 27*d*-1 of the cyan ink (C), yellow ink (Y), and magenta ink (M) damping chambers 27*b*, 27*c*, 27*d* will be described later. As shown in FIG. 6, the secondary partition walls 35*a* extend horizontally over a substantially entire length of the lower case 32. The respective second chambers 39*a*, 39*c*, 39*d* of the three damping chambers 27*b*, 27*c*, 27*d* communicate, at respective positions horizontally offset from the upper surface of the primary partition wall 35, with respective ink flow outlets 41*b*, 41*e*, 41*d* corresponding to the cyan ink (C), yellow ink (Y), and magenta ink (M), respectively.

The secondary partition wall 35*b* cooperates with the side wall 37 of the lower case 32 to define the second chamber 39*a* of the black ink (BK) damping chamber 27*a*. As shown in FIG. 6, the secondary partition wall 35*b* extends horizontally to a position which is horizontally offset from the upper surface of the primary partition wall 35 and near to the ink flow outlets 41*b*, 41*c*, 41*d*, and the second chamber 39*a* communicates with an ink flow outlet 41*a* corresponding to the black ink (BK). The respective second chambers 39*a*, 39*b*, 39*c*, 39*d* of the four damping chambers 27*a*, 27*b*, 27*c*, 27*d* function as respective air-bubble trapping or collecting chambers, as will be described later.

Figure 5:
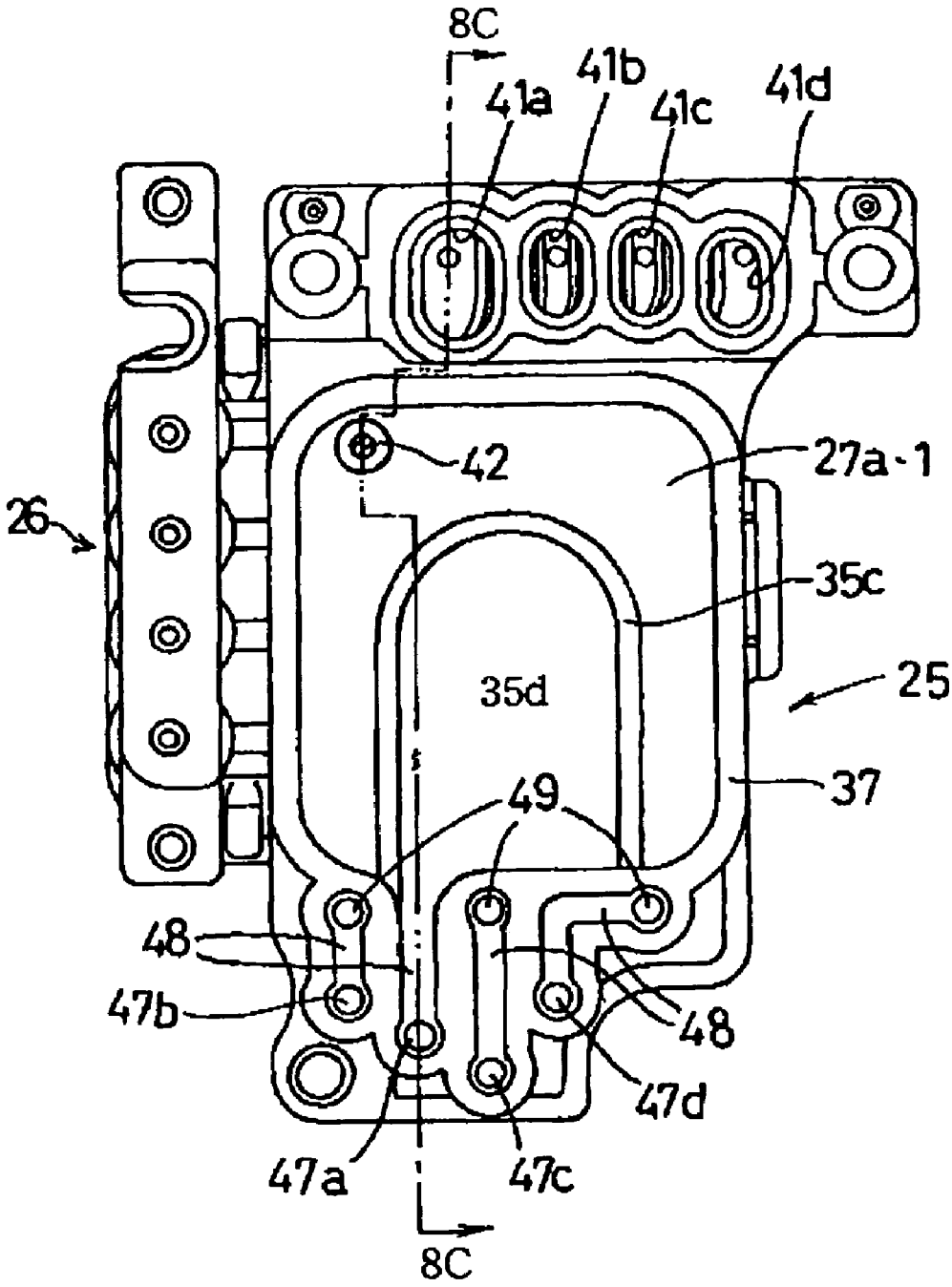
FIG. 5 is a bottom view of the damping device of the ink jet printer, with a lower flexible membrane of the damping device being removed.
Figure 8A:
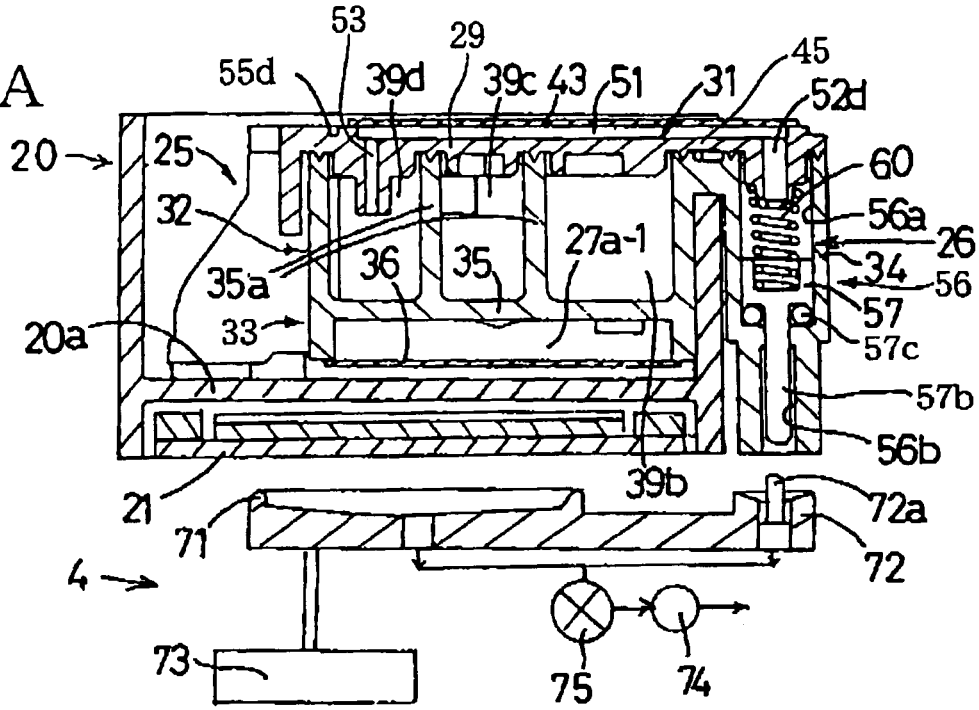
FIG. 8A is a cross-section view taken and viewed along arrows indicated by 8A, 8A in FIG. 4.
Figure 8B:
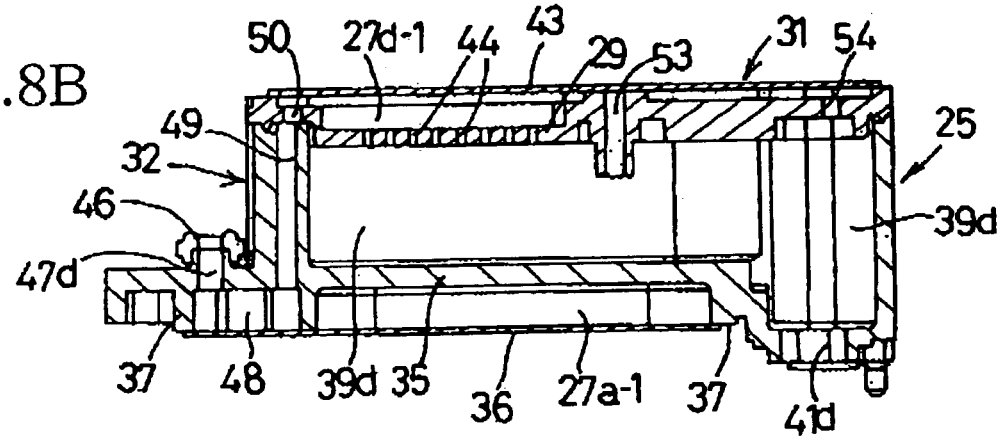
FIG. 8B is a cross-section view taken and viewed along arrows indicated by 8B, 8B in FIG. 4.
Figure 8C:
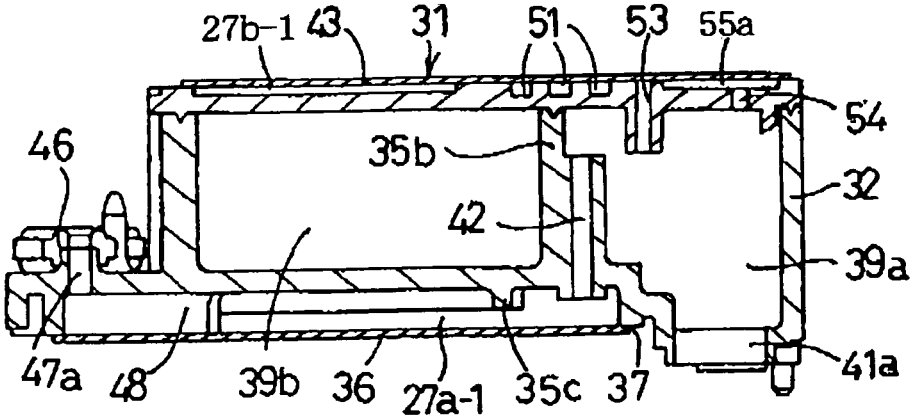
FIG. 8C is a cross-section view taken and viewed along arrows indicated by 8C, 8C in FIG. 5.

The first chamber 27*a*-1 of the black ink (BK) damping chamber 27*a* communicates with the second chamber 39*a* thereof, via an ink flow passage 42 that is vertically formed through a cylindrical wall formed along the secondary partition wall 35*b*, as shown in FIGS. 5, 6, and 8C. The ink flow passage 42 functions as a flow restricting portion. The ink flow passage 42 has a cross-section area smaller than that of the first chamber 27*a*-1, and accordingly has a greater resistance to flow of fluid (e.g., ink therethrough than that of the same 27*a*-1.

The upper case 31 has a generally flat configuration, and has a plurality of recesses formed in an upper surface thereof. The upper case 31 includes a lid portion 29 which covers the upper open end of the damping-device supporting portion 33; and an extension portion 45 which extends from the lid portion 29 so as to cover the upper open end of the accommodating portion 34, as shown in FIGS. 8A, 8B, and 8C.

Figure 4:
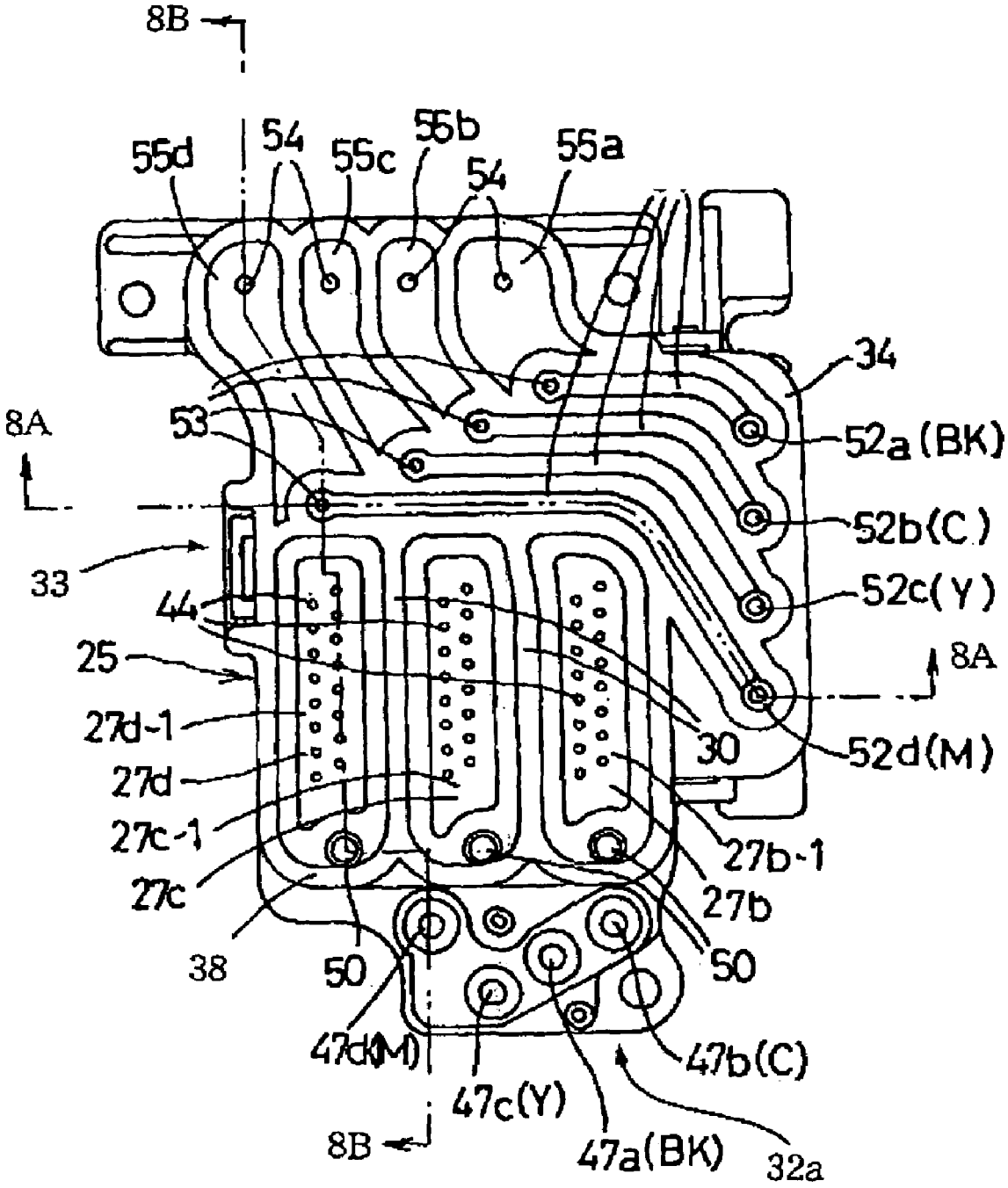
FIG. 4 is a plan view of a damping device of the ink jet printer, with an upper flexible membrane of the damping device being removed.

In the present embodiment, as shown in FIG. 4, the upper case 31 has, on the upper surface thereof the two secondary partition walls 30 which separate respective portions (ie., first chambers) 27*b*-1, 27*c*-1, 27*d*-1 of the cyan ink (C), yellow ink (Y), and magenta ink (M) damping chambers 27*b*, 27*c*, 27*d*, from each other. The three first chambers 27*b*-1, 27*c*-1, 27*d*-1 are substantially aligned with, and located above, the downward opening, first chamber 27*a*-1 of the black ink (BK) damping chamber 27*a*, and all those chambers 27*b*-1, 27*c*-1, 27*d*-1 open upward. The two secondary partition walls 30 of the upper case 31 are partly located on respective planes vertically extended from the two secondary partition walls 35*a* of the lower case 32. The lid portion 29 defines respective bottom walls of the three first chambers 27*b*-1, 27*c*-1, 27*d*-1, and has a plurality of communication holes 44 vertically farmed through a thickness of the lid portion 29. Each of the holes 44 may have a circular cross section having a diameter of about 0.8 mm, or a square cross section having each side of about 0.8 mm. The communication holes 44 cooperate with each other to function as a flow restricting portion, like the ink flow passage 42. Thus, each of the three first chambers 27*b*-1, 27*c*-1, 27*d*-1 communicates, via corresponding ones of the communication holes 44, with a corresponding one of the three second chambers 39*b*, 39*c*, 39*d* that is located below the each first chamber and is defined by the secondary partition walls 35*a* in the lower case 32.

Each of the communication holes 44 has a cross-section area smaller than that of each of the three first chambers 27*b*-1, 27*c*-1, 27*d*-1, and accordingly has a greater resistance to flow of fluid therethrough than that of the same 27*b*-1, 27*c*-1, 27*d*-1.

Respective upper open ends of the three first chambers 27*b*-1, 27*c*-1, 27*d*-1, and respective upper open ends of four air discharging passages 51 corresponding to the four color inks are commonly closed by a single flexible membrane 43 as a flexible sheet that is constituted by a film formed of a synthetic resin and does not allow permeation of air or liquid. The flexible membrane 43 functions as a pressure-change damping portion, as described later. More specifically described, an outer periphery of the flexible membrane 43 is bonded by, e.g., adhesion or ultrasonic welding to an upper end of an outer peripheral wall of the upper case 81 that defines respective outer peripheries of the three first chambers 27*b*-1, 27*c*-1, 27*d*-1, and respective upper ends of the secondary partition walls 30. Thus, each of the three first chambers 27*b*-1, 27*c*-1, 27*d*-1 is partly defined by the lid portion 29 of the upper case 31.

As shown in FIG. 5, the four ink flow outlets 41*a*, 41*b*, 41*c*, 41*d* are arranged in an array in the lower surface of the lower case 32, and open downward at a height position: lower than a height position where the lower flexible membrane 36 is provided. Meanwhile, the recording head 21 has, in the upper surface thereof, the four ink supply holes, not shown, which communicate with respective one ends of the four ink supply channels (i,e., four common ink chambers) corresponding to the four color inks, respectively, and which are opposed to the four ink flow outlets 41, respectively. The bottom wall 20*a* of the head holder 20 has four through-holes which allow the four ink flow outlets 41 to communicate with the four ink supply holes of the recording head 21 via respective sealing members 40 such as rubber packing members.

Figure 3:
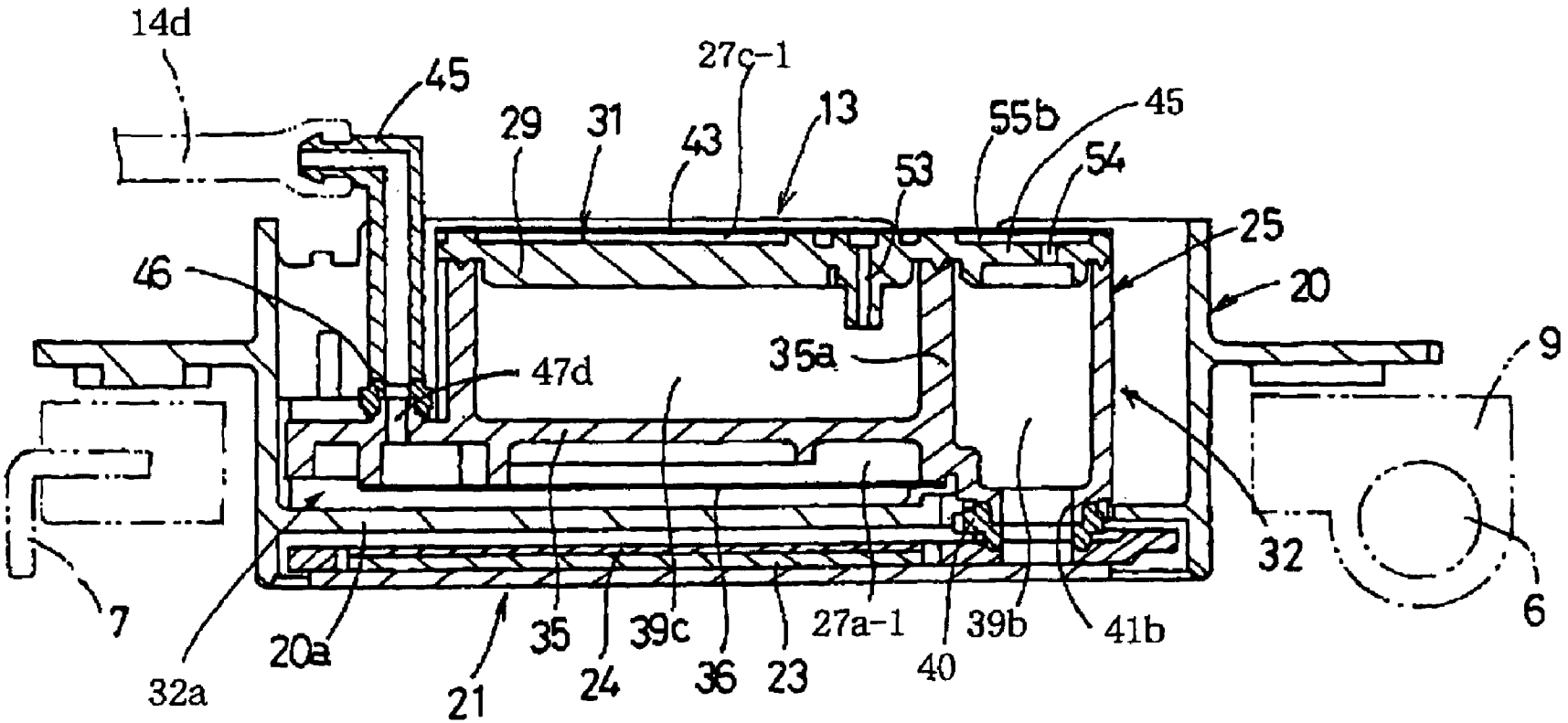
FIG. 3 is a cross-section view taken and viewed along arrows indicated by 3, 3 in FIG. 2.

The lower case 32 includes a flange-like projecting portion 32*a* which laterally projects from one side of the lower case 32 that is opposite to the ink flow outlets 41, As shown in FIGS. 3 and 4, the projecting portion 32*a* has four ink flow inlets 47 (47*a*, 47*b*, 47*c*, 47*d*) which correspond to the black ink (BK), the cyan ink (C), the yellow ink (Y), and the magenta ink (M), respectively, and each of which opens upward.

Four joint members; 45 are connected to the four ink flow inlets 47, respectively, via respective sealing members 46 such as rubber packing members. Respective upstream-side ends of the four joint members 45 are connected to respective downstream-side ends of the four ink supply tubes 41 corresponding to the four color inks, respectively. The four ink supply tubes 41 define respective portions of the four ink flow channels.

As shown in FIGS. 4, 5, 7A, 7B, and 8B, the ink flow inlet 47*a* corresponding to the black ink (BK) communicates with the first chamber 27*a*-1 of the black ink damping chamber 27*a* via a connection passage 48 in the form of a horizontal groove which is formed in the lower surface of the lower case 32 and opens downward; and the other, three ink flow inlets 47*b*, 47*c*, 47*d* corresponding to the other, three color inks communicate with the respective first chambers 27*b*-1, 27*c*-1, 27*d*-1 of the other, three damping chambers 27*b*, 27*c*, 27*d* via respective connection passages or horizontal grooves 48 which are formed in the lower surface of the lower case 32 and open downward, respective communication passages 49 vertically extending in the side wall 37 of the lower case 32 (in a direction substantially perpendicular to the primary partition wall 35), and respective communication passages (i.e., ink introducing passages) 50 vertically extending in the upper case 31. Since respective upper open ends of the three communication passages 50 of the upper case 31 are located at respective height positions that are near to a lower surface of the flexible membrane 43, the inks flowing into the fist chambers 27*b*-1, 27*c*-1, 27*d*-1 can directly collide with the flexible membrane 43 that is near, and opposed, to the respective upper open ends of the communication passages 50, so that respective dynamic changes of pressure of the inks in the flexible ink supply tubes 14*b*, 14*c*, 14*d* can be efficiently absorbed and attenuated, i.e., damped by the flexible membrane (i.e., pressure-change damping portion) 43. For the black-ink damping chamber 27*a*, the ink flow inlet 47*a* and the connection passage 48 connected thereto can be said as an ink flow inlet communicating with the corresponding ink introducing passage 50; and for each of the cyan-ink, yellow-ink, and magenta-ink damping chambers 27*b*, 27*c*, 27*d*, a corresponding one of the ink flow inlets 47*b*, 47*c*, 47*d*, the connection passage 48 connected thereto, and the communication passage 49 communicating therewith via the connection passage 48 can be said as an ink flow inlet communicating with the corresponding ink introducing passage 50.

Respective lower open ends of the four ink flow inlets 47 and the four connection passages 48 are closed by an extension portion of the flexible membrane 36.

The primary partition wall 35 has, on the lower surface thereof defining a ceiling surface of, the first chamber 27*a*-1 of the black ink damping chamber 27*a*, a rib 35*c* having, in its plan view, a generally U-shaped configuration whose opposite ends are connected to the side wall 37 of the lower case 32 that is near to the connection passages 48. However, the rib 35*c* does not reach the flexible membrane 36. Therefore, the rib 35*c* surrounds a space 35*d* which the black ink does not enter, and this space 35*d* and the flexible membrane 36 cooperate with each other to absorb the changes of pressure of the black ink, as described in detail later.

The upper case 31 has, in the upper surface thereof four recesses defining respective third chambers 55*a*, 55*b*, 55*c*, 55*d* of the four damping chambers 27*a*, 27*b*, 27*c*, 27*d*, at respective positions that are vertically aligned with the respective second chambers 39*a*, 39*b*, 39*c*, 39*d* near to the four ink flow outlets 41*a*, 41*b*, 41*c*, 41*d*, such that the four third chambers 55*a*, 55*b*, 55*c*, 55*d* are independent of each other. The four third chambers 55*a*, 55*b*, 55*c*, 55*d* communicate with the corresponding second chambers 39*a*, 39*b*, 39*c*, 39*d* via respective air holes 54 formed through the thickness of the upper case 31. That is, each of the four damping chambers 27 corresponding to the four color inks, respectively, includes three chambers, i.e., the first chamber 27-1, the second chamber 39, and the third chamber 55.

In addition, the upper case 31 has, in the upper surface thereof the four air discharging passages 51 in the form of grooves and independent of each other, such that the air discharging passages 51 extend generally in a direction perpendicular to a lengthwise direction of the damper case 25 in which the four ink flow inlets 47 and the four ink flow outlets 41 are opposite to each other. Moreover, the upper case 31 has four air discharging holes 53 which are located between the three first chambers 27*b*-1, 27*c*-1, 27*d*-1 and the four third chambers 55*a*, 55*b*, 55*c*, 55*d* on a horizontal plane and which are formed through the thickness of the upper case 31 such that the four air discharging holes 53 communicate with the four second chambers 39*a*, 39*b*, 39*c*, 39*d*, respectively. The four air discharging holes 53 define respective upstream-side ends of the four air discharging passages 61. Respective downstream-side ends of the four air discharging passages 51 are connected to four connection holes 52*a*, 52*b*, 52*c*, 52*d* which correspond to the four color inks, respectively, and which are connected to the air discharging valve device 26, described later, as shown in FIG. 4.

The four air discharging holes 53 are formed in respective tubular walls which project downward from the upper case 31 into the respective second chambers 39*a*, 39*b*, 39*c*, 39*d*, and those air discharging holes 53 open in the respective second chambers 39 at respective height positions distant from the upper case 31 by a predetermined distance. Thus, even after the air bubbles have been discharged from the second chambers 39 via the air discharging holes 53, respective amounts of air each corresponding to the predetermined distance, i.e., a length of projection of the tubular walls from the upper case 31 are left in respective upper portions of the second chambers 39. In addition, usually, the third chambers 55*a*, 55*b*, 55*c*, 55*d* keep respective air layers, and those air layers can contribute to damping or absorbing the respective changes of pressure of the color inks produced in the damping chambers 27*a*, 27*b*, 27*c*, 27*d*, so that respective droplets of inks are ejected with respective uniform ejection pressures from the nozzles 22*a*, 22*b*, 22*c*, 22*d* of the recording head 21 and accordingly the recording quality of the head 21 is improved.

Respective upper open ends of the respective third chambers 55*a*, 55*b*, 55*c*, 55*d* of the fur damping chambers 27*a*, 27*b*, 27*c*, 27*d* and the four air discharging passages 51 are closed by the extension portion of the flexible membrane 43, so that the four third chambers 55 and the four air discharging passages 51 are defined.

The damping device 13 is fixed to the carriage 9, such that the primary partition wall 35 and the two flexible membranes 36, 43 extend parallel to the directions in which the carriage 9 is reciprocated, and parallel to the nozzle supporting surface of the recording head 21 that supports the nozzles 22.

Next, the air discharging valve device 26 will be described by reference to FIGS. 4 and 8A The lower case 32 includes, as the integral portion of the damping-device supporting portion 33 having the four damping chambers 27, the air discharging-valve-device supporting portion as the accommodating portion 34 that accommodates the air discharging valve device 26. The accommodating portion 34 is located in one side portion of the lower case 32, i.e., a right-hand side portion thereof shown in FIGS. 4 and 8A. Respective upper end portions of the accommodating portion 34 and the damping device supporting portion 33 are connected to each other, such that a space is provided between the two portions 33, 34 and such that a portion of the side wall of the head holder 20 is inserted in this space, as shown in FIG. 8A. The accommodating portion 34 has four valve holes 56 which correspond to the four color inks, respectively, and which are vertically elongate and open at respective upper and lower ends thereof. One side portion of the upper case 31 is extended to a location where the one side portion covers an upper end of the, accommodating portion 34, as shown in FIG. 8A. As shown in FIG. 4, that respective other ends of the four air discharging passages 51 communicate with the respective connection holes 52 (52*a*, 52*b*, 52*c*, 52*d*) as the respective upper open ends of the four valve holes 56.

Figure 8E:
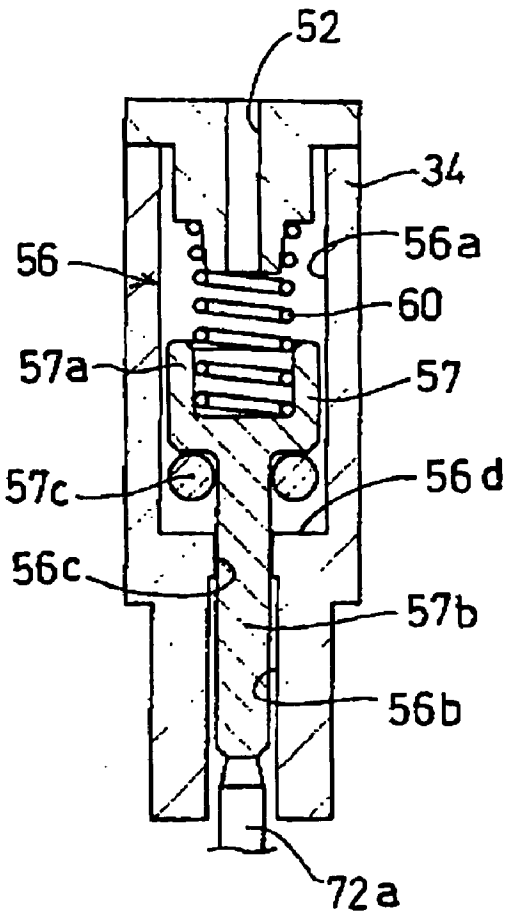
FIG. 8E is a cross-section view showing an open state of each valve member.
Figure 8D:
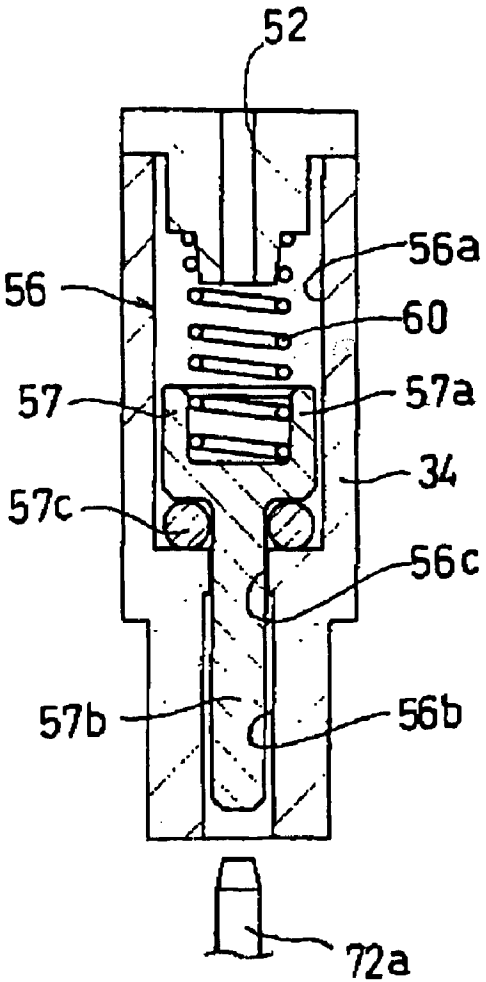
FIG. 8D is a cross-section view showing a closed state of each valve member of an air discharging valve device of the ink jet printer.

As shown in FIGS. 8D and 8E, each of the four valve holes 56 includes an upper large-diameter portion 56*a* and a lower small-diameter portion 56*b*, and accommodates a valve member 57 including a large-diameter valve portion 57*a*; a small-diameter valve rod 57*b* integrally extending downward from a central portion of a lower end surface of the valve portion 57*a*; and a sealing portion 57*c* fixed to an outer annular portion of the lower end surface of the valve portion 57*a* and surrounding the valve rod 57*b*. The large-diameter valve portion 57*a* and the small-diameter valve rod 57*b* are inserted in the large-diameter portion 56*a* and the small-diameter portion 56*b* of the valve hole 56, respectively, such that a clearance is left between the valve portion 57*a* and the large-diameter portion 56*a* and a clearance is left between the valve rod 57*b* and the small-diameter portion 56*b*. Those clearances allow air to flow therethrough. In each of the valve holes 56, the corresponding valve member 57 is movable in an axial direction of the valve hole 56. The small-diameter portion 56*b* has an upper open end opening in a bottom surface of the large-diameter portion 56*a* and defining a communication port 56*c* which communicates with the atmosphere and which is opened and closed by the valve member 57. Thus, the bottom surface of the large-diameter portion 56*a* functions as a valve seat 56*d* having the communication port 56*c*, and the sealing portion 57*c* of the valve member 57 is provided between the valve portion 57*a* and the valve seat 56*d*. An elastic member, such as a packing member formed of rubber, is preferably used as the sealing portion 57*c*. In the present embodiment, an O-ring is used as the sealing portion 57*c*, and is fitted on the valve rod 57*b*. The large-diameter portion 56*a* of each valve hole 56 accommodates a spring member 60, such as a coil spring, as a sort of biasing member that biases the valve member 57 in a direction to close the communication port 56*c*. The valve rod 57*b* is inserted in the small-diameter portion 56*b*, such that a lower end of the valve rod 57*b* extends downward to a position in the vicinity of a lower end of the small-diameter portion 56*b*, as shown in FIG. 8A.

The valve member 57 is biased in a downward direction by the spring member 60, so that the sealing portion 57*c* is pressed and sandwiched by, and between, the valve portion 57*a* and the valve seat 56*d* having the communication port 56. This state is a closed state of each valve member 57, shown in FIGS. 8A and 8D.

Meanwhile, when the respective valve rods 57*b* of the four valve members 57 are pushed upward by respective projecting portions 72*a* of four small cap members 72, the respective sealing portions 57*c* of the four valve members 57 are separated from the respective valve seats 56*d*. This is an open state of each valve member 67, shown in FIG. 8E. In this state, a clearance is produced between the sealing portion 57*c* and the valve seat 56*d*, and accordingly the air bubbles accumulated in the corresponding damping chamber 27 can be discharged into the atmosphere via the communication port 56*c*, the small-diameter portion 56*b*, and a suction pump 74, described later.

To assure that the closed state of each valve member 57 is highly air-tight, i.e., free of air leakage, it is desirable that a contact surface of the valve seat 56*d* having the communication port 56*c* have a low roughness, i.e., a high smoothness, that is, that respective contact surfaces of the valve seat 56*d* and the sealing portion 57*c* be closely contacted with each other. According to experiments carried out by the Inventor, in the case where each sealing portion 57*c* is formed of ethylene propylene dien monomer (EPDM), and each valve seat 56*d* is formed of polypropylene (PP) so as to have a smooth contact surface, such a phenomenon was observed that the sealing portion 57*c* was stuck to the valve seat 56*d*, i.e., that though the valve rod 57*b* was pushed upward, the sealing portion 57*c* failed to follow the valve rod 57*b* or open the communication port 56*c*. Hence, the Inventor carried out an additional experiment, and found that in the above-described case, ie., in the case where each sealing portion 57*c* is formed of EPDM and each valve seat 56*d* is formed of PP, if the contact surface of each valve seat 56*d* has a roughness Rz (JIS: Japanese Industrial Standard) ranging from about 0.8 μm to about 1.6 μm, the above-described phenomenon was solved and a high degree of sealing was obtained.

According to another experiment of the Inventor, in the case where each valve seat 56*d* is formed of an acetal resin such as POM (polyoxymethylene) and each sealing portion 57*c* is formed of an elastic material such as rubber (e.g., EPDM or fluororubber), the respective contact surfaces of each valve seat 56*d* and each sealing portion 57*c* may have a roughness Rz of lower than about 0.8 μm. That is, even if those contact surfaces may be highly smooth, the above-described phenomenon was not observed and the degree of sealing was improved. Thus, the Inventor fund that in the case where the respective contact surfaces of each valve seat 56*d* and each sealing portion 57*c* have a roughness Rz of not lower than about 0.8 μm and not higher than about 1.6 μm, those contact surfaces may be formed of any material so as to be able to assure that each valve seat 56*d* and each sealing portion 57*c* can be easily separable from each other and can be sufficiently highly sealed with each other.

In the case where each valve seat 56*d* is formed of POM and each sealing portion 57*c* is formed of EPDM, if the sealing portion 57*c* has a type A deurometer hardness of not lower than A40/S (JIS: Japanese Industrial Standard) and each spring member 60 has a load of 45 gf, the above-described problem of sticking of the sealing portion 57*c* was solved, and the high degree of sealing was obtained. In addition, in the case where each valve seat 56*d* is formed of POM and each sealing portion 57*c* is formed of fluororubber, if the sealing portion 57*c* has a type A deurometer hardness of not lower than A70/S and each spring member 60 has a load of 80 gf, the problem of sticking was solved and the high degree of sealing was obtained.

The maintenance unit 4 includes a large cap member 71 which can cover the entire nozzle supporting surface of the recording head 21 that supports the nozzles 22; and the four small cap members 72 which can cover the respective lower open ends of the four small-diameter portions 56*b* of the air discharging valve device 26, independent of each other, as shown in FIG. 8A The maintenance unit 4 additionally includes an elevating and lowering device 73 that is employed in a known maintenance unit. When the carriage 9 is moved to the waiting position, i.e., the right-hand end position shown in FIG. 1, the elevating and lowering device 73 elevates the large and small cap members 71, 72 so as to contact closely the nozzle supporting surface where the nozzles 22 open, and the lower end surface of the valve device 26 where the valve holes 56 open; and, when the cage 9 is moved to other positions, the elevating and lowering device 73 lowers the cap members 71, 72 away from those surfaces. The large cap member 71 is connected to the suction pump 74 as a discharging device, like in the known maintenance unit. When the suction pump 74 is driven or operated, the large cap member 71 sucks, and thereby, removes thickened ink and foreign matters from the nozzles 22.

The four small cap members 72 have the respective projecting portions 72*a* which project from respective remaining portions thereof When the small cap members 72 closely contact the lower surface of the air discharging valve device 26, the projecting portions 72 push the corresponding valve members 57 upward against the respective biasing forces of the spring members 60, so that the respective sealing portions 57*c* of the valve members 57 are moved away from the respective valve seats 56*d* as the respective bottom surfaces of the large-diameter portions 56*a* and thus the valve members 57 are placed in the respective open states thereof.

The four small cap members 72 are connected via a common flow passage to the suction pump 74. Therefore, when the suction pump 74 is driven, the air bubbles collected in the respective second chambers 39*a*, 39*b*, 39*c*, 39*d* of the four damping chambers 27 are concurrently sucked and discharged. More specifically described, when the color inks supplied from the ink tanks 5 via the flexible ink supply tubes 14 are temporarily stored in the second chambers 39, air bubbles separate from the inks, and float on respective upper surfaces of the inks, so that those air bubbles are collected in the respective upper portions of the second chambers 39. The suction pump 74 sucks and discharges those air bubbles.

A control valve 75 selectively connects the large cap member 71 or the small cap members 72 to the suction pump 74 Although the elevating and lowering device 73 concurrently elevates the large cap member 71 and the small cap members 72 to contact closely the nozzle supporting surface of the recording head 21 and the lower surface of the air discharge valve device 26, it is preferred that first the air bubbles accumulated in the respective upper portions of the four second chambers 39 (39*a* through 39*d*) be discharged via the respective small cap members 72 and subsequently the thickened inks be discharged from the nozzles 22 via the large cap member 71. In a conventional manner in which the air bubbles in the second chambers 39 are discharged through the large cap member 71 only, too large amounts of inks are discharged In contrast, in the present embodiment, the air bubbles can be discharged and the recording head 21 can be recovered while only small amounts of inks are discharged.

It is possible to perform the operation of sucking the inks from the nozzles 22, and the operation of discharging the air bubbles from the second chambers 39 (39*a* through 39*d*), independent of each other.

In the present embodiment, when the recording head 21 is not positioned at the waiting position where the maintenance unit 4 is provided, that is, when the recording head 21 is ejecting the inks toward the recording sheet P, the respective projecting portions 72*a* of the small cap members 72 are not inserted into the respective lower open ends of the respective small-diameter portions 56*b* of the valve holes 56. Thus, the state in which the valve members 57 are biased by the spring members 60 toward the communication ports 56*c* is maintained, so that the sealing portions 57*c* are held in close contact with the corresponding valve seats 56*d*. Thus, the sealing portions 57*c* can closely contact the valve seats 56*d* and air-tightly close the communication ports 56*c*. Thus, the if and the air bubbles present in the damping chambers 27 cannot be discharged via the air discharging passages 51, and can be stably kept in the same 27.

Meanwhile, when the recording head 21 is positioned at the waiting position where the maintenance unit 4 is provided, and the respective projecting portions 72*a* of the small cap members 72 are inserted upward into the respective lower open ends of the respective small-diameter portions 56*a* of the valve holes 56, the valve members 57 are pushed upward Since, as described above, the sealing portions 57*c*, fixed to the corresponding valve rods 57*b*, can be highly separable from the corresponding valve seats 56*d*, the sealing portions 57*c* are moved upward when the valve rods 57*b* are pushed upward by the projecting portions 72*a*, so that respective clearances are quickly produced between the sealing portions 57*c* and the corresponding valve seats 56*d*. Thus, the suction pump 74 can suck the air bubbles from the damping chambers 27 via the air discharging passages 51, the large-diameter portions 56*a*, the communication ports 56*c*, the small-diameter portions 56*b*, and the small cap members 72.

In the present embodiment, the degree of sealing, and degree of separability, between each sealing portion 57*c* and the corresponding valve seat 56*d* having the communication port 56*c* is improved by combining three conditions, i.e., the surface roughness of the valve seat 56*d*, the hardness of the sealing portion 57*c*, and the respective materials of the valve seat 56*d* and the sealing portion 57*c*. However, it is not needed to employ all of the three conditions, but it is possible to employ arbitrary two conditions out of the three conditions.

In addition, in the present embodiment, the valve portion 57*a* and the sealing portion 57*c* of each valve member 57 are formed independent of each other, and then are integrally fixed to each other. However, the valve portion 57*a* may be formed of the same elastic material (e.g., rubber) as that used to form the sealing portion 57*c*.

In a modified mode of the present embodiment, the suction pump 74 may be replaced with a positive pressure applying pump. In the modified mode, when the positive pressure applying pump applies a positive pressure (i.e., a pressurized air) to the inks stored in the ink tanks 5 (5*a*, 5*b*, 5*c*, 5*d*), thickened inks and foreign matters are removed from the nozzles 22, and air bubbles are discharged from the second chambers 39 (39*a*, 39*b*, 29*c*, 39*d*). In another modified form of the present embodiment, it is possible to employ both the suction pump 74 and the positive pressure applying pump.

Next, a second embodiment of the present invention will be described by reference to FIGS. 9, 10, 11A, 11B, 12A, 12B, 13A, 13B, 14, 15A, 15B, 16A, and 16B. In the second embodiment, four color inks, i.e., black, cyan, yellow, and magenta inks are supplied to two recording heads 21 each of which has, like the single recording head 21 employed in the first embodiment, four arrays of nozzles 22 (22*a*, 22*b*, 22*c*, 22*d*, FIG. 2) each array of which ejects a droplet of a corresponding one of the four color inks. The two recording heads 21 are arranged in a recording direction in which the recording heads 21 are moved, and the two heads 21 are fixed to a head holder 20.

Figure 9:
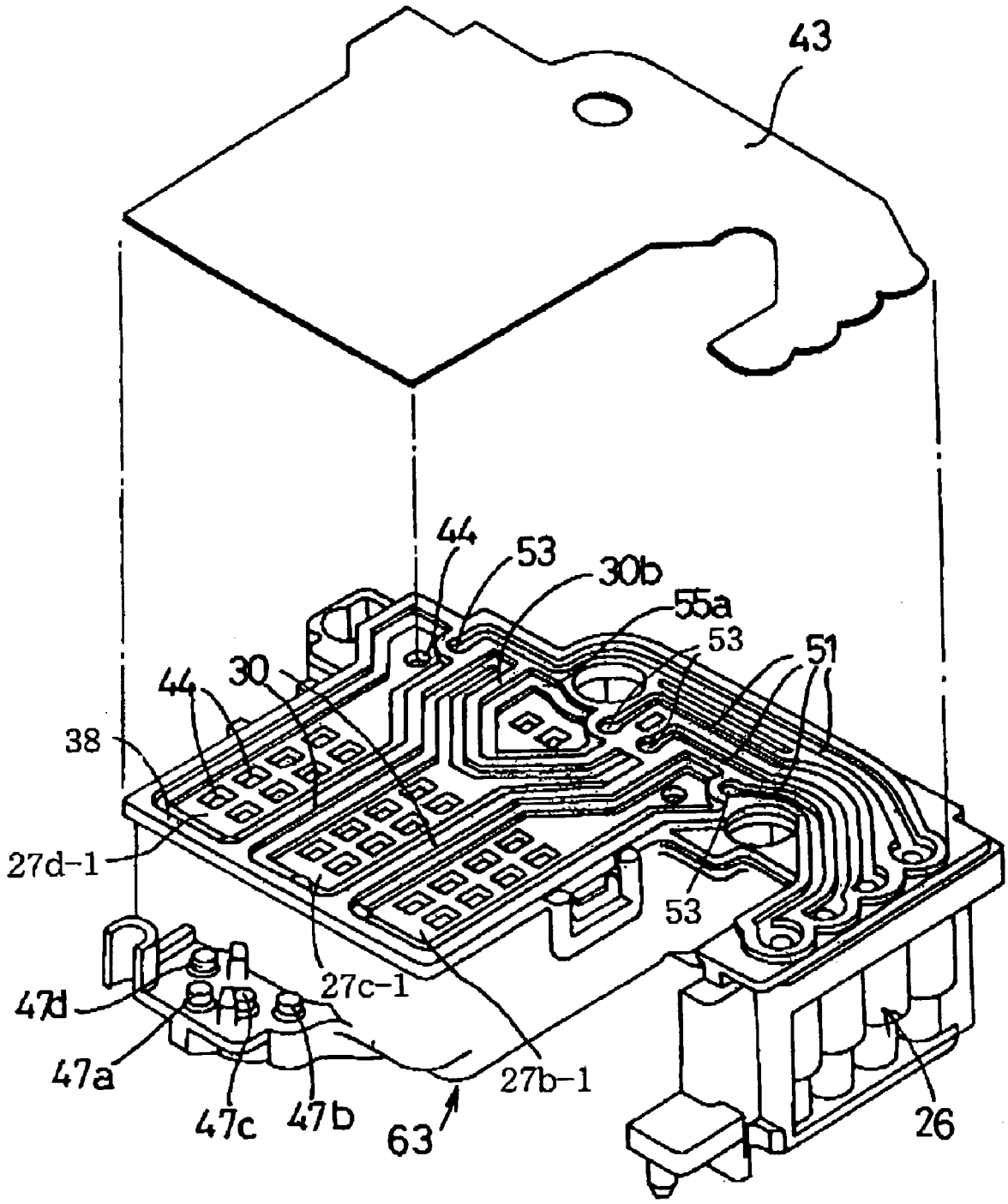
FIG. 9 is a perspective top view of a damper case and an upper flexible membrane of a damping device of another ink jet printer as a second embodiment of the present invention.
Figure 10:
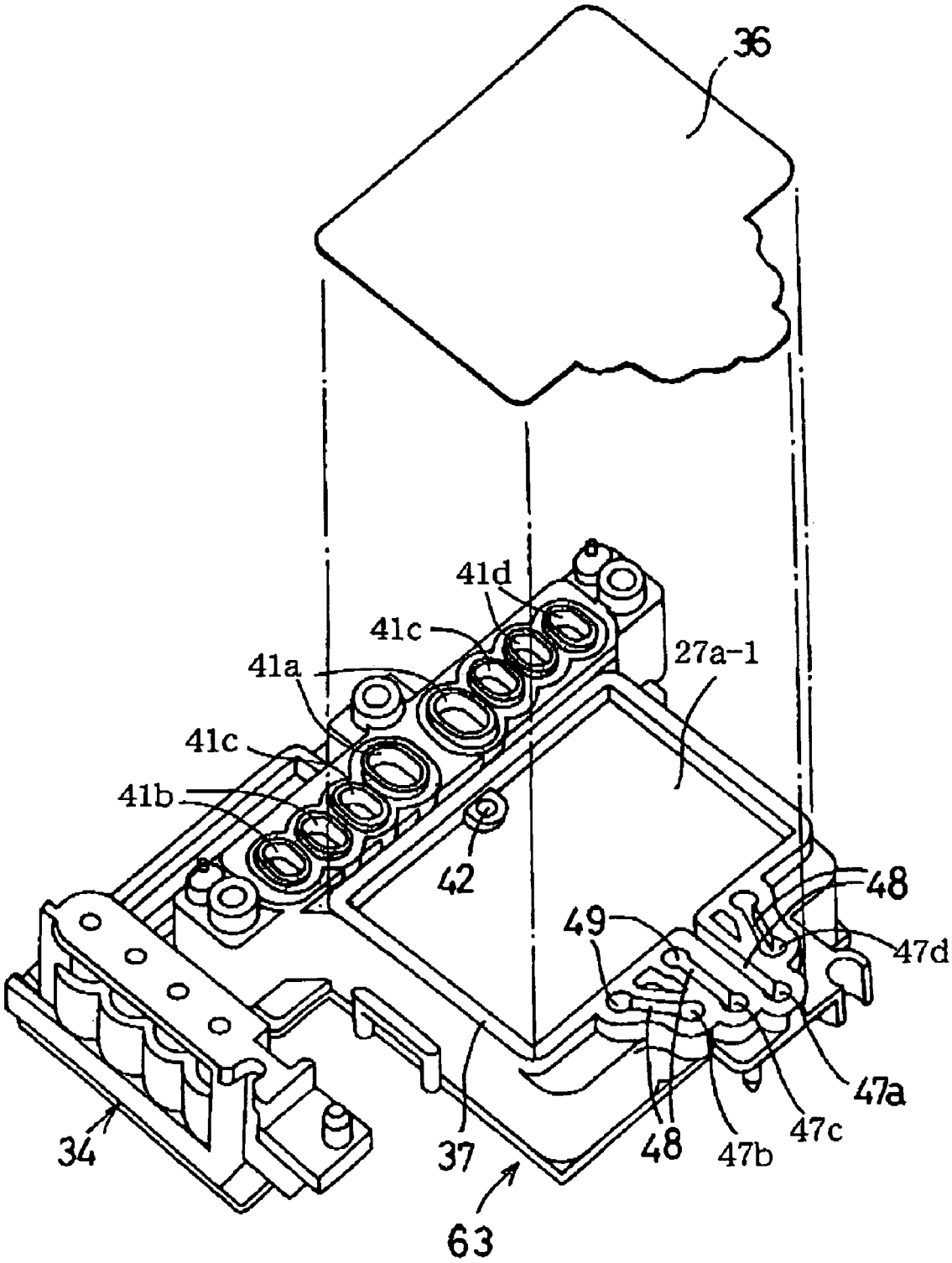
FIG. 10 is a perspective bottom view of the damper case and a lower flexible membrane of the damping device of FIG. 9.

In the second embodiment, a damping device 63 supplies, to each of the two recording heads 21, the four color inks. More specifically described, although four ink flow inlets 47 (47*a*, 47*b*, 47*c*, 47*d*) are provided for the four color inks, respectively, that is, one ink inflow inlet 47 is provided for each color ink, as shown in FIG. 9, two ink flow outlets 41 (41*a*, 41*b*, 41*c*, 41*d*) are provided for each color ink, as shown in FIG. 10. Since the second embodiment is a modified form of the first embodiment, the same reference numerals as used in the first embodiment are used to designate the corresponding elements and parts of the second embodiment.

In the second embodiment, the damping device 63 includes a damper case 25 including an upper case 31 and a lower case 32. The upper case 31 is liquid-tightly fixed by, e.g., ultrasonic welding to an upper end of the lower case 32.

Figure 15A:
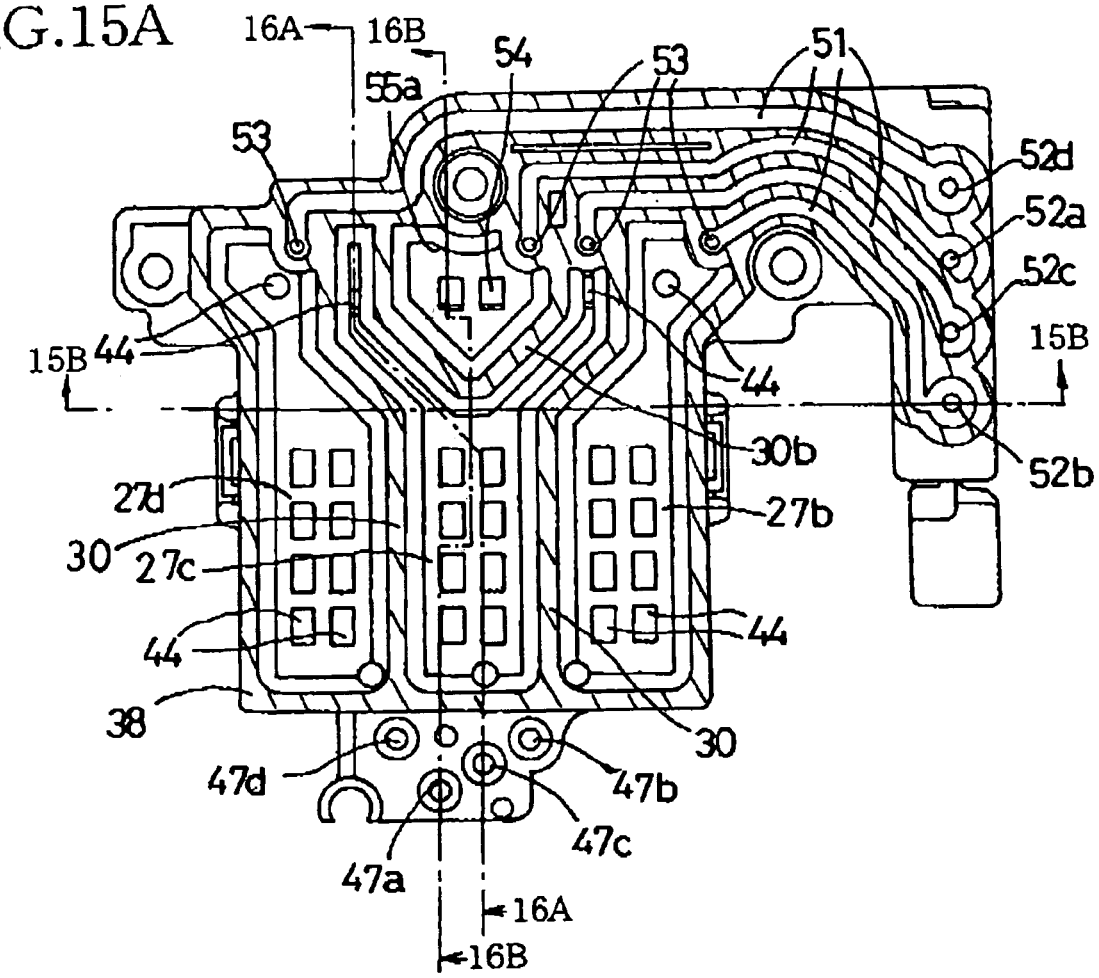
FIG. 15A is a plan view of the upper case of the damper case of the damping device of FIG. 9.
Figure 15B:
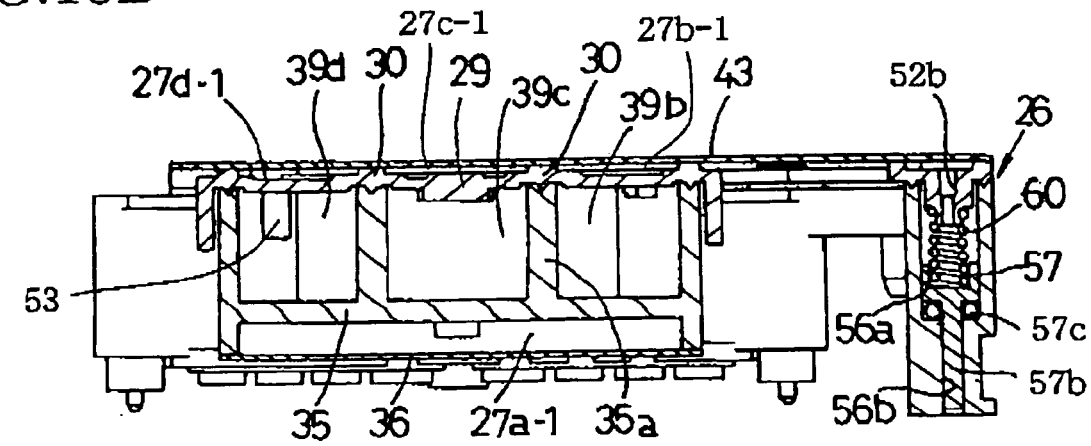
FIG. 15B is a cross-section view taken and viewed along arrows indicated by 15B, 15B in FIG. 15A.

The second embodiment resembles the first embodiment in that, as shown in FIG. 15B, the lower case 32 has, under a primary partition wall 35 thereof, a first chamber 27*a*-1 of a damping chamber 27*a* corresponding to the black ink (BK). The first chamber 27*a*-1 occupies a major portion of a lower surface of the lower case 82, and opens downward, and a flexible membrane 86 as a flexible sheet is bonded to the lower surface of the lower case 32 so as to closes the lower open end of the first chamber 27*a*-1. In addition, the lower case 32 has, in the vicinity of the lower open end of the first chamber 27*a*-1, the eight ink flow outlets 41*a*, 41*b*, 41*c*, 41*d*. In the second embodiment, as shown in FIG. 10, the two central ink flow outlets 41*a* correspond to the black ink (BK); the two ink flow outlets 41*c* on either side of the central outlets 41*a* correspond to the yellow ink (Y); the left-hand two ink flow outlets 41*b* correspond to the cyan ink (C); and the right-hand two ink flow outlets 41*d* correspond to the magenta ink (M).

Figure 11A:
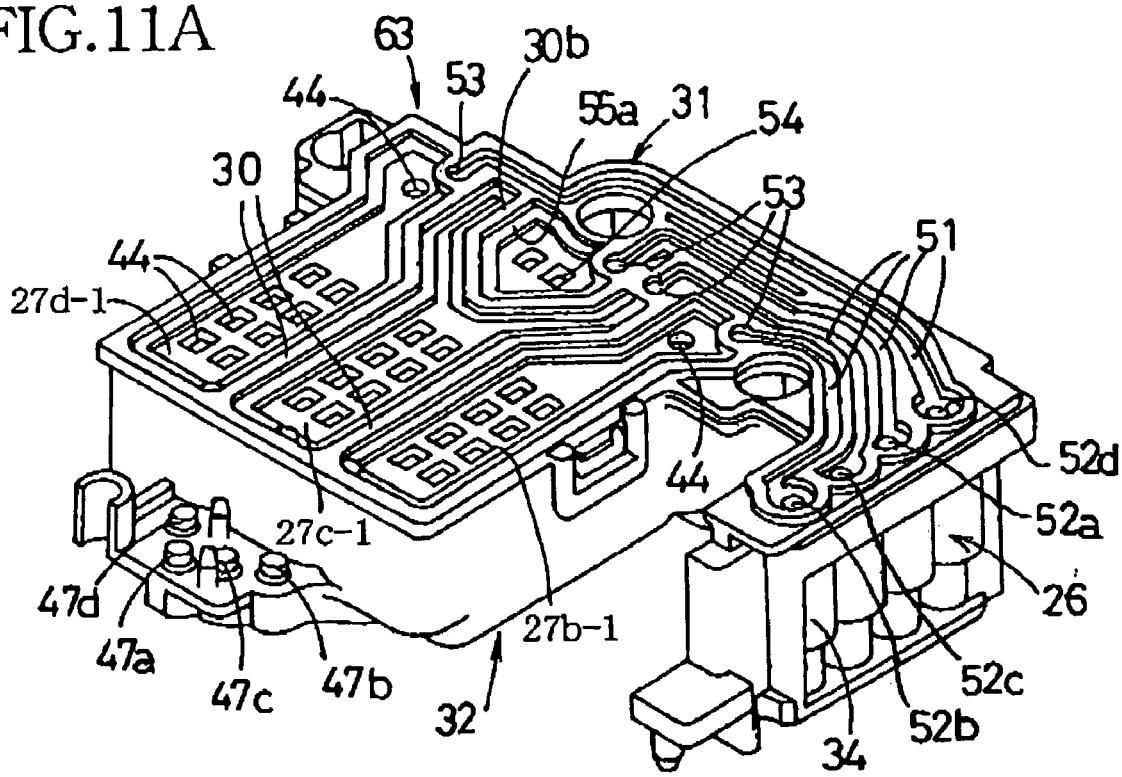
FIG. 11A is a perspective top view of the damper case (ie., upper and lower cases fixed to each other) of the damping device of FIG. 9.
Figure 11B:
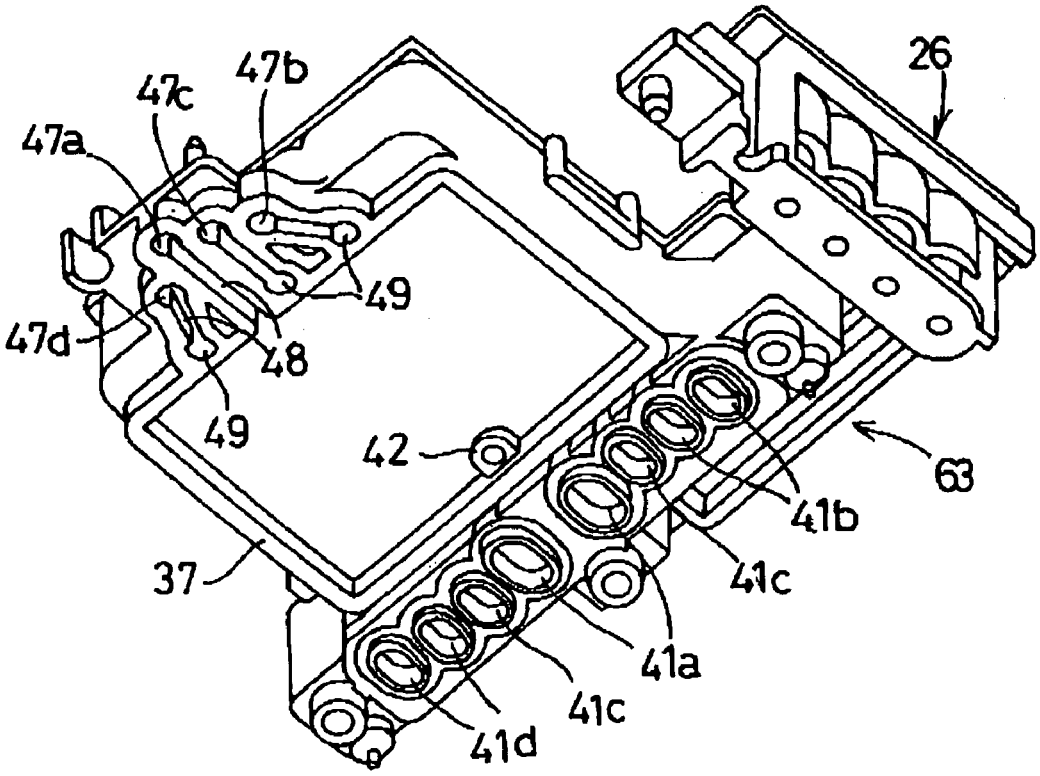
FIG. 11B is a perspective bottom view of the damper case of the damping device of FIG. 9.
Figure 12A:
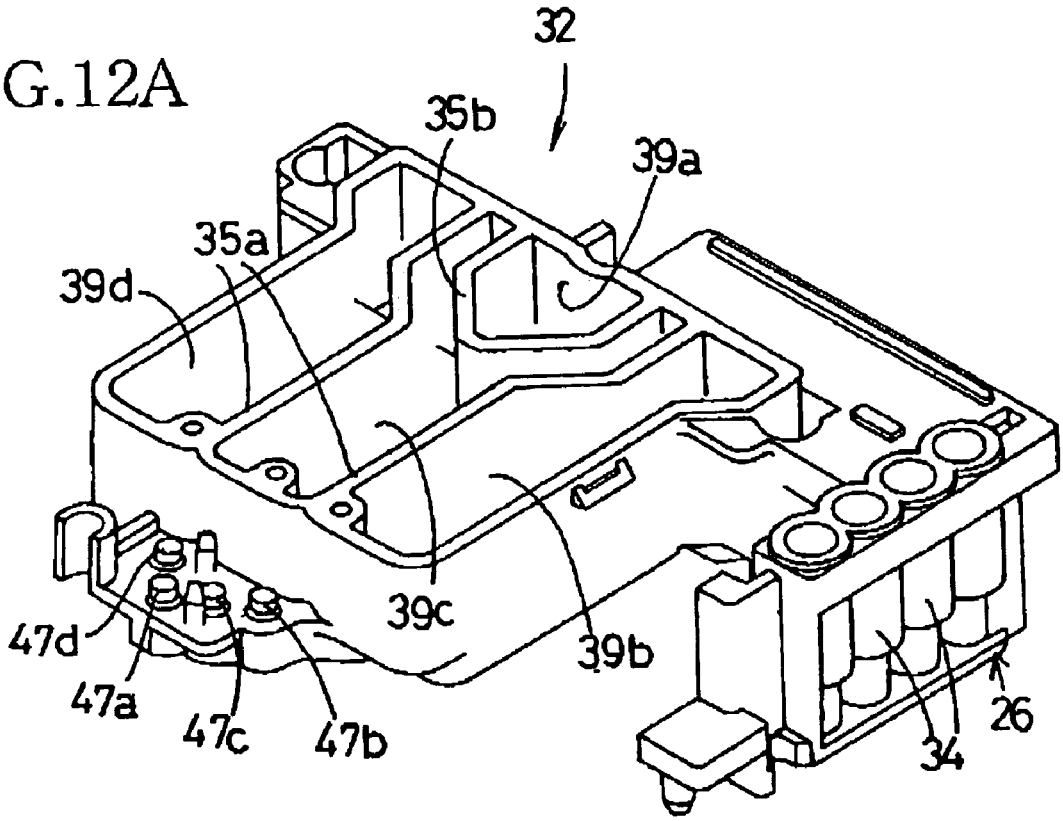
FIG. 12A is a perspective top view of the lower case of the damper case of the damping device of FIG. 9.
Figure 12B:
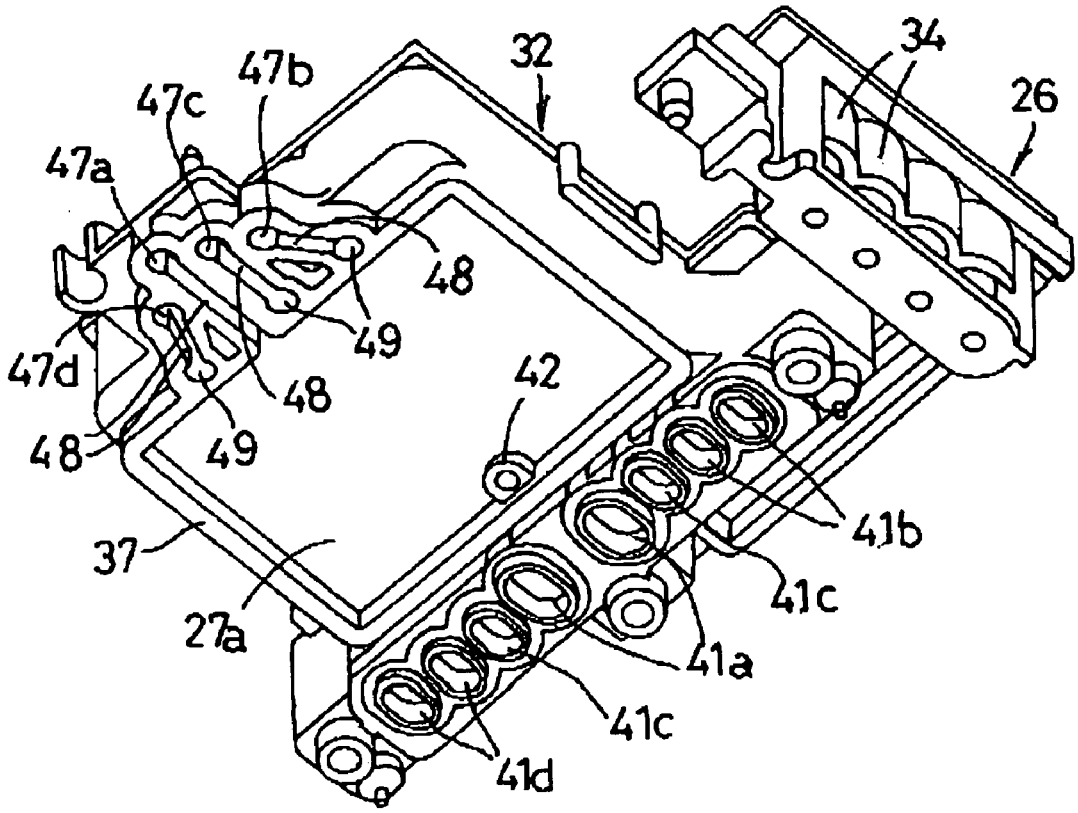
FIG. 12B is a perspective bottom view of the lower case of the damper case of the damping device of FIG. 9.
Figure 14:
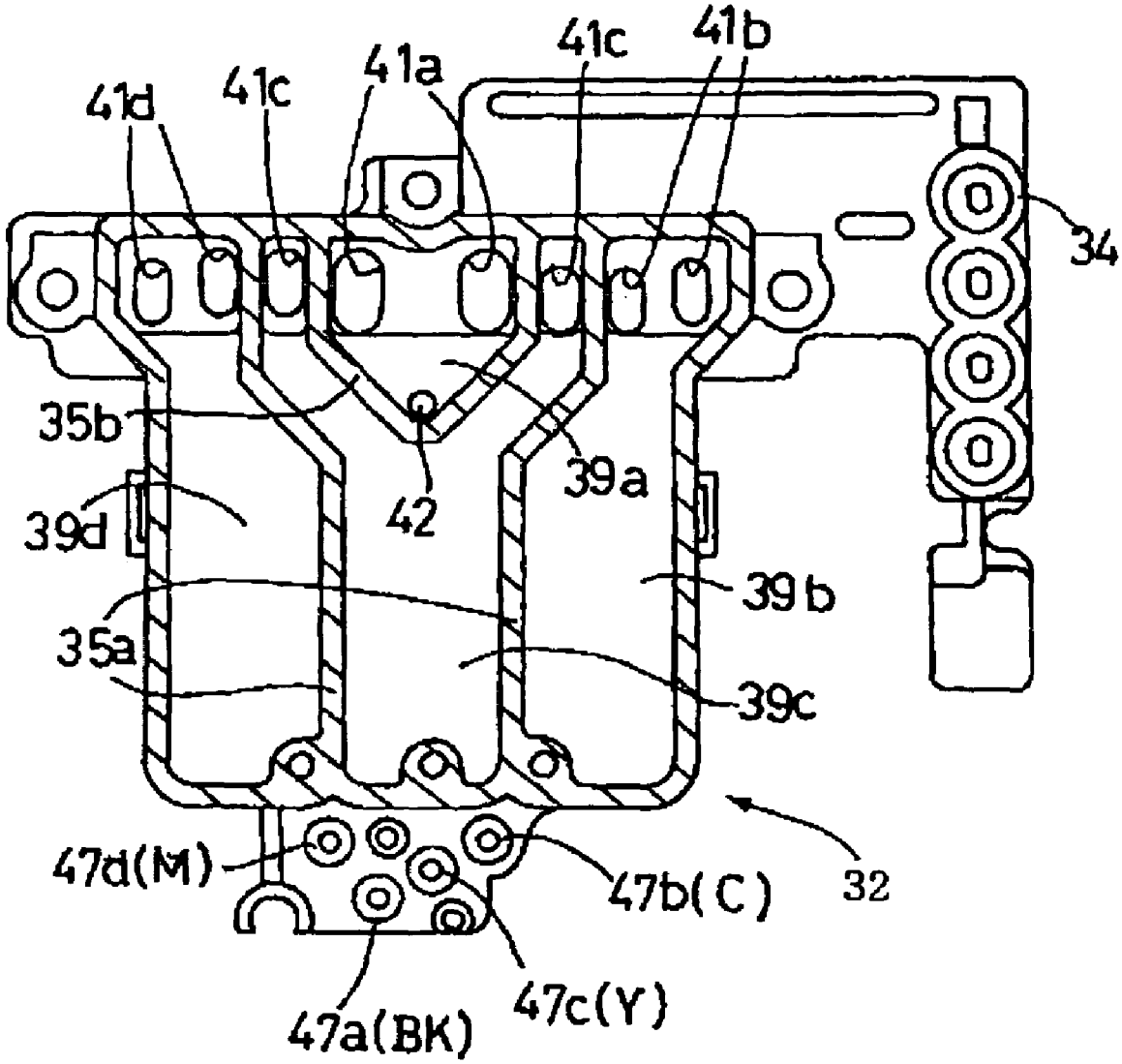
FIG. 14 is a plan view of the lower case of the damper case of the damping device of FIG. 9.

As shown in FIGS. 12A, 12B, and 14, a second chamber 39*a* of the damping chamber 27*a* corresponding to the black ink (BK) is defined, in its plan view, by a secondary partition wall 35*b* which is so formed as to surround the two central ink flow outlets 41*a*, and the second chamber 39*a* communicates with the first chamber 27*a*-1 via a communication passage 42 formed through the primary partition wall 35. The communication passage 42 functions a flow restricting portion. In addition, as shown in FIG. 11A, the upper case 31 has, in an upper surface thereof, a third chamber 55*a* of the black-ink damping chamber 27*a* that is defined by a secondary partition wall 30*b* which is aligned with the secondary partition wall 35*b* of the lower case 32. The third chamber 55*a* communicates with the second chamber 39*a* via air holes 54 formed through the upper case 31.

The second embodiment also resembles the first embedment, in that three damping chambers 27*b*, 27*c*, 27*d* corresponding to the cyan, yellow, and magenta inks, respectively, are defined by two secondary partition walls 35*a* projecting upward from an upper surface of the primary partition wall 35, and two central secondary partition walls 30 which project upward from the upper surface of the upper case 31 and are aligned with the two secondary partition walls 35*a*, respectively. As shown in FIG. 15B, the damping chambers 27*b*, 27*c*, 27*d* include respective first chambers 27*b*-1, 27*c*-1, 27*d*-1 located above a bottom wall (i.e., a lid portion) 29 of the first case 31, and respective second chambers 39*b*, 39*c*, 39*d* located below the bottom wall 29. As shown in FIG. 14, the second chambers 39*b*, 39*c*, 39*d* extend over a substantially entire length of the lower case 32, and communicate with the ink flow outlets 41*b*, 41*c*, 41*d*, respectively. In the second embodiment, the second chamber 39*c* corresponding to the yellow ink (Y) has, in its plan view, a generally Y-shaped configuration; and the second chambers 39*b*, 39*d* corresponding to the cyan and magenta inks (C, M) are located on either side of the Y-shaped second chamber 39*b*, respectively.

Figure 16A:
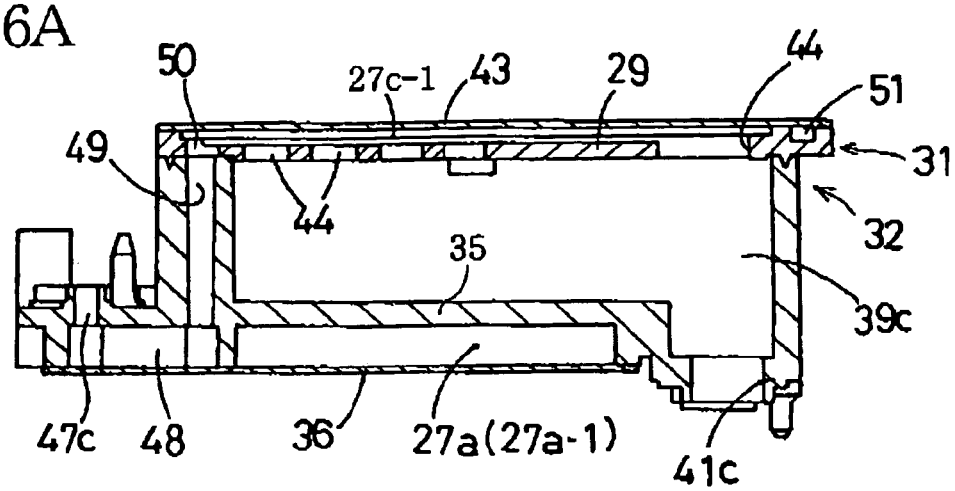
FIG. 16A is a cross-section view taken and viewed along arrows indicated by 16A, 16A in FIG. 15A.
Figure 16B:
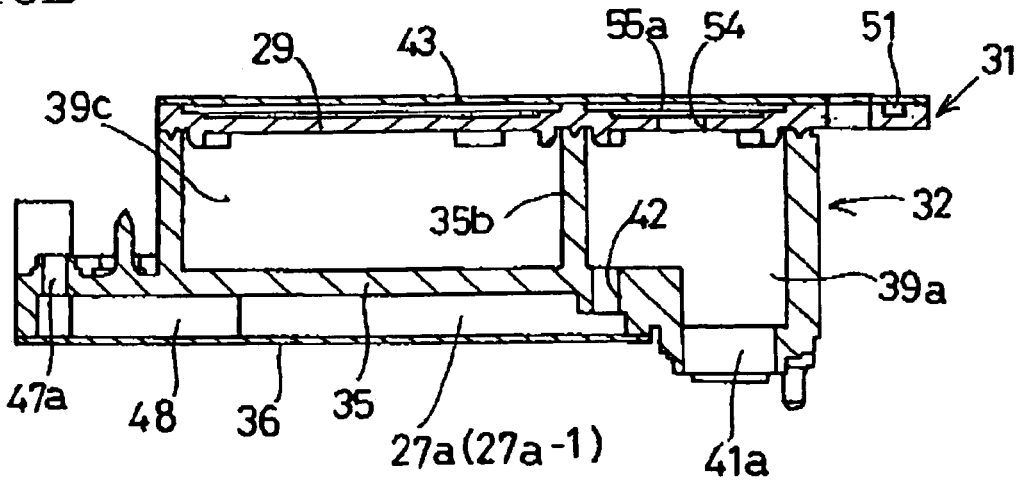
FIG. 16B is a cross-section view taken and viewed along arrows indicated by 16B, 16B in FIG. 15A.

The three first chambers 27*b*-1, 27*c*-1, 27*d*-1 provided in the upper surface of the upper case 31 are located above the corresponding second chambers 39*b*, 39*c*, 39*d*. However, the second embodiment does not have respective third chambers corresponding to the cyan, yellow, and magenta inks (C, Y, M). As shown in FIG. 16A, for each of the three first chambers 27*b*-1, 27*b*-*c*, 27*d*-1, the bottom wall 29 has a plurality of first communication through-holes 44 in the vicinity of a corresponding one of three communication passages 50, described later, and additionally has one or two second communication through-boles 44 in the vicinity of corresponding two ink flow outlets out of the six ink flow outlets 41*b*, 41*c*, 41*d*, so that the first and second communication through-holes 44 communicate between the each of the first chambers 27*b*-1, 27*c*-1, 27*d*-1 and a corresponding one of the second chambers 39*b*, 39*c*, 39*d*.

Figure 13A:
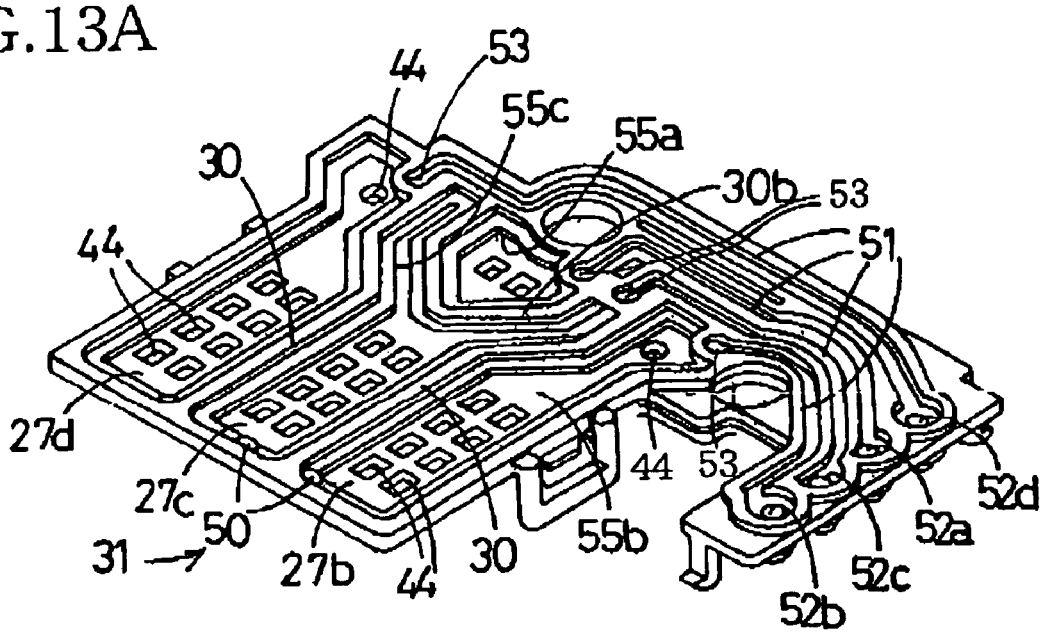
FIG. 13A is a perspective top view of the upper case of the damper case of the damping device of FIG. 9.
Figure 13B:
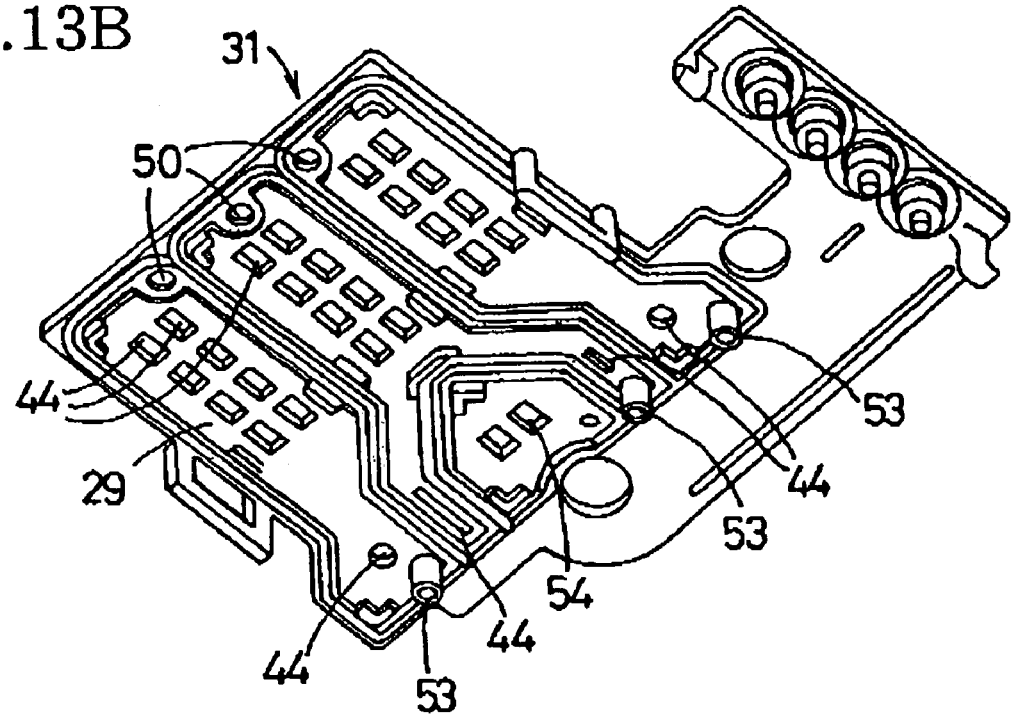
FIG. 13B is a perspective bottom view of the upper case of the damper case of the damping device of FIG. 9.

As shown in FIG. 11A, the upper case 31 additionally has four air discharging passages 51 in the form of grooves formed in the upper surface of the case 31. The air discharging passages 51 communicate, at respective air discharging boles 53 as respective upstream-side ends thereof, with the respective second chambers 39*a*, 39*b*, 39*c*, 39*d*, and communicate, at respective four connection holes 52 (52*a*, 52*b*, 52*c*, 52*d*) as respective downstream-side ends thereof with an air discharging valve device 26 whose construction is identical with that of the air discharging valve device 26 employed in the first embodiment. The second embodiment resembles the first embodiment in that the three air discharging holes 53 corresponding to the cyan, yellow, and magenta inks (C, Y, M) open downward at respective height positions lower than those of respective ceiling surfaces of the three second chambers 39*b*, 39*c*, 39*d*, as shown in FIG. 13B, so that respective spaces in which respective amounts of air are accumulated, are defined in respective upper portions of the second chambers 39*b*, 39*c*, 39*d*, as shown in FIG. 15B.

Respective upper open ends of the three first chambers 27*b*-1, 27*c*-1, 27*d*-1, the third chamber 55*a* corresponding to the black ink, and the four air discharging passages 51 are closed by a single flexible membrane 43 as a flexible sheet, as shown in FIG. 9.

The lower case 82 has the four ink flow inlets 47*a*, 47*b*, 47*c*, 47*d* which are similar to the four ink flow inlets 47*a*, 47*b*, 47*c*, 47*d* employed in the first embodiment. The ink flow inlet 47*a* corresponding to the black ink (BK) is connected to the damping chamber 27*a* (i.e., the first chamber 27*a*-1) corresponding to the black ink, via a connection passage 48 in the form of a groove; and the ink flow inlets 47*b*, 47*c*, 47*d* corresponding to the cyan, yellow, and magenta inks are connected to the damping chambers 27*b*, 27*c*, 27*d* (i.e., the first chambers 27*b*-1, 27*c*-1, 27*d*-1) corresponding to the cyan, yellow, and magenta inks, via respective connection passages 48 in the form of grooves, respective communication passages 49, and respective communication passages 50, as shown in FIGS. 10 and 16A. Respective lower open ends of the ink flow inlets 47*a*, 47*b*, 47*c*, 47*d* and the connection passages 48 are closed by an extension portion of the flexible membrane 36.

In each of the first and second embodiments, as the carriage 9 is reciprocated, during a recording operation, in the leftward and rightward directions in FIG. 1, the ink supply tubes 14 (14*a*, 14*b*, 14*c*, 14*d*) are also moved in the leftward and rightward directions so as to follow the carriage 9. Because of an inertia: force produced upon returning of the carriage 9, the pressure of the ink present in each of the ink supply tubes 14 is largely changed. This pressure change is propagated via a corresponding one of the ink flow inlets 47 (47*a*, 47*b*, 47*c*, 47*d*) to a corresponding one of the damping chambers 27 (27*a*, 27*b*, 27*c*, 27*d*). Since the flexible membranes 36, 43 liquid-tightly closing the damping chambers 27 are flexed or deformed, the change of pressure of the ink accommodated in each damping chamber 27 can be reduced Thus, each of the flexible membranes 36, 43 defining the damper chambers 27 functions as a pressure-change damping portion which damps a change of pressure of each of the color inks flowing into the respective damping chambers 27.

In particular, the first chamber 27*a*-1 of the black-ink damping chamber 27 has a volume greater than that of each of the respective first chambers 27*b*-1, 27*c*-1, 27*d*-1 of the other, three damping chambers 27*b*, 27*c*, 27*d* corresponding to the cyan, yellow, and magenta inks, because the black ink is more consumed than the other color inks. A portion of the lower flexible membrane 36 that closes the lower open end of the first chamber 27*a*-1 corresponding to the black ink has an area larger than each of respective portions of the upper flexible membrane 43 that close the respective upper open ends of the respective first chambers 27*b*-1, 27*c*-1, 27*d*-1 corresponding to the other, three color inks.

The respective pressure changes propagated to the respective first chambers 27*a*-1, 27*b*-1, 27*c*-1, 27*d*-1 of the damping chambers 27*a*, 27*b*, 27*c*, 27*d* are restricted by the communication passage 42 and the communication holes 44 each functioning as the flow restricting portion. Accordingly, first, the flexible membranes 36, 43 are largely flexed or deformed by those pressure changes. In addition, since the communication passages 49, 50 communicating with the first chambers 27*b*-1, 27*c*-1, 27*d*-1 corresponding to the cyan, yellow, and magenta inks open at respective positions opposed, and near, to the flexible membrane 43, the pressure changes are directly received, and quickly absorbed, by the membrane 43.

Moreover, usually, respective air layers are kept in the respective upper portions of the second chambers 39*a*, 39*b*, 39*c*, 39*d*, and accordingly those air layers exhibit respective damping effects. Furthermore, the flexible membrane 43 liquid-tightly closing the first chambers 27*b*-1, 27*c*-1, 27*d*-1 and the third chamber 55*a* is deformable to absorb and reduce the pressure changes produced in the damping chambers 27*a* through 27*d* and the above-described pressure changes propagated thereto. Thus, the respective pressures of the inks present in the nozzles 22 of the recording bead 21 can be kept uniform and accordingly the quality of recording of the head 21 can be improved.

The respective flows of the inks that have entered the first chambers 27*a*-1, 27*b*-1, 27*c*-1, 27*d*-1 of the damping chambers 27*a*, 27*b*, 27*c*, 27*d*, are decelerated by the respective flow restricting effects of the communication passage 42 and the communication holes 44 each as the flow restricting portion, and then those inks enter the second chambers 39*a*, 39*b*, 39*c*, 39*d*. In the second chambers 39*a*, 39*b*, 39*c*, 39*d*, the air bubbles contained in the inks move up and separate from the inks. Then, the inks freed of the air bubbles are supplied to the recording head 21 via the ink flow outlets 41*a*, 41*b*, 41*c*, 41*d*.

In each of the above-described two embodiments, the nozzle supporting surface of the recording head unit 3 is substantially horizontal and the recording head 21 ejects, from the nozzles 22, the inks in a downward direction. Thus, the damping device 13 is located above the recording head 21, such that the primary partition wall 35 and the flexible membranes 36, 43 are substantially horizontal, and such that between the lower flexible membrane 36 and the recording head 21 (sore specifically described, the flexible flat cable 24), there is provided a clearance or space in which the flexible membrane 36 is allowed to displace.

However, in the case where the recording head unit 8 has a vertical nozzle supporting surface, the damping device 13 may be provided such that the primary partition wall 35 and the flexible membranes 36, 43 are substantially vertical As is apparent from the foregoing description of the first and second embodiments, one of the plurality of damping chambers 27 corresponding to the plurality of color inks or the plurality of ink supply channels of the recording head 21, is separated from the other damping chambers 27 by the primary partition wall 35, such that the one damping chamber 27 and the other damping chambers 27 are arranged in a back to back relation, so as to open in opposite directions, respectively, such that the open end of the one chamber 27 and the respective open ends of the other chambers 27 are liquid-tightly closed by the two flexible membranes 36, 43, respectively. Thus, the plurality of damping chambers 27 can be provided in a reduced space, and the respective open ends of the same 27 can each have a large area. Therefore, the damping device 13 can be made in a small size, while the flexible membranes 36, 43 liquid-tightly closing the respective open ends of the damping chambers 27 can each have a large area to flex or deform. Accordingly, the damping device 13 can exhibit a high damping effect In particular, since the plurality of damping chambers 27 are all provided in the single damper case 25 having the primary and secondary partition walls 35, 35*a*, 35*b*, 30, (30*b*,) the damping device 13 can be made in a small size.

In each of the first and second embodiments, since the three damping chambers 27*b*, 27*c*, 27*d* of the four damping chambers 27*a*, 27*b*, 27*c*, 27*d* are separated from each other by the secondary partition walls 35*a*, 35*b*, 30, (30*b*) that extend perpendicularly to the primary partition wall 35, and those chambers 27*b*, 27*c*, 27*d* are located adjacent each other, the chambers 27*b*, 27*c*, 27*d* open in the same direction and accordingly can be liquid-tightly closed by the single flexible membrane 43. Therefore, the liquid-tightly closing operation can be easily carried out, and the production cost of the damping device 13 can be reduced.

In addition, the damper case 25 having the plurality of damping chambers 27 additionally has not only the air discharging passages 51 communicating with the air discharging valve device 26, but also the air discharging valve device 26. Thus, the carriage 9 can carry means needed to remove the air bubbles from the recording head unit 3, when a maintenance operation is carried out. Thus, the recording head unit 8 can be made in a reduced size. In particular, the air discharging passages 51 are separated from each other, and are located adjacent each other, by partition walls of the damper case 25 that are integral with the secondary partition walls go, such that the air discharging passages 51 open in the same direction as the direction in which the first chambers 27*b*-1, 27*b*-1, 27*c*-1 open. Thus, when the single flexible membrane 43 is adhered to an appropriate outer surface of the damper case 25, the damping chambers 27 and the air discharging passages 51 are simultaneously defined, and accordingly the production cost of the damping device 13 can be reduced.

In the first embodiment, the second chambers 39*a*, 39*b*, 39*c*, 39*d* each functioning as an air-bubble buffering or collecting chamber communicate with the corresponding third chambers, i.e., air damping chambers 55*a*, 55*b*, 55*c*, 55*d*. Therefore, the recording head unit 3 can be made in a reduce size and, additionally, the pressure changes caused by the displacements of the inks in the second chambers 39*a*, 39*b*, 39*c*, 39*d* when the carriage 9 is reciprocated can be effectively damped.

In the damping device 13, the damper case 25 has the opposite two open ends, and the plurality of damping chambers 27 are defined by the primary partition wall 35 spaced from each of the two open ends, and the two flexible membranes 36, 43 liquid-tightly closing the two open ends, respectively. In addition, the damper case 25 has the ink flow inlets 47 arranged in an array, via which the inks are supplied from the ink supply tubes 14 to the damping chambers 27; and the ink flow outlets 41 arranged in an array, via which the in are supplied from the damping chambers 27 to the ink supply channels of the recording head 21. The ink flow inlets 47*b*, 47*c*, 47*d* communicate with the corresponding damping chambers 47*b*-1, 47*c*-1, 47*d*-1 via the communication passages 49, 50 that extend in the direction substantially perpendicular to the plane defined by the primary partition wall 35.

Therefore, although the plurality of damping chambers 27 are separated from each other by the primary partition wall 35 and the secondary partition walls 35*a*, 35*b*, 30, 30*b*, the ink flow inlets 47 or the ink flow outlets 41 can be formed in an array in one surface face of the damper case 25. Therefore, the ink flow inlets 47 can be easily connected to the ink supply tubes 14, and the ink flow outlets 41 ran be easily connected to the ink supply inlets (of shown) of the recording head 21.

The recording head 21 has the plurality of ink supply inlets (not shown) that are connected to the ink supply channels (not shown), respectively, and are provided in an array along one side of the back surface of the head 21. Meanwhile, the lower case 32 of the damper case 25 has the plurality of ink flow outlets 41 that are opposed downward to the ink supply lents, respectively and the plurality of ink flow inlets 41 that communicate with the ink flow outlets 47, respectively, and are opposite to the same 47. Therefore, when the damper case 25 is placed on the back surface of the recording head 21, the ink flow outlets 41 of the lower case 32 can be easily connected to the ink supply inlets corresponding to the ink supply channels of the recording head 21. In addition, when the flexible ink supply tubes 14 are moved toward the lower case 32 in a direction intersecting the back surface of the recording head 21, the ink supply tubes 14 can be easily connected to the ink flow inlets 47, respectively.

Next, there will be described a third embodiment of the present invention by reference to FIGS. 17 through 31. The third embodiment also relates to an ink jet printer The present ink jet printer has a recording portion 2, including two elongate plate-like guide rails 6', 7' that extend in a Y direction perpendicular to an X direction parallel to a sheet feeding direction, A, in which a recording sheet as a sort of recording medium, not shown, is fed; and a recording head unit 3' that is supported by the two guide rails 6', 7' such that the head unit 3' is slideable on the rails 6', 7' and functions as a carriage which is reciprocateable on the same 6', 7'. The recording portion 2' additionally includes a timing belt 11' that is provided above an upper surface of the guide rail 7 such that the timing belt 11' extends parallel to the upper surface, and is driven to reciprocate the recording head unit 3'; and a CR (carriage) motor 10, that drives or moves the timing belt 11'.

Figure 18:
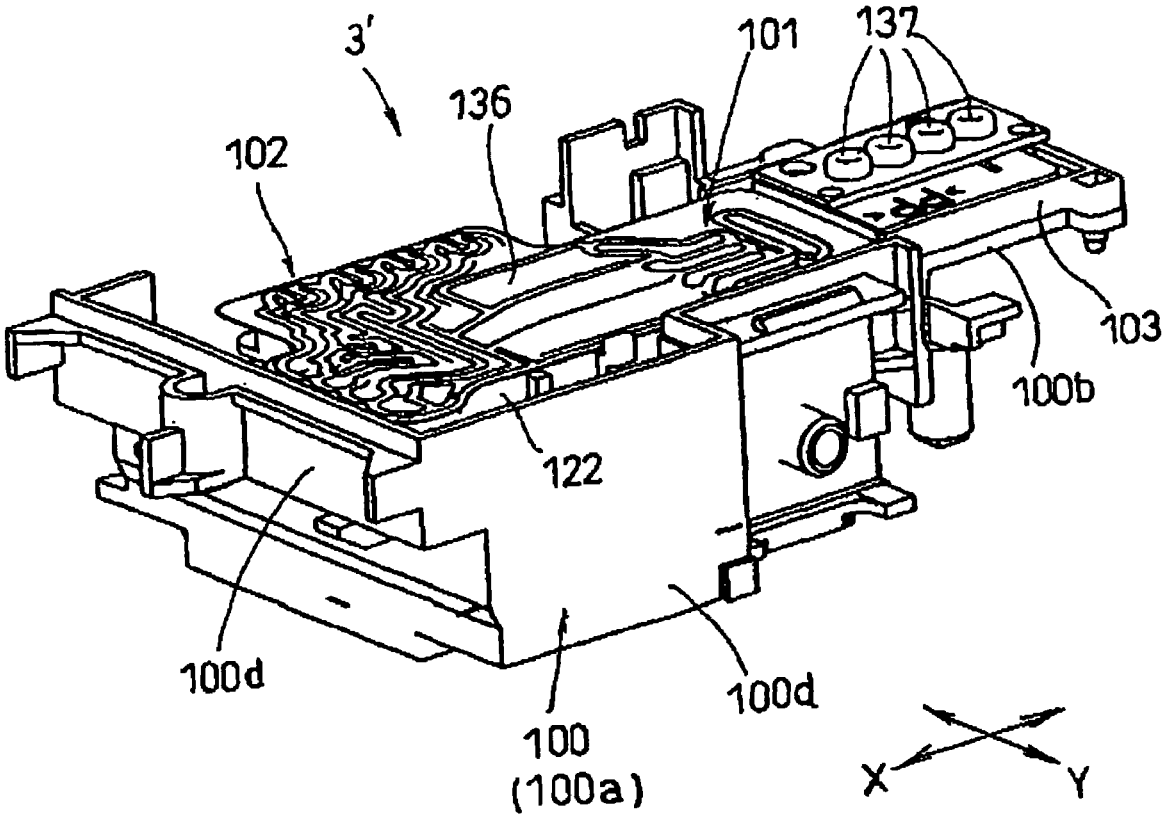
FIG. 18 is a perspective view of a recording head unit of the recording portion of FIG. 17.
Figure 19:
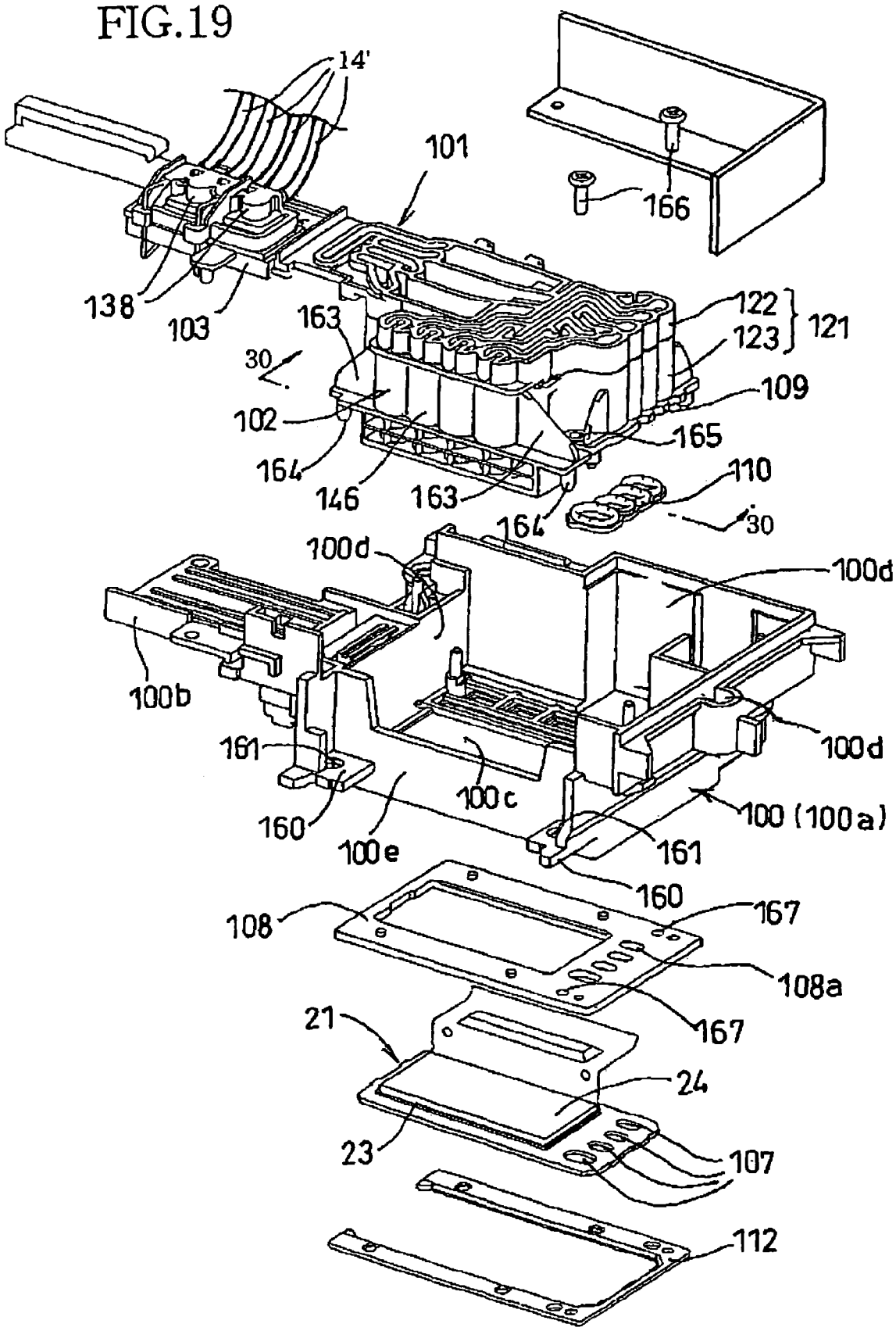
FIG. 19 is a perspective, exploded view of the recording head of FIG. 18.

As shown in FIGS. 18 and 19, the recording head unit 3' includes a head holder 100 including a main case 100*a* that has a generally box-like configuration and opens upward, and a connection-portion support portion 100*b* that projects from the main case 100*a* in the sheet feeding direction A; an ink jet recording head 21 fixed to a lower surface of a bottom wall 100*c* of the head holder 100; and a damping device 101 and an air discharging valve device 102 both of which are fixed to an upper surface of the bottom wall 100*c*.

The damping device 101 includes a connection portion 103 that substantially horizontally projects in the sheet feeding direction A and is superposed on, and supported by, the connection-portion support portion 100*b*. Respective one end portions of four flexible ink supply tubes 14' are connected to the connection portion 103. The present ink jet printer employs, for recording a full color image, four ink supply sources in the form of four separate ink tanks, not shown, that store a yellow ink (Y), a magenta ink (M), a cyan ink (C), and a black ink (BK), respectively, and are detachably attached to an ink-tank supporting portion, not shown, provided in a housing, not shown, of the ink jet printer. The respective other end portions of the four ink supply tubes 14' are connected to the four ink tanks, respectively. The color inks are supplied from the ink tanks to a plurality of ink supply channels (i.e., common ink chambers) of the recording head 21, respectively via a plurality of ink flow channels including the ink supply tubes 14' and a plurality of damping chambers 113 (113*a*, 113*b*, 113*c*, 113*d*) of the damping device 101. Though, in the present embodiment, the four ink supply tubes 14' respectively corresponding to the four color inks, i.e., yellow ink (Y), magenta ink (M), cyan ink (C), and black ink (BK), are employed, the total number of the color inks or the ink supply tubes 14' and the sorts of the color inks are not limited to the details of the present embodiment.

Figure 17:
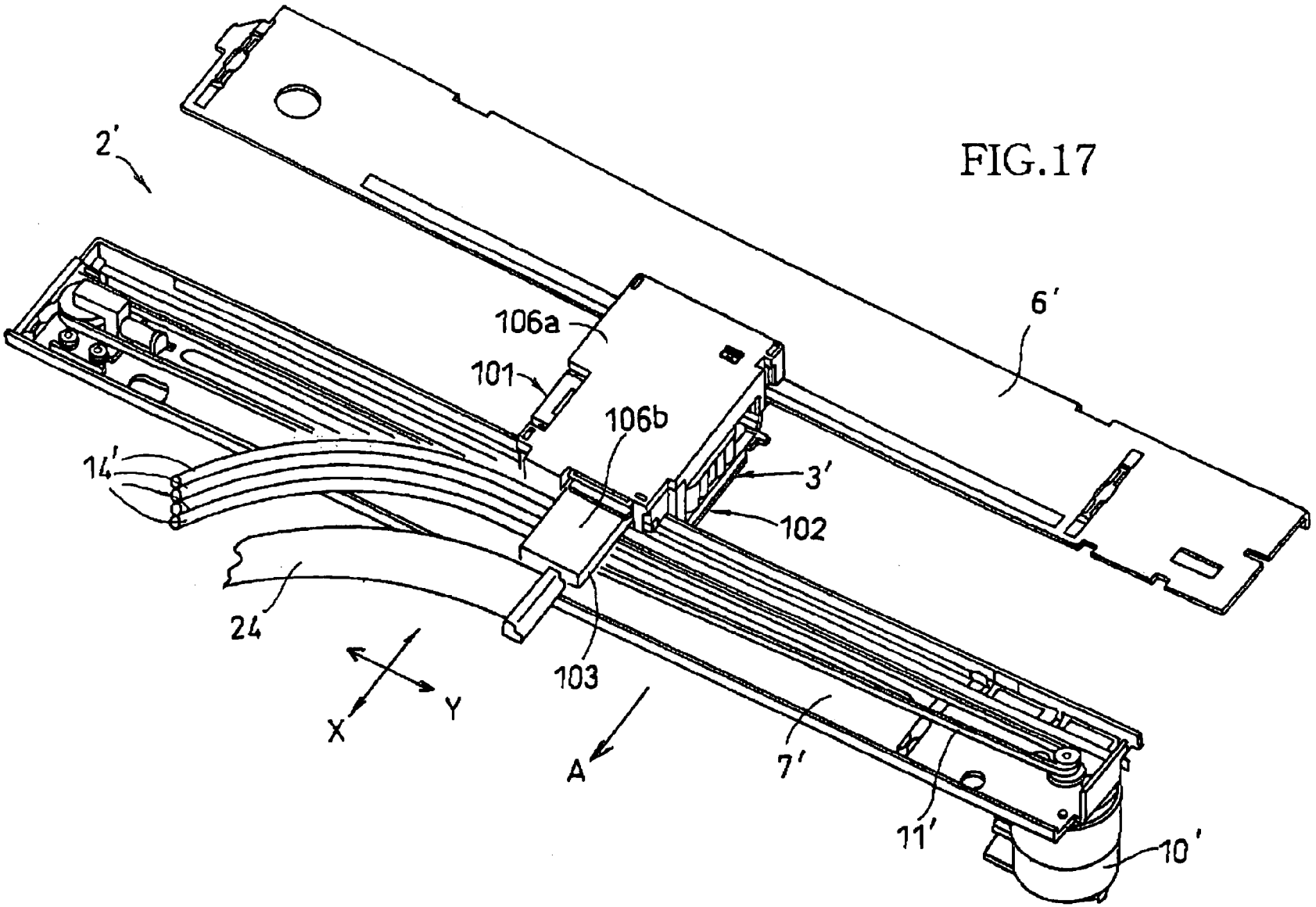
FIG. 17 is a perspective view of a recording portion of another ink jet printer as a third embodiment of the present invention.

Respective upper ends of the damping device 101 and the air discharging valve device 102 are covered by a first cover member 106*a*; and an upper end of the connection portion 108 of the damping device 101 is covered by a second cover member 106*b*, as shown in FIG. 17.

Figure 24:
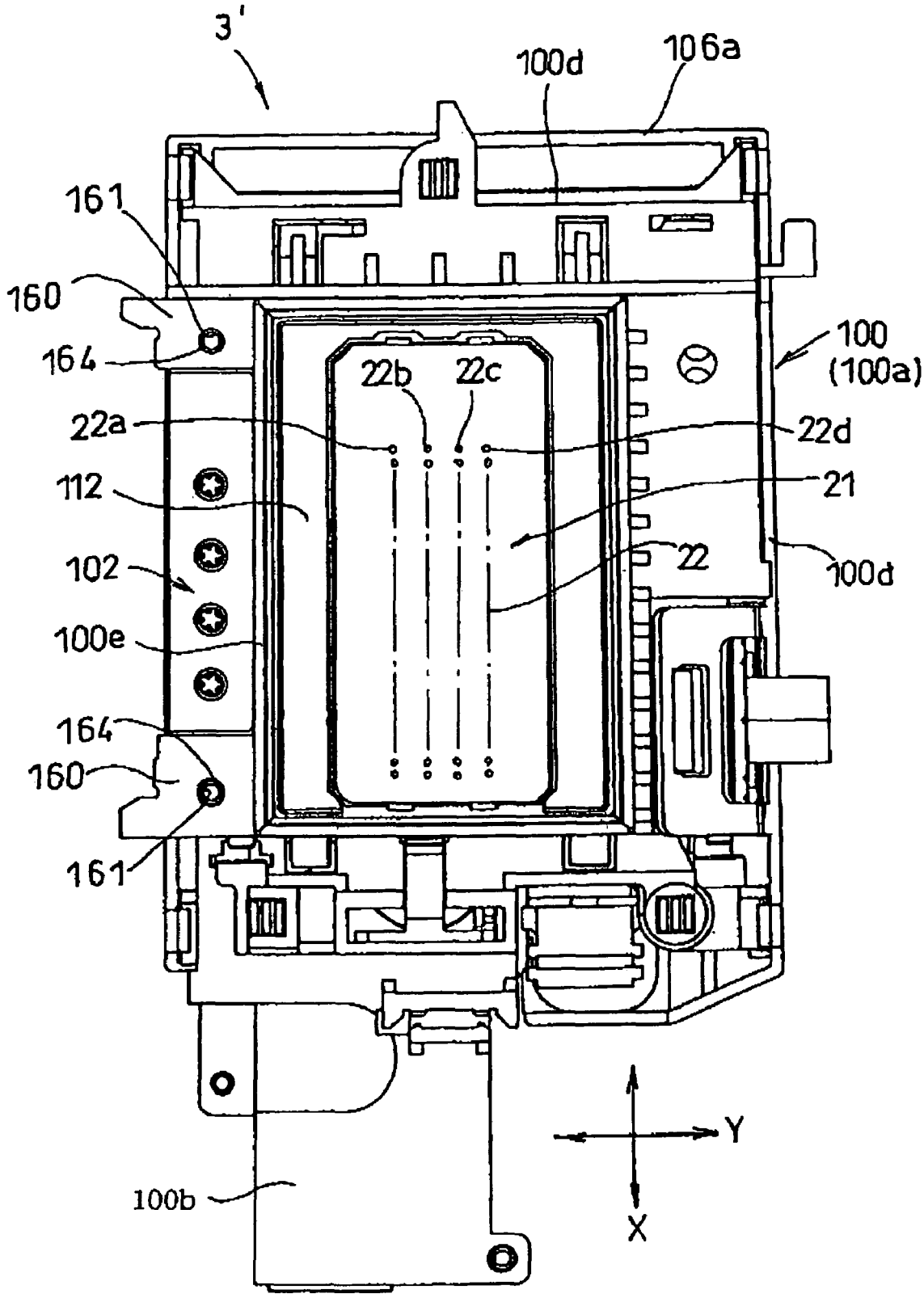
FIG. 24 is a bottom view of the recording head unit.

As shown in FIG. 24, the recording head 21 has, in a lower surface thereof a plurality of ink ejection nozzles 22 arranged in four arrays 22*a*, 22*b*, 22*c*, 22*d* corresponding to the black ink (BK), the cyan ink (C), the yellow ink (Y), and the magenta ink (M), respectively. The four arrays of nozzles 22 are elongate in the X direction perpendicular to the Y direction in which the recording head unit 3' functioning as the carriage is reciprocated. In the lower surface of the recording head 21, the nozzles 22 are exposed in a downward direction to face an upper surface of the recording sheet.

The recording head 21 is identical with a known recording head that is disclosed by, e.g., Japanese Patent Application Publication No. 2002-67312 or its corresponding U.S. Pat. No. 6,729,717, or Japanese Patent Application Publication No. 2001-219560. The contents of U.S. Pat. No. 6,729,717 are incorporated herein by reference. More specifically described, as shown in FIG. 19, the recording head 21 has, along one side of an upper surface thereof, four ink supply inlets 107 that correspond to the four color inks, respectively, and communicate with the four ink supply channels (or four common ink chambers), respectively. From each of the four ink supply channels, a corresponding one of the four color inks is supplied to a plurality of pressure chambers, not shown, communicating with the nozzles 22 of a corresponding one of the four arrays 22*a*, 22*b*, 22*c*, 22*d*. When an actuator unit 23 including four arrays of piezoelectric elements corresponding to the four color inks, respectively is driven or operated, an arbitrary one of the four arrays of nozzles 22*a*, 22*b*, 22*c*, 22*d* ejects a droplet of ink toward the recording sheet.

As shown in FIG. 19, a flexible flat cable 24 that applies an electric voltage to the actuator unit 23, is connected to an upper surface of the actuator unit 23. The recording head 21 is attached to the lower surface of the bottom wall 100*c* of the head holder 100, via a reinforcing frame 108 which prevents deformation of the recording head 21 that would otherwise be caused by the attachment thereof and which has four through-holes 108*a*. The damping device 101 has four ink flow outlets 109 that are respectively inserted in four through-holes, not shown, of the bottom wall 100*c*, so that the four ink flow outlets 109 (109*a*, 109*b*, 109*c*, 109*d*) respectively communicate with the four ink supply inlets 107 via the respective through-holes 108*a* of the reinforcing frame 108 and respective sealing members 110 such as rubber packing members. A generally U-shaped front frame 112 is attached to a lower surface of the reinforcing frame 108, such that the front frame 112 cooperates with the nozzle supporting (i.e., lower) surface of the recording head 21 to define a flat or plane front surface of the same 21.

Next, a construction of the damping device 101 will be described by reference to FIGS. 19 through 31.

Figure 28:
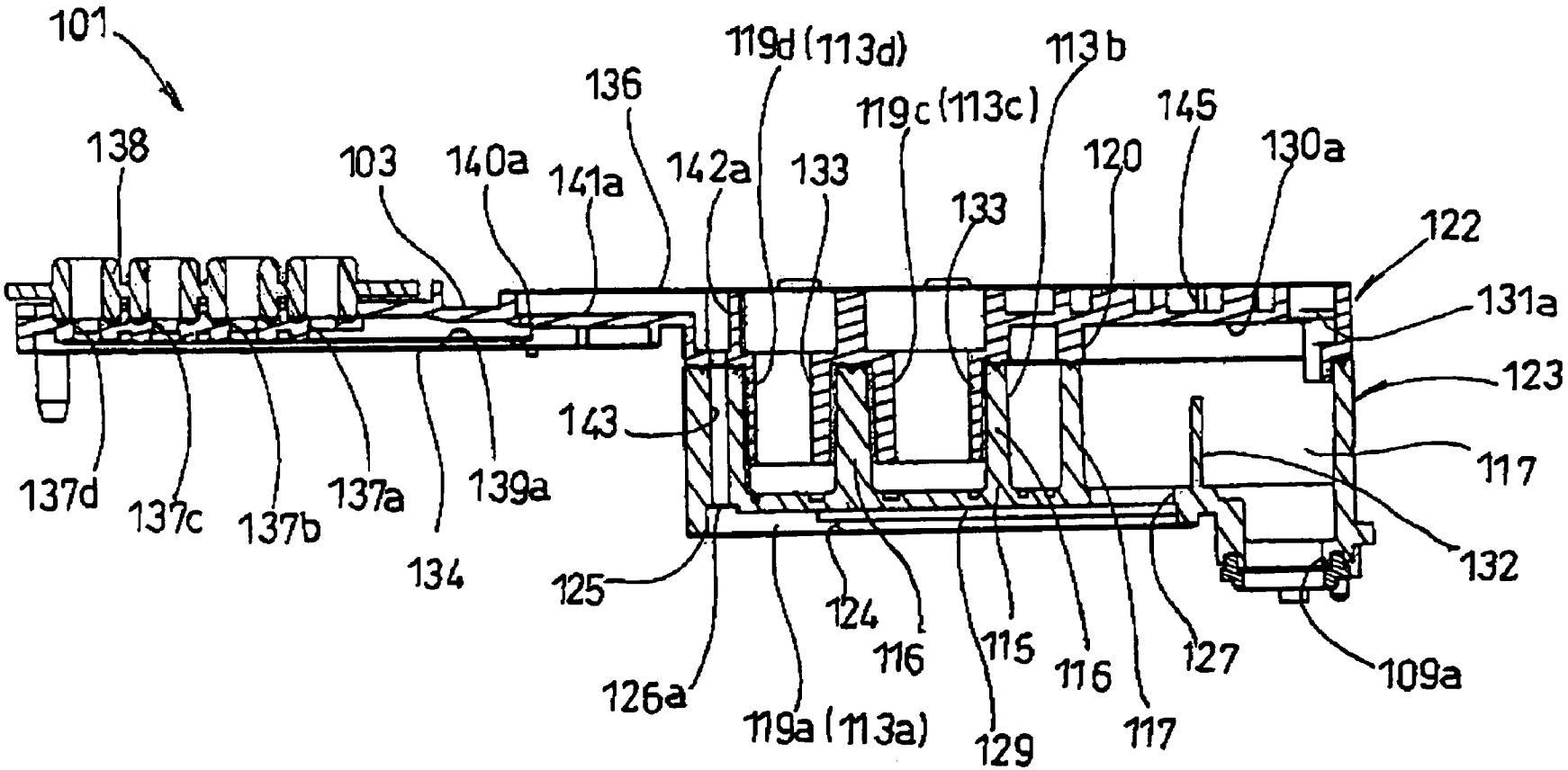
FIG. 28 is a cross section view take along arrows indicated by 28, 28 in FIG. 26, with the flexible membranes being attached to the damping device.

The damping device 101 has the four damping chambers 113 (113*a*, 113*b*, 113*c*, 113*d*) that correspond to the four color inks, respectively, and are separated from each other by a primary partition wall 115, and secondary partition walls 116, 117 extending laterally or upward from the primary partition wall 115. As shown in FIG. 28, below the primary partition wall 115, there is provided a first chamber 119*a* as a portion of the damping chamber 113*a* corresponding to the, black ink (BK); and above the, primary partition wall 115, there are provided a second chamber 120 as another portion of the black-ink damping chamber 113*a*, and the respective damping chambers 113*b*, 113*c*, 113*d* corresponding to the cyan, yellow, and magenta inks (C, Y, M), respectively. Thus, the four damping chambers 113*a*, 113*b*, 113*c*, 113*d* are provided in two layers, i.e., upper and lower layers located on either side of the primary partition wall 115.

More specifically described, the damping device 101 includes a damper case 121 including an upper care 122 and a lower case 123. As shown in FIGS. 19, 20A, 20B, 21A, 21B, 22A, and 22B, the upper case 122 is flat and has a generally rectangular shape in its plan view, and the lower case 123 has a generally box-like shape, includes a rectangular and tubular side or outer wall, and opens upward and downward. The upper open end of the lower case 123 is closed by the upper case 122, such that respective contact surfaces of the two cases 122, 123 are liquid-tightly bonded to each other. One lengthwise end portion of the upper portion of the upper case 122 is extended outward to provide the connection portion 103 to which the ink supply tubes 14' are connected. The upper and lower cases 122, 123 are each formed, by injection, of a synthetic resin, and has an appropriate degree of rigidity. The respective contact surfaces of the two cases 122, 123 are liquid-tightly bonded to each other by, e.g., ultrasonic welding, as will be described later. Those contact surfaces of the two cases 122, 128 are plane, and include respective upper end surfaces of the secondary partition walls 116 separating the damping chambers 113*b*, 113*c*, 113*d* from each other, and an upper end surface of the secondary partition wall 117 separating the second chamber 120 of the black-ink damping chamber 113*a* from the other damping chambers 113*b*, 113*c*, 113*d*, and additionally include respective lower end surfaces of the upper case 122 to which those upper end surfaces of the lower case 123 are liquid-tightly bonded by, e.g., ultrasonic welding.

Figures 21A, 21B:
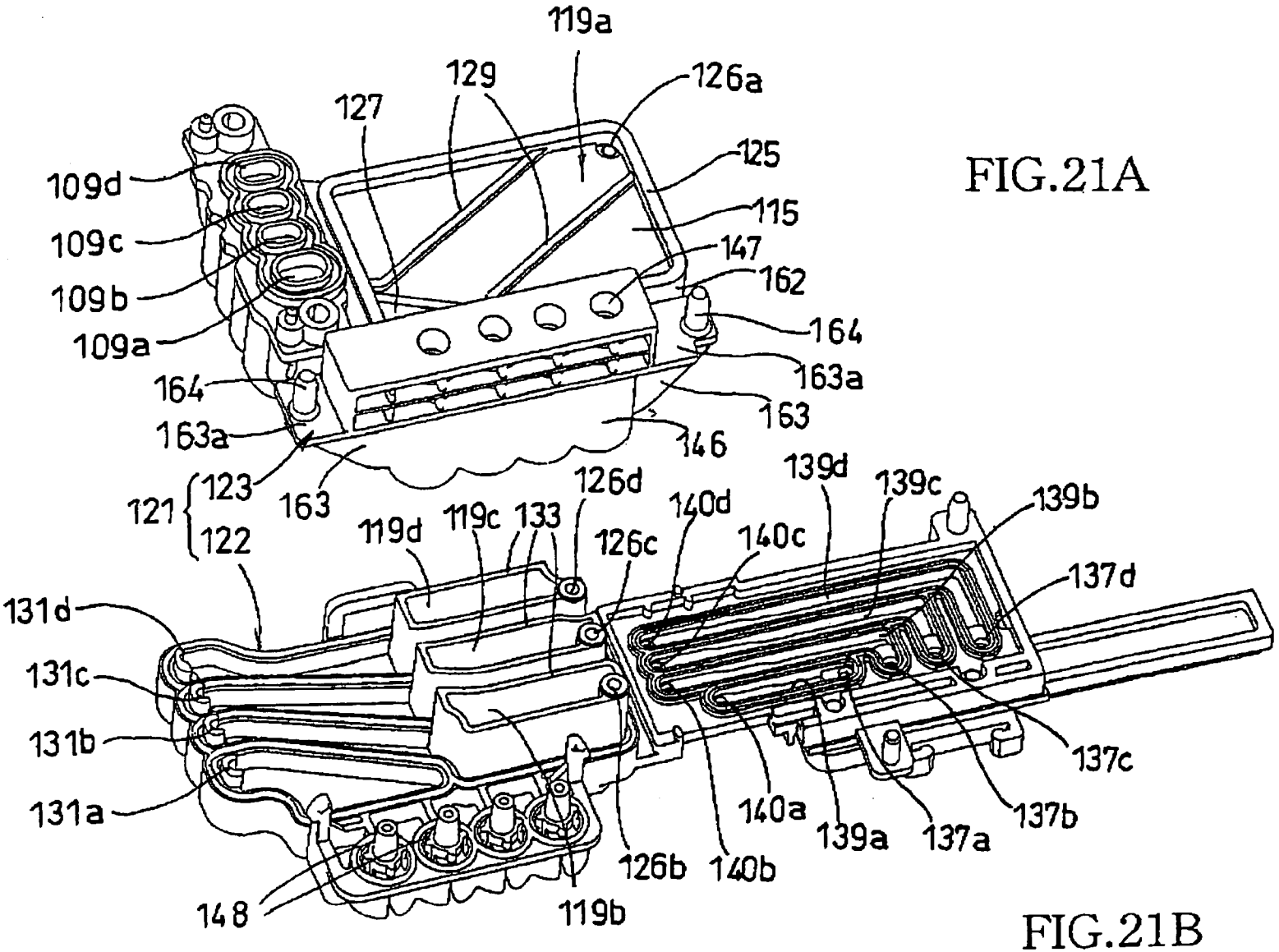
FIG. 21A is a perspective bottom view of the lower case.
FIG. 21B is a perspective bottom view of the upper case.
Figure 22A:
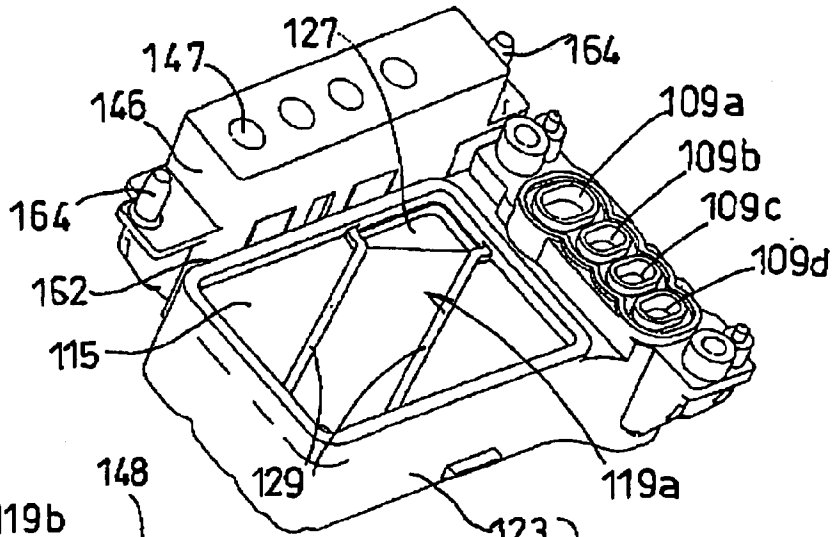
FIG. 22A is another perspective bottom view of the lower case.
Figure 22B:
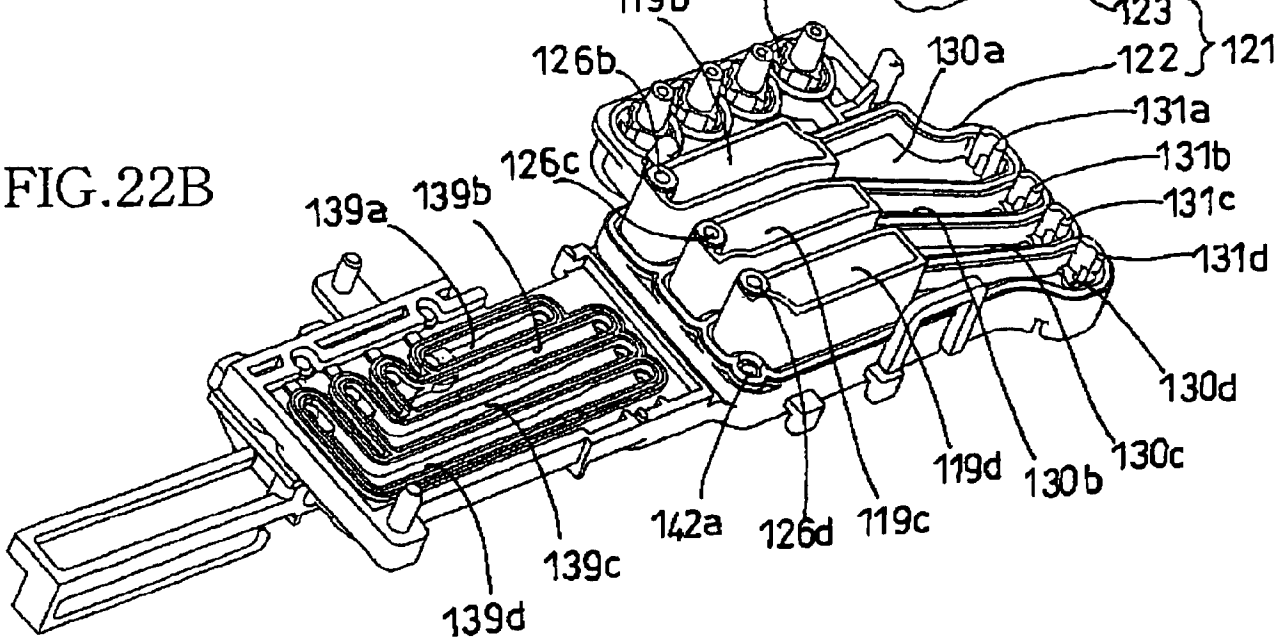
FIG. 22B is another perspective bottom view of the upper case.
Figure 25:
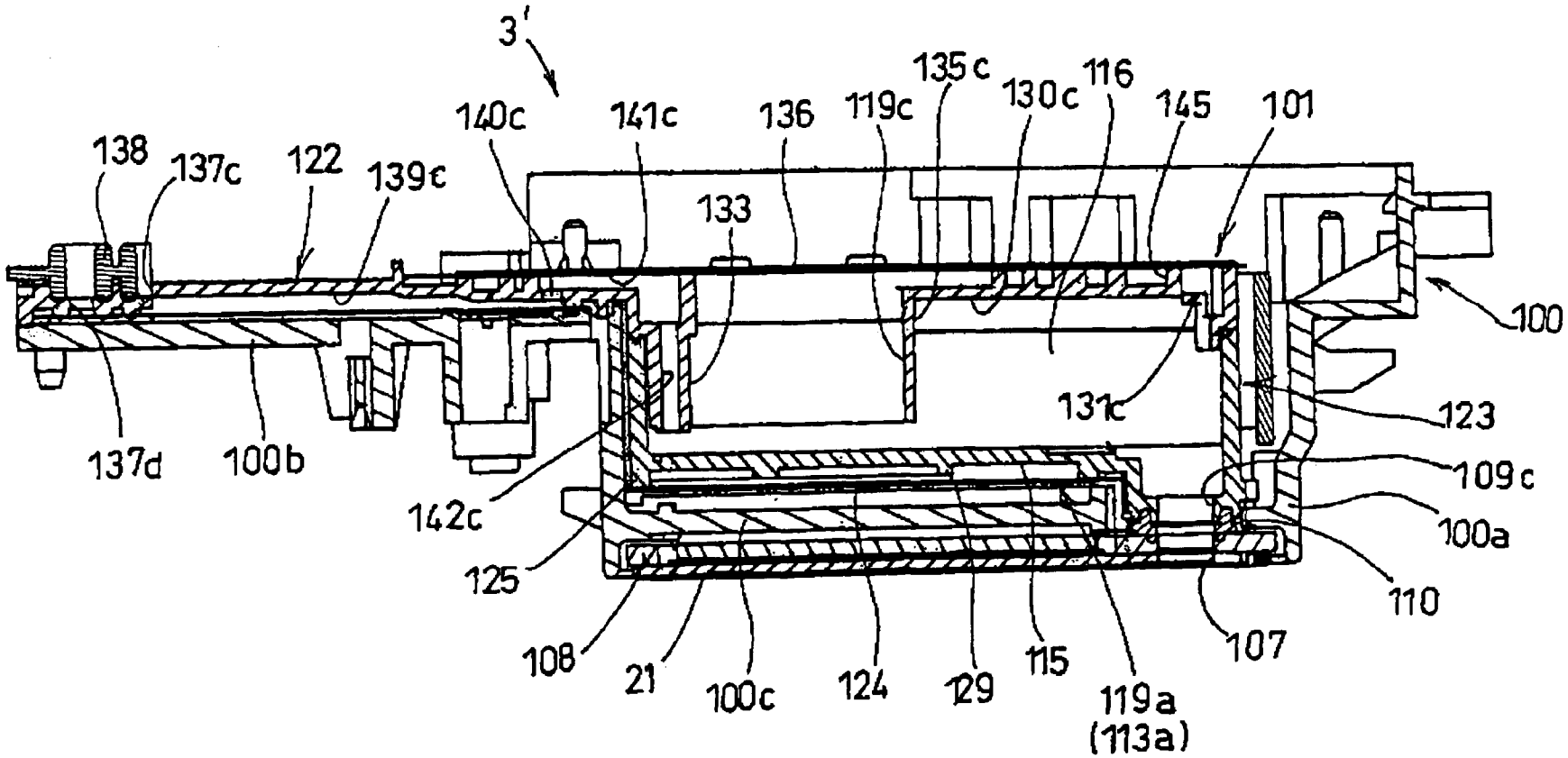
FIG. 25 is a cross-section view take along arrows indicated by 25, 25 in FIG. 23, with the upper flexible membrane being attached to the upper surface of the upper case of the damping device.
Figure 26:
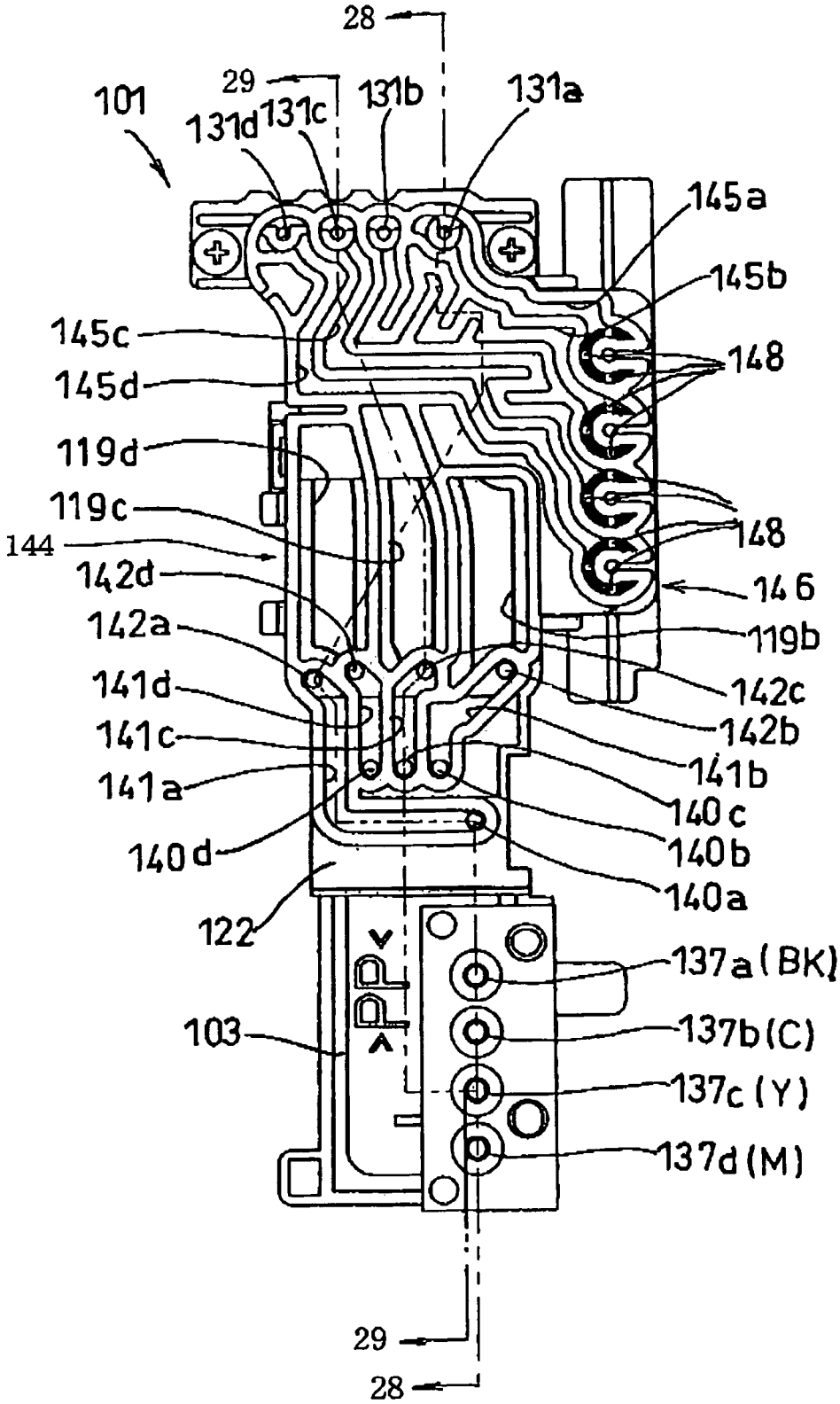
FIG. 26 is a plan view of the upper case of the damping device with the upper flexible membrane being removed from the upper surface of the upper case.

As shown in FIGS. 21A and 25, the lower case 123 has a lower opening which occupies a major portion of a lower surface thereof, and the primary partition wall 116 of the lower case 123 is distant inward from, and is parallel to, each of the upper and lower open ends thereof. The lower open end of the lower case 123 is liquid-tightly closed by a flexible membrane 124 as a flexible sheet that is constituted by a film formed of a synthetic resin and does not allow permeation of air or liquid. The flexible membrane 124 functions as a pressure-change damping portion that will be described later. More specifically described, an outer periphery of the lower flexible membrane 124 is bonded, by, e.g., adhesion or ultrasonic welding, to a lower end surface of an outer wall 125 of the lower case 123 that defines the lower opening of the lower case 123, as shown in FIGS. 25, 28, and 29.

The lower flexible membrane 124 and the primary partition wall 115 cooperate with each other to define the flat first chamber 119*a* as part of the black-ink damping chamber 113*a*. The first chamber 119*a* functions as a pressure-change damping chamber, and the flexible membrane 124 facing the primary partition wall 115 and liquid-tightly closing the lower open end of the first chamber 119*a* functions as the pressure-change damping portion. As shown in FIG. 25, the damping device 101 is fixed to the head holder 100, such that between the lower flexible membrane 124 and the bottom wall 100*c* of the head holder 100, there is left a clearance which allows deformation of the flexible membrane 124. The head holder 100 is mounted on the carriage 3' such that the flexible membrane 124 (i.e., the pressure-change damping portion) partly defining the first chamber (.e., the pressure-change damping chamber) 119*a* of the black-ink damping chamber 113*a* extends substantially horizontally. As shown in FIGS. 21A and 25, the lower case 123 has the four ink flow outlets 109 (109*a*, 109*b*, 109*c*, 109*d*) that communicate with the four ink supply inlets 107 of the recording head 21, respectively. The four ink flow outlets 109 open downward in the lower surface of the lower case 123, such that the four ink flow outlets 109 are arranged in an array, are opposed to the fur ink supply inlets 107, respectively, and are located at a height position lower than the lower flexible membrane 124. The recording head 21 is provided such that the four arrays of ink ejection nozzles 22*a*, 22*b*, 22*c*, 22*d* extend along a plane substantially parallel to the primary partition wall 116.

As shown in FIGS. 21A, 22A, 27, and 28, the primary partition wall 115 having a generally rectangular shape in its plan view, has an ink flow inlet 126*a* communicating with one end portion of the first chamber 119*a* of the black-ink damping chamber 113*a*, and a communication passage 127 communicating with another end portion of the same 119*a*, such that the ink flow inlet 126*a* and the communication passage 127 are located at respective positions on a diagonal line of the rectangular shape of the partition wall 115. The communication passage 127 has a larger cross-section than that of the ink flow inlet 126*a*.

Figure 27:
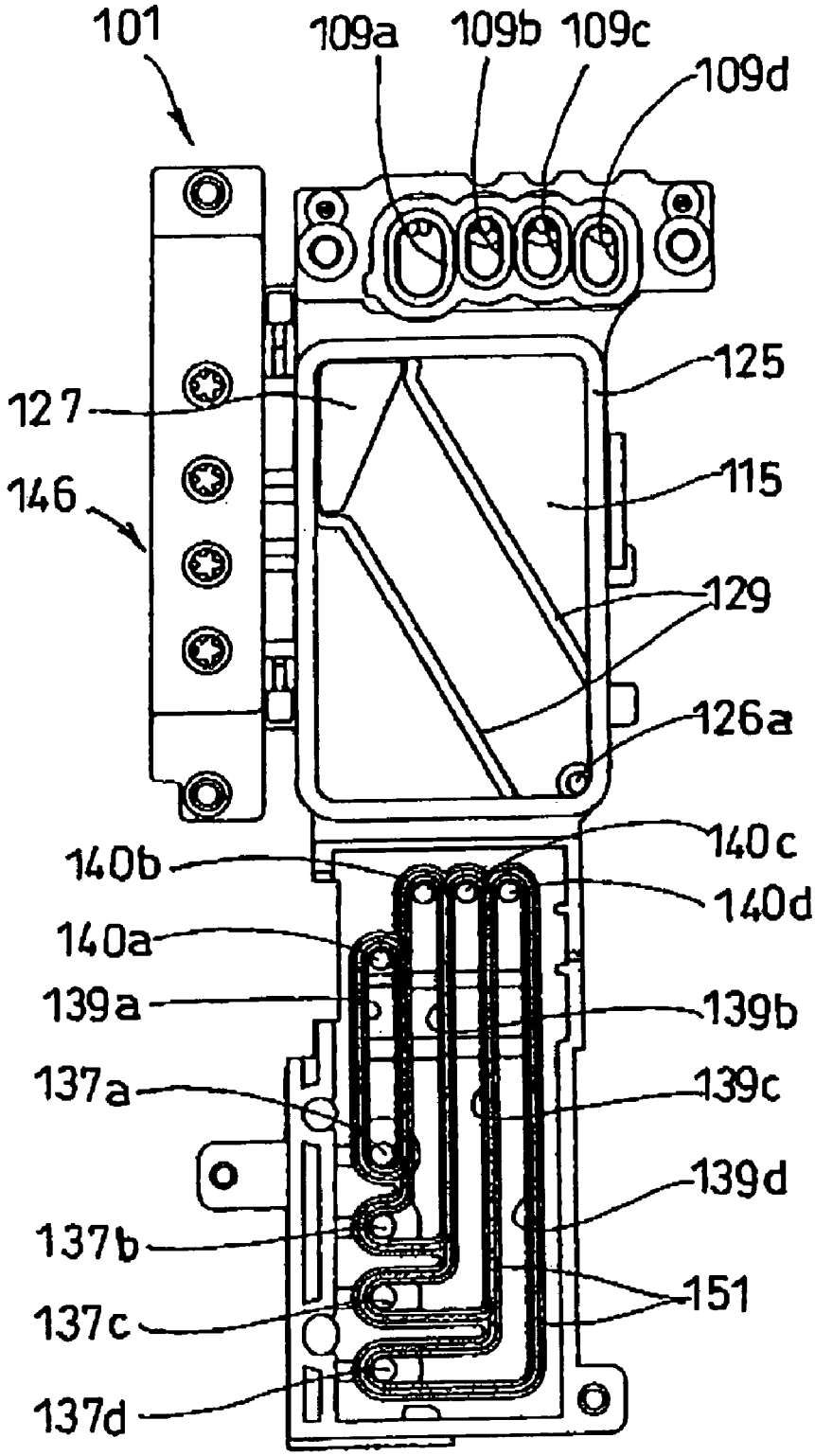
FIG. 27 is a bottom view of the lower case of the damping device with a lower flexible membrane being removed from a lower surface of the lower case.
Figure 29:
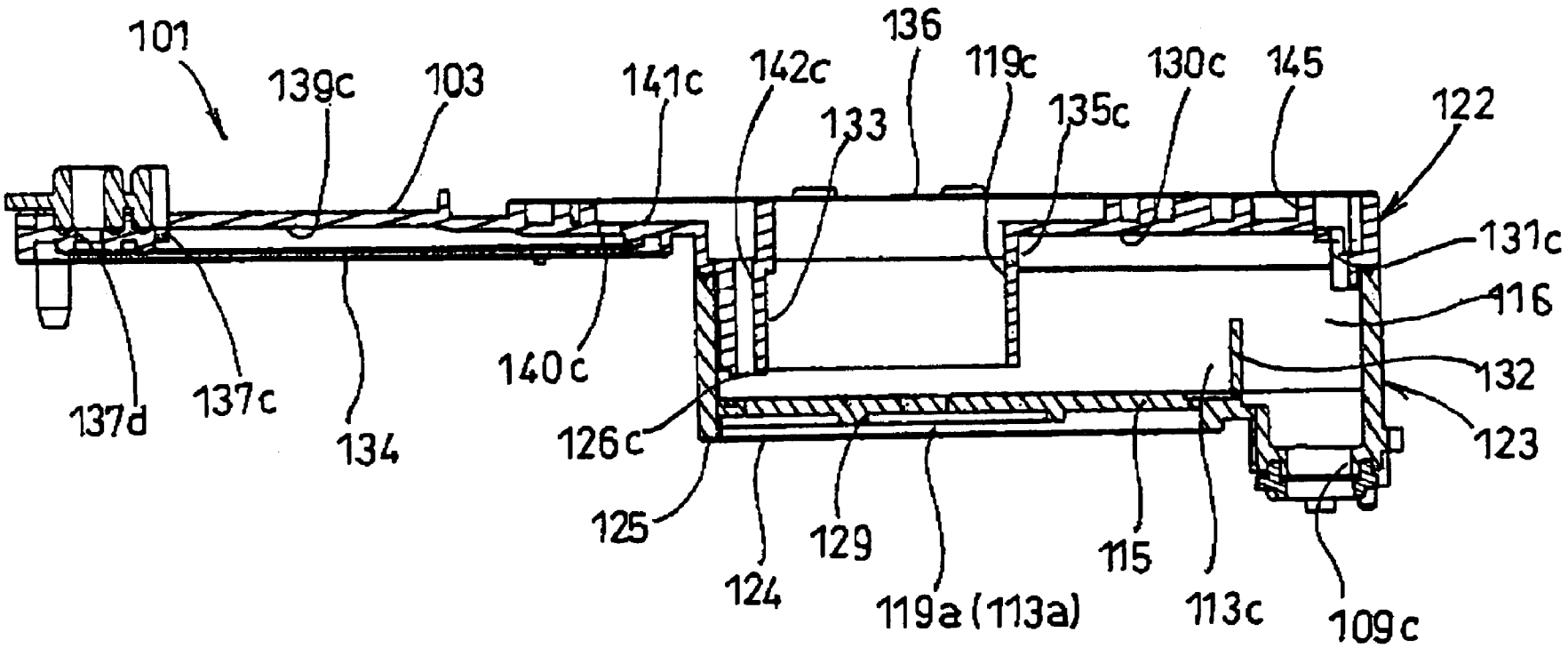
FIG. 29 is a cross-section view take along arrows indicated by 29, 29 in FIG. 26, with the flexible membranes being attached to the damping device.

As shown in FIGS. 27, 28, and 29, two ribs 129 are provided in the first chamber 119*a* of the black-ink damper chamber 113*a*, and cooperate with each other to define an ink guide passage connecting between the ink flow inlet 126*a* and the communication passage 127. More specifically described, in the third embodiment, the two ribs 129 project downward, integrally from the lower surface of the primary partition wall 115, and extend parallel to each other in a diagonal direction of the first chamber 119*a*. The ink flow let 126*a* and the communication passage 127 are located between the two ribs 129. The ribs 129 project downward over a certain length such that the ribs 129 do not reach the lower flexible membrane 124 and accordingly a clearance is left between respective lower ends of the ribs 129 and the flexible membrane 124. Thus, the two ribs 129 projecting downward from the primary partition wall 115 cooperate with each other to separate a ceiling portion of the first chamber 119*a* in the vicinity of the primary partition wall 115, into three separate portions, but do not separate a bottom portion of the first chamber 119*a* in the vicinity of the lower flexible membrane 124. Thus, the bottom portion of the damper chamber 119*a* can be filled with the lack ink.

The lower case 123 has the secondary partition walls 116, 117 projecting upward, integrally from the upper surface of the primary partition wall 115, and the upper portion of the lower case 123, located above the primary partition wall 115, cooperates with the upper case 122 to define the three damping chambers 113*b*, 113*c*, 113*d*.

More specifically described, as shown in FIG. 20B, the two secondary partition walls 116 are spaced from each other, extend over an entire length of the lower case 123, and cooperate with the side wall of the lower case 123 to define the three damping chambers 113*b*, 113*c*, 113*d* corresponding to the cyan, yellow, and magenta inks, respectively. The damping chambers 113*b*, 113*c*, 113*d* communicate with the corresponding ink flow outlets 109*b*, 109*c*, 109*d*, at respective positions corresponding to respective one end portions of the two secondary partition walls 116, i.e., one end portion of the primary partition wall 115, as shown in FIG. 25.

In addition, as shown in FIGS. 20B and 28, the secondary partition wall 117 cooperates with the outer or side wall of the lower case 123 to define the second chamber 120 as another portion of the black-ink damping chamber 113*a*. The second chamber 120 has a generally triangular shape in its plan view, and is located in a corner of the lower case 123 in the vicinity of the ink flow outlet 109*a*. Thus, the black-ink damping chamber 113*a* includes the first chamber (i.e., the pressure-change damping chamber) 119*a* located below the primary partition wall 115, and the second chamber 120 located above the primary partition wall 115. A plan-view area of the second chamber 120 is smaller than that of the first chamber 119*a*, but a portion of the second chamber 120 overlaps, in its plan view, the first chamber 119*a* located below the second chamber 120. As shown in FIG. 28, the communication passage 127 formed through the primary partition wall 115 defines an ink flow inlet of the second chamber 120. The second chamber 120 communicate with the ink flow outlet 109*a* located in the vicinity of one end portion of the primary partition wall 115. Thus, the ink flow inlet (ie., the communication passage 127) and the ink flow outlet (i.e., the ink flow outlet 109*a*) of the second chamber 120 are both provided in the bottom of the same 120.

The second chamber 120 temporarily stores the black ink, and a ceiling portion 130*a* of the upper case 122 defines an air-bubble collecting portion that collects or accumulates, little by little, air bubbles separating from the black ink stored by the second chamber 120. Thus, the second chamber 120 functions as an air-bubble collecting chamber of the black-ink damping chamber 113*a*. The ceiling portion 130*a* has an air discharging hole 131*a* formed through a thickness of the upper case 122, as shown in FIG. 28. In addition, a rib 132 projects upward from the primary partition wall 115 defining the bottom of the second chamber 120, as shown in the figure. The rib 132 is located between the communication passage 127 i.e., the ink flow inlet of the second chamber 120) and the ink flow outlet 109*a* (i.e., the ink flow outlet of the same 120), and separates a lower portion of the second chamber 120 into a first portion located on the side of the passage 127 and a second portion located on the side of the outlet 109*a*. The rib 132 does not have a height that reaches the ceiling portion 130*a* defining the top of the second chamber 120, but has a width that completely separates the lower half portion of the second chamber 120 into the two portions located on the respective sides of the passage 127 and the outlet 109*a*. The width of the rib 132 is a dimension thereof as measured in a direction perpendicular to the sheet of FIG. 28. Therefore, an amount of the black ink that enters the second chamber 120 via the passage 127 once flows upward along the rib 132, and then flows downward toward the ink flow outlet 109*a*.

As shown in FIGS. 29A and 21B, the upper case 122 has a plurality of recesses in each of the upper and lower surfaces thereof In particular on the side of the connection portion 103, the upper case 122 has three ribs 133 each of which has a generally rectangular, annular, continuous shape.

Each of the three separate spaces defined by the three ribs 133 of the upper case 122 has a generally rectangular shape in its plan view, and opens upward and downward. When the upper and lower cases 122, 123 are bonded to each other, the three ribs or the three separate spaces are accommodated by the three damping chambers 113*b*, 113*c*, 113*d* of the lower case 128, respectively. Each of the three ribs 133 has a length that does not reach the primary partition wall 115, so that a clearance is left between a lower end of the each rib 133 and the bottom of a corresponding one of the damping chambers 113*b*, 113*c*, 113*d*, i.e., the upper surface of the primary partition wall 115. The three separate spaces defined by the three ribs 133 define respective first chambers i.e., respective pressure-change damping chambers) 119*b*, 119*c*,

119*d* of the damping chambers 113*b*, 113*c*, 113*d* corresponding to the cyan, yellow, and magenta inks, respectively. Each of the respective first chambers 119*b*, 119*c*, 119*d* of the damping chambers 113*b*, 113*c*, 113*d* is designed to hold or keep a certain amount of air from a time before commencement of use of the present ink jet printer, and functions as the pressure-change damping chamber.

Since the respective amounts of air kept by the three first chambers 119*b*, 119*c*, 119*d* are completely separated by the corresponding ribs 133, no portions of those amounts of air are not discharged from respective air discharging holes 131*b*, 131*c*, 131*d*, described later, and the respective initial amounts of air corresponding to the length of downward projection of the ribs 133 are kept intact in the three first chambers 119*b*, 119*c*, 119*d*. In addition, respective upper open ends of the thee first chambers 119*b*, 119*c*, 119*d* are liquid-tightly closed by a common upper flexible membrane 136 as a flexible sheet that is constituted by a film formed of a synthetic resin and does not allow permeation of air or liquid. The upper flexible membrane 136 functions as the pressure-change damping portion, described later. An outer periphery of the upper flexible membrane 136 is bonded, by, e.g., adhesion or ultrasonic welding, to respective upper end surfaces of the three ribs 133 of the upper case 122.

The damping chambers 113*b*, 113*c*, 113*d* corresponding to the cyan, yellow, and magenta inks include, on respective downstream sides of the first chambers (i.e., the pressure-change damping chambers) 119*b*, 119*c*, 119*d* thereof, i.e., on respective one sides of the same 119*b*, 119*c*, 119*d* that are near to the respective ink flow outlets 109*b*, 109*c*, 109*d*, respective second chambers i.e., air-bubble collecting chambers) 135*b*, 135*c*, 135*d*. As shown in FIG. 29, in each of the damping chambers 113*b*, 113*c*, 113*d*, a rib 132 projects upward from the primary partition wall 135, at a position between a corresponding one of the first chambers 119*b*, 119*c*, 119*d* and a corresponding one of the ink flow outlets 109*b*, 109*c*, 109*d*. The rib 132 does not have a height that reaches a corresponding one of ceiling portions 130*b*, 130*c*, 130*d* that defines the top of a corresponding one of the second chambers 135*b*, 135*c*, 135*d*, but has a width that completely separates a lower half portion of the corresponding second chamber 135 into two portions one of which is located on the side of the corresponding first chamber 119 and the other of which is located on the side of the corresponding ink flow outlet 109. Therefore, an amount of each of the cyan, yellow, and magenta inks that enters the corresponding second chamber 135 via the corresponding first chamber 119 once flows upward along the rib 132, and then flows downward toward the corresponding ink flow outlet 109.

As shown in FIGS. 22 and 29, the upper case 122 includes the ceiling portions 130*b*, 130*c*, 130*d* defining the respective tops of the second chambers 135*b*, 135*c*, 135*d*, and has three air discharging holes 131*b*, 131*c*, 131*d* each of which is formed through a corresponding one of the three ceiling portions 130*b*, 130*c*, 130*d*.

As described above, the connection portion 103 of the upper case 122 is located in a downstream-side end portion thereof in the sheet feeding direction A As shown in FIGS. 18, 23, 26, and 28, the connection portion 103 has four supply tube connection ports 137 (137*a*, 137*b*, 137*c*, 137*d*) corresponding to the black, cyan, yellow, and magenta inks, respectively. The connection ports 137 are formed in the connection portion 103 such that the ports 137 are arranged in an array along one side of the portion 103 in the X direction.

The fur flexible ink supply tubes 14' are connected to the four supply-tube connection ports 137, respectively, via respective joint members 138 having respective flow passages corresponding to the four color inks. As shown in FIGS. 20A, 20B, 21A, 21B, and 22, the fur connection ports 137 communicate with the fur damping chambers 113, respectively, via respective ink flow passages, etc. formed in the upper and lower cases 122, 128.

As shown in FIGS. 20A, 20B, 21A, 21B, 22A, 22B, 23, 26, 27, and 28, an ink flow passage corresponding to the black ink is formed in the connection portion 103 of the upper case 122, and the lower case 123. The connection portion 103 has a first groove-like passage 139*a* that communicates, at one end thereof, with the corresponding supply-tube connection port 137*a* and opens downward in the lower surface of the portion 103; a first communication hole 140*a* that is formed, at the other end of the first passage 139*a*, through the thickness of the portion 103 and opens in the upper and lower surfaces of the same 103; a generally L-shaped second groove-like passage 141*a* that communicates, at one end thereof, with the first hole 140*a* and opens upward in the upper surface of the portion 103; and a second communication hole 142*a* that is formed, at the other end of the second passage 141*a*, through the thickness of the portion 103 and opens in the upper and lower surfaces of the same 103. The lower case 123 has, as shown in FIG. 20B; a third communication hole 143 that is formed through the outer or side wall of the case 123, at a position adjacent to the magenta-ink damping chamber 113*d* and distant from the ink flow outlet 109*d*. A lower end of the third communication hole 143 opens in the lower surface of the primary partition wall 115, and this lower open end defines the ink flow inlet 126*a* of the first chamber 119*a* of the black-ink damper chamber 113*a*. However, the supply-tube connection port 137*a* may be said as the ink flow inlet of the black-ink damping chamber 115*a*. When the upper and lower cases 122, 123 are bonded to each other, the upper end of the third communication hole 143 and the lower end of the second communication hole 142*a* are liquid tightly bonded to each other. Thus, the supply-tube connection port 137*a* corresponding to the black ink is connected to the first chamber (pressure-change damping chamber) 119*a* of the black-ink damping chamber 113*a*.

As shown in FIGS. 21A, 21B, 22A, 22B, 28, 26, 27, and 29, respective ink flow passages corresponding to the cyan, yellow, and magenta inks are formed in the connection portion 103 of the upper case 122. The connection portion 103 has three first groove-like passages 139*b*, 139*c*, 139*d* that communicates, at respective one ends thereof with the corresponding supply tube connection ports 137*b*, 137*c*, 137*d* and open downward in the lower surface of the portion 103; three first communication holes 140*b*, 140*c*, 140*d* that are formed, at the respective other ends of the three first groove-like passages 139*b*, 139*c*, 139*d*, through the, thickness of the portion 103 and open in the upper and lower surfaces of the same 103; three generally L-shaped second groove-like passages 141*b*, 141*c*, 141*d* that communicate, at respective one ends thereof, with the corresponding first holes 140*b*, 140*c*, 140*d* and open upward in the upper surface of the portion 103; and three second communication holes 142*b*, 142*c*, 142*d* that are formed, at the respective other ends of the three second passages 141*b*, 141*c*, 141*d*, through the thickness of the portion 103 and open in the upper and lower surfaces of the same 103. Thus, the three supply-tube connection ports 137*b*, 137*c*, 137*d* corresponding to the cyan, yellow, and magenta inks are connected to the respective first chambers (pressure-change damping chambers) 119*b*, 119*c*, 119*d* of the three damping chambers 113*b*, 113*c*, 113*d*.

The three second communication holes 142*b*, 142*c*, 142*c* are formed in the respective ribs 133, and extend downward a small distance from respective lower ends of the same 133. As shown in FIGS. 21A, 21B, 22A, and 22B, respective lower open ends of the three second communication holes 142*b*, 142*c*, 142*d* define respective ink flow inlets 126*b*, 126*c*, 126*d* of the three damping chambers 113*b*, 113*c*, 113*d*. Thus, the three supply-tube connection ports 137*b*, 137*c*, 137*d* corresponding to the cyan, yellow, and magenta inks are connected to the three damping chambers 113*b*, 113*c*, 113*d*, respectively.

However, the ports 137, the passages 139, 141, and the holes 140 may be said as the ink flow inlets of the damping chambers 113, and the holes 142, 143 having the ink flow inlets 126 may be said as the communication passages that communicate the ink flow inlets 139, 140, 141 with the corresponding damping chambers 113.

Figure 23:
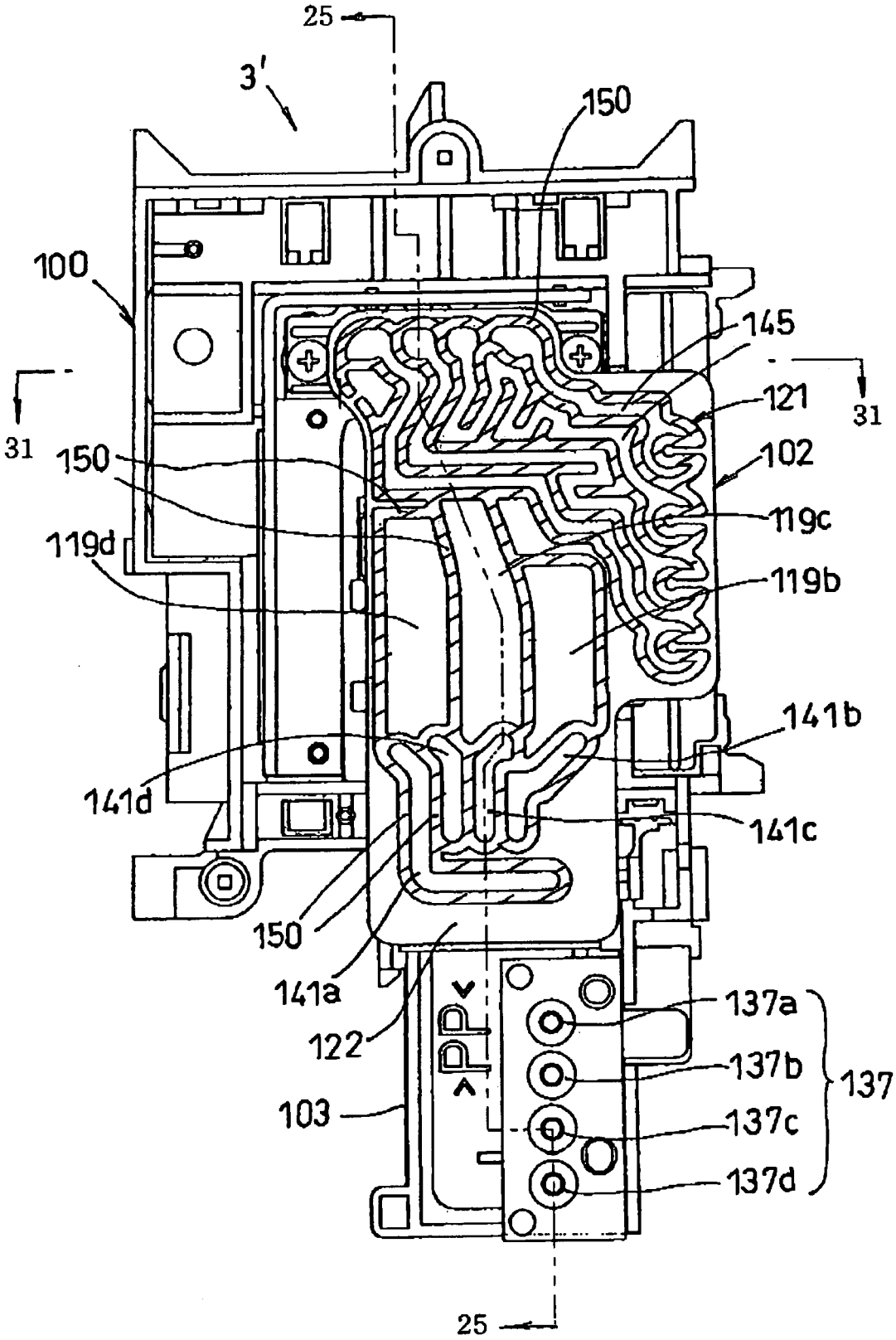
FIG. 23 is a plan view of the recording head unit with an upper flexible membrane being removed from an upper surface of the upper case of the damping device.

As described above, the upper case 122 has the four air discharging holes 131*a*, 131*b*, 131*c*, 131*d* that are formed therethrough to communicate with the four second chambers (air-bubble collecting chambers) 120, 135*b*, 135*c*, 135*d*, respectively. The four air discharging holes 131*a*, 131*b*, 131*c*, 131*d* communicate, at respective upper ends thereof, with respective one ends of four air discharging passages 145*a*, 145*b*, 145*c*, 145*d* that are provided in the form of separate grooves in the upper surface of the upper case 122. As shown in FIG. 23, the blur air discharging passages 145 run in a direction perpendicular to the lengthwise direction of the upper case 122, while the passages 145 are more or less curved, so as to communicate, at the respective other ends thereof, with the air discharging valve device 102.

As shown in FIGS. 28 and 29, the first groove-like passages 139*a*, 139*b*, 139*c*, 139*d* formed in the lower surface of the connection portion 103 are commonly closed by a single flexible membrane 134 as a flexible sheet that is bonded by, e.g., adhesion or ultrasonic welding to a lower end of an outer wall of the portion 103. Thus, the inks can flow in the passages 139. The flexible membrane 134 is formed of a synthetic resin such as PET (polyethylene telephthalate). The flexible membrane 134 may be provided by a different sort of flexible sheet such as a rubber sheet The second groove-like passages 141*a*, 141*b*, 141*c*, 141*d* and the air discharging passages 145*a*, 145*b*, 145*c*, 145*d* are closed in the same manner by respective extended portions of the upper flexible membrane 186 functioning as the pressure-change damping portion. Thus, the inks can flow in the passages 141, and the air (or air bubbles) can flow in the passages 145.

Alternatively, the connection portion 103 may be formed as an integral portion of the lower case 123. In this case, the first groove-like passages 139*a*, 139*b*, 139*c*, 139*d* may be formed in the upper or lower surface of the connection portion 103, and the respective open ends of the passages 139 may be closed by the flexible membrane 134 or a different sort of flexible sheet.

Figure 30:
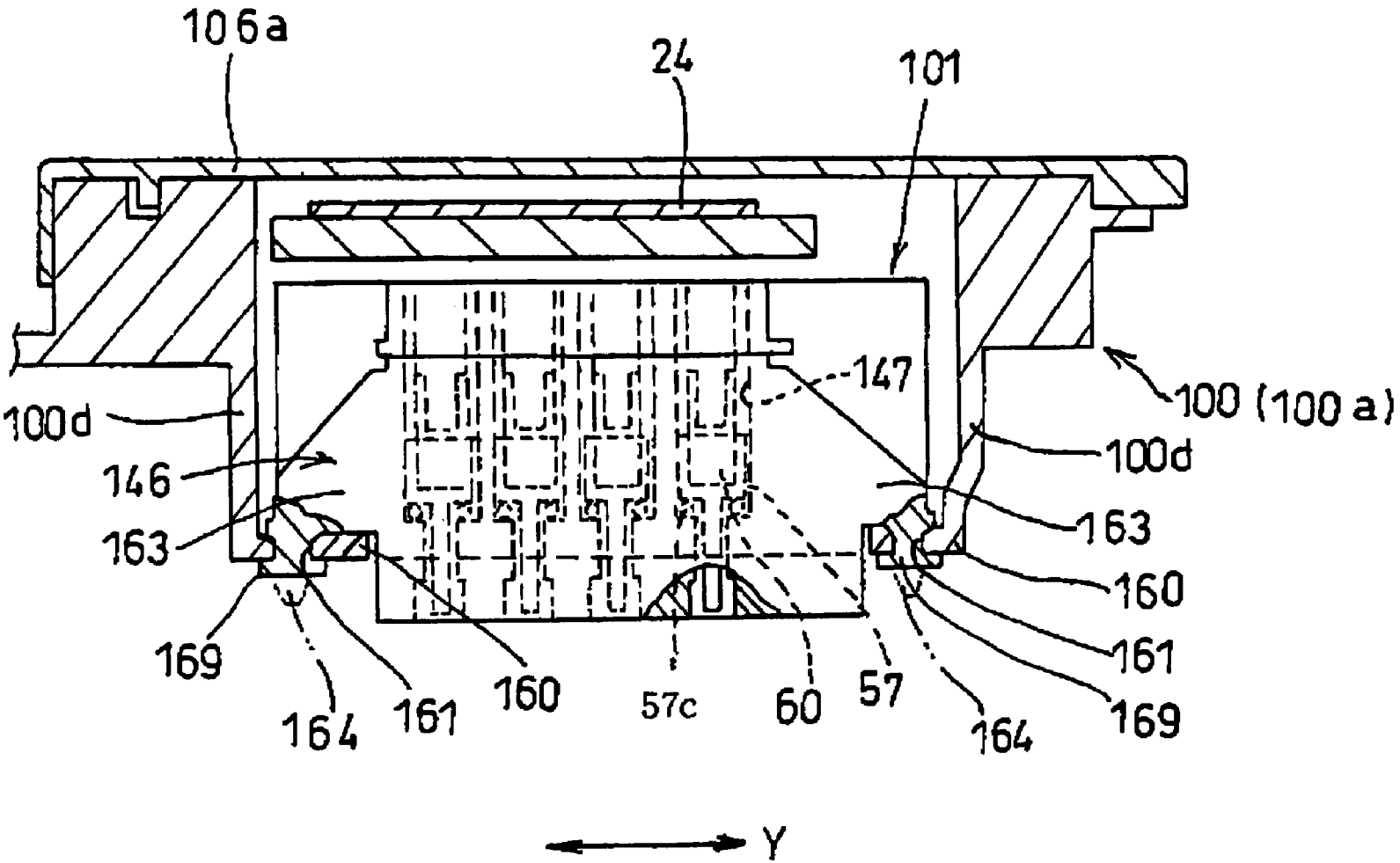
FIG. 30 is a cross-section view take along arrows indicated by 30, 30 in FIG. 19.

Next, the air discharging valve device 102 will be described. As shown in FIGS. 20A and 21B, the lower case 123 includes, as an air-discharging-valve-device supporting portion, an accommodating portion 146 located in one end portion thereof The accommodating portion 146 has four valve holes 147 that correspond to the four color inks, respectively, and are vertically elongate so as to open upward and downward. One end portion of the upper case 122 is extended to a position where the one end portion of the case 122 covers an upper end of the accommodating portion 146. The four air discharging passages 145*a*, 145*b*, 145*c*, 145*d* have, as the above-described respective other ends thereof respective open ends 148 each of which communicates with a corresponding one of the four valve holes 147. The accommodating portion 146 as the air-discharging-valve-device supporting portion is integrally connected to a remaining portion of the lower case 123, like in the above-described first embodiment shown in FIG. 8A. The accommodating portion 146 extends in a downward direction while a space 162 (FIG. 31) is left between the portion 146 and the remaining portion of the lower case 123. Respective lower open ends of the four valve holes 147 are located at a height position substantially level with the lower surface (i.e., nozzle supporting) surface of the recording head 21. A side wall 100*e* (FIG. 19) of the head holder 100 is inserted in the space 162 present between the accommodating portion 146 and the remaining portion of the lower case 123. Like in each of the first and second embodiments, as shown in FIG. 30, each of the valve holes 147 accommodates a valve member 57 including a sealing portion 57*c* (e.g., a separate packing member), and a spring 60. The valve member 57 is movable to open and close the lower open end of the each valve hole 147. When the recording head unit 3, is moved to a right-hand end position of the ink jet printer, shown in FIG. 17, where a maintenance unit, not shown, is provided, the valve member 57 is moved upward to open the lower end of the valve hole 147, so that the thus opened lower end of the valve hole 147 is sucked by a suction pump, not shown. Thus, the respective amounts of air bubbles collected or accumulated in the respective second chambers (air-bubble collecting chambers) 120, 135*b*, 135*c*, 135*d* of the damping chambers 113*a*, 113*b*, 113*c*, 113*d* can be discharged through the respective air discharging holes 131*a*, 131*b*, 131*c*, 113*d* and the air discharging passages 145*a*, 145*b*, 145*c*, 145*d*.

In the third embodiment, first, the inks are supplied from the ink tanks, not shown, to the damping device 101 via the flexible ink supply tubes 14' and the supply-tube connection ports 137*a*, 137*b*, 137*c*, 137*d*. In particular, the black ink flows, as shown in FIG. 28, into the first chamber pressure-change damping chamber) 119*a* of the black-ink damping chamber 113*a*, located under the primary partition wall 115, via the supply-tube connection port 137*a*, the first and second groove-like passages 139*a*, 141*a* provided in the connection portion 103, and the ink flow inlet 126*a*. The pressure change of the black ink, transmitted to the ink flow inlet 126*a*, is directly applied to the lower flexible membrane (pressure-change damping portion) 124 facing the inlet 126*a*. Thus, the pressure change of the black ink can be reliably damped or absorbed by the large area of the membrane 124. The flow of the black ink including the air bubbles is guided toward the communication passage 127 having the large cross-section, by the guide ribs 129 projecting downward from the primary partition wall 115 into the ceiling portion of the first chamber 119*a*.

Then, the black ink flows from the communication passage 127 into the second chamber 120 of the black-ink damping chamber 113*a* that is located above the primary partition wall 115. Since the second chamber 120 is located above the first chamber 119*a*, the air bubbles do not remain in the first chamber 119*a*, but move into the second chamber 120. The black ink is reserved in the second chamber 120, before it is supplied to the recording head 21. More specifically described, the black ink flows into the second chamber 120 through a portion of the bottom thereof, subsequently moves over the rib 132, and then reaches the ink flow outlet

109*a* formed in another portion of the bottom. During the flowing of the black ink, the air bubbles separate from the black ink, move upward, and accumulate little by little in the ceiling portion (air-bubble collecting portion) 130*a* of the second chamber 120. Then, the black ink is supplied from the ink flow outlet 109*a* to one of the ink supply inlets 107 of the recording head 21 that corresponds to the black ink.

The cyan, yellow, and magenta inks flow, as shown in FIG. 29, into the respective first chambers (pressure-change damping chambers) 119*b*, 119*c*, 119*d* of the cyan-ink, yellow-ink, and magenta-ink damping chambers 113*b*, 113*c*, 113*d*, via the respective supply-tube connection ports 137*b*, 137*c*, 137*d*, the respective first groove-like passages 139*b*, 139*c*, 139*d*, the respective second groove-like passages 141*b*, 141*c*, 141*d* provided in the connection portion 103, and the respective ink flow inlets 126*b*, 126*c*, 126*d*. The first chambers (pressure-change damping chambers) 119*b*, 119*c*, 119*d* which keep the respective certain amounts of air and whose ceiling portions are defined by the upper flexible membrane 136, are located in respective upstream-side portions of the damping chambers 113*b*, 113*c*, 113*d*. Therefore, the pressure change of each of the cyan, yellow, and magenta inks is damped or absorbed by the cooperation of the flexible membrane 186 and the air. The air bubbles separating, and moving upward, from each of the inks that has flowed into a corresponding one of the damping chambers 113*b*, 113*c*, 113*d*, are accumulated little by little in the corresponding second chamber (air-bubble collecting chamber) 135*b*, 135*c*, 135*d*.

When the recording head unit 3' is moved to the waiting position where an air-bubble removing operation as a sort of maintenance operation is carried out, and the air discharging valve device 102 of the unit 3' is connected to a suction pump, not shown, like in the first embodiment, the air bubbles accumulated in the second chambers 120, 135*b*, 135*c*, 135*d* are removed via the respective air discharging holes 131*a*, 131*b*, 131*c*, 131*d*, the respective air discharging passages 145*a*, 145*b*, 145*c*, 145*d*, and the air discharging valve device 102.

In the third embodiment, the rib 132 projects upward from the bottom of each second chamber 120, and thereby separates the second chamber 120 into the first portion located on the side of the flow inlet thereof i.e., the communication passage 127, and the second portion located on the side of the flow outlet thereof i.e., the ink flow outlet 109*a*. Since the rib 132 is like a wall and has no meshes unlike a filter, the black ink flowing into the second chamber 120 via the communication passage 127 located on the side of the bottom of the chamber 120, moves over the rib 132 before the ink reaches the ink flow outlet 109*a* also located on the side of the bottom. Thus, the air bubbles, large or small, contained in the black ink can be prevented from flowing with the ink out of the ink flow outlet 109*a* by the momentum of the ink. Since the air-bubbles move upward with the black ink along the rib 132, the air bubbles can be easily separated from the ink and accumulated in the air-bubble collecting portion defined by the ceiling portion 130*a* of the second chamber 120. Thus, the recording head 21 is freed of the problem that the air bubbles occlude the ink ejection nozzles of the head 21 and thereby make the nozzles 21 unable to eject the ink.

The damping chamber 113*a* corresponding to the black ink includes the first chamber (pressure-change damping chamber) 119*a* that absorbs the pressure change of the ink, in addition to the second chamber 120 that accumulates the air bubbles separated from the ink. Since the black ink is more frequently used than the other color inks, and is supplied in a greater amount than respective amounts in which the other color inks are supplied, and since the black ink is supplied against only a smaller flow resistance than respective flow resistances against which the other color inks are supplied, a greater pressure wave is propagated to the black ink. Since, however, the first chamber 119*a*, i.e., the pressure-change damping chamber 119*a* is independent of the, second chamber 120, the chamber 119*a* can exhibit a high pressure-change damping effect.

Though the damping chamber 113*a* includes the first and second chambers 119*a*, 120 independent of each other, the damping chamber 113*a* as a whole can be provided in a small space, because the two chambers 119*a*, 120 share the primary partition wall 115, and overlap each other in their plan view such the two chambers 119*a*, 120 are located on the lower and upper sides of the wall 115, respectively.

In addition, since the rib 132 is integral with the lower case 123 that defines the lower portion of the second chamber 120, the second chamber 120 having the rib 132 therein can be easily obtained by just bonding the upper and lower cases 122, 123 to each other.

The lower surface of the lower case 123 to which the lower flexible membrane 124 is liquid-tightly adhered, and the upper and lower surfaces of the upper case 122 to which the upper flexible membrane 136 and the third flexible membrane 134 are liquid-tightly bonded are substantially parallel to the respect contact surfaces of the upper and lower cases 122, 123 that are liquid-tightly fixed to each other. Therefore, the flexible membranes 14, 136, 134 can be easily bonded.

More specifically described, the upper flexible membrane 136 is liquid-tightly bonded, by adhesion or ultrasonic welding, to an upper end surface of a projection wall 150 that defines, in the upper surface of the upper case 122, the second chambers (pressure-change damping chambers) 119*b*, 119*c*, 119*d*, the second groove-like passages 141*a*, 141*b*, 141*c*, 141*d*, and the air discharging passages 145*a*, 145*b*, 145*c*, 145*d*, as shown in FIG. 23. The third flexible membrane 134 is liquid-tightly bonded, by adhesion or ultrasonic welding, to a lower end surface of a projection wall 151 that defines, in the lower surface of the upper case 122, the first groove-like passages 139*a*, 139*b*, 139*c*, 139*d*, as shown in FIG. 27. In addition, the lower flexible membrane 124 is liquid-tightly bonded, by adhesion or ultrasonic welding, to the lower end surface of the outer wall 125 that defines, in the lower surface of the lower case 123, the second chamber 119*a* corresponding to the black ink, as shown in FIG. 27.

Thus, the upper end surface of the projection wall 150, the lower end surface of the projection wall 151, and the lower end surface of the outer wall 125 are parallel to the respective contact surfaces of the upper and lower cases 122, 123. Therefore, for example, after the respective contact surfaces of the two cases 122, 123 are bonded to each other, the lower flexible membrane 124 and the third flexible membrane 134 can be simultaneously adhered, or ultrasonic-welded and, after the bonded cases 122, 123 are turned upside down, the upper flexible membrane 136 can be liquid-tightly bonded. In this case, the bonding operation can be easily carried out.

Next, there will be described a manner in which the damping device 101 is attached to the head holder 100 in the third embodiment.

The main case 100*a* of the head holder 100 includes three high side walls 100*d* and one low side wall 100*e* that are integral with each other, so that the damping device 101 can be inserted in the main case 100*a* from above the same 100*a*.

Two arm portions 160 each as a supporting portion project substantially horizontally from an outer surface of the low side wall 100*e*, such that the two arm portions 160 are distant from each other by an appropriate distance in the X direction. The two arm portions 160 have respective insertion holes 161 vertically formed through respective thickness of the arm portions 160. The recording head 21 is adhered to a lower surface of the reinforcing frame 108 so as to provide a sub-unit that in turn is fixed with adhesive to a lower surface of the bottom wall 100*c* of the head holder 100.

As shown in FIGS. 19, 20B, 21A, 24, and 30, two reinforcing portions 163 each having a generally inverted T-shaped cross-section are integrally formed with two opposite end portions of the accommodating portion (air-discharging-valve-device supporting portion) 146 that are opposite to each other in the Y direction in which the valve members 47 are provided in one array. The two reinforcing portions 163 include respective horizontal portions 163*a* from each of which a thermal-calking pin 164 projects downward.

As shown in FIGS. 19 and 25, the sealing members 110 are interposed between the lower surface of the lower case 123 of the damping device 101 and the upper surface of the reinforcing frame 108. The sealing members 110 have respective through-holes that assure that the fur ink flow outlets 109*a*, 109*b*, 109*c*, 109*d* are opposed to, and communicated with, the four ink supply inlets 107 of the recording head 21, respectively, and that the four flow outlets 109 are separated from each other and the four supply inlets 107 are separated from each other.

The damping device 101 is inserted into the main case 100*a* of the head holder 100, from a position above the same 100*a*, such that the accommodating portion (air-discharging-valve-device supporting portion) 146 of the device 101 is located outside the low side wall 100*e* of the main case 100*a*. Thus, the low side wall 100*e* is inserted in the space 162 provided between the accommodating portion 146 and the remaining portion of the lower case 123, as shown in FIG. 31.

Figure 31:
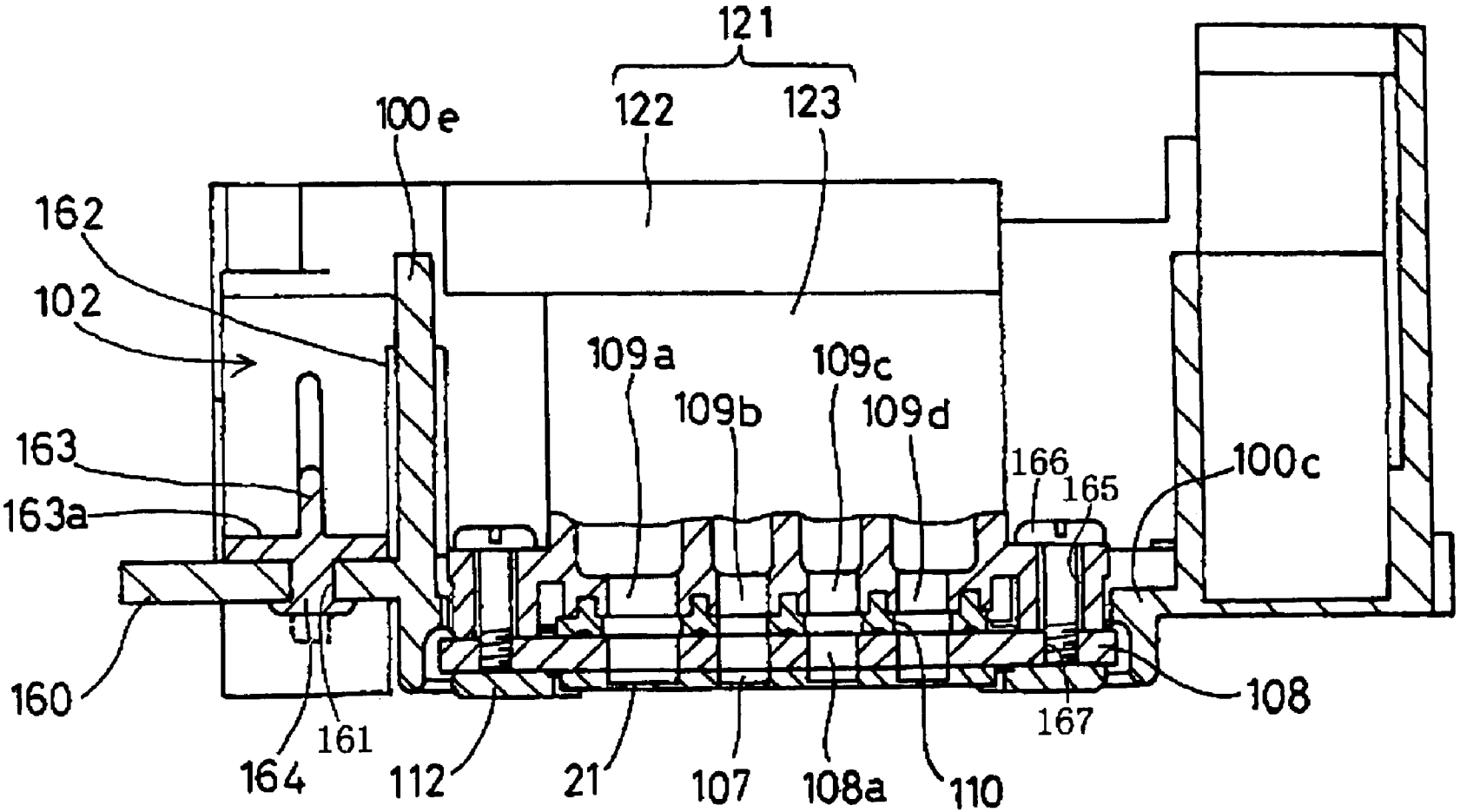
FIG. 31 is a cross-section view take along arrows indicated by 31, 31 in FIG. 23.

As shown in FIG. 19 and 31, the lower case 123 has two through-holes 165 at respective positions outside two lengthwise opposite ends of the array of sealing members 110, respectively. Two small screws 166 are inserted through the two through-holes 165, respectively, and are screwed into two threaded holes 167 of the reinforcing frame 108, respectively. Thus, the damping device 101 is fastened to the head holder 100. In this case, the respective horizontal portions 163*a* of the two reinforcing portions 163 of the accommodating portion 146 are held in contact with the two arm portions 160 of the head holder 100, respectively, and the two pins 164 are fitted in the two insertion holes 161, respectively. When a heating tool, not shown, is pressed against a lower end of each pin 164 projecting downward from the lower surface of the corresponding arm portion 160, the each pin 164 that is formed of a thermoplastic resin is softened to provide a thermally calked portion 169, shown in FIG. 30. When the two calked portions 169 are hardened, the damping device 101, the air discharging valve device 102, and the head holder 100 are strongly fixed to each other, such that those elements 101, 102, 100 are integral with each other and are not separable from each other.

Thus, the horizontal portions 163*a* and the arm portions 160 extend parallel to the plane on which the ink flow outlets 109 are connected to the ink supply inlets 107, respectively. In other words, the direction in which the pins 164 are fitted in the insertion holes 161 is the same as the direction in which the ink flow outlets 109 are opposed to the ink supply inlets 107. Since the pins 164 are fixed to the insertion holes 161, the sealing members 110 can liquid tightly seal the ink flow outlets 109 and the ink supply inlets 107, with higher reliability. In addition, since the pins 164 are thermally calked, the pins 164 can be more easily and quickly fixed than screws. In addition, since the pins 164 cannot come off the arm portions 160, the internal elements of the damping device 101 are prevented from rattling, and thus the recording head unit 3' enjoys higher reliability.

In the above-indicated condition in which the damping device 101 is attached to the head holder 100, the damping device 101, the recording head 21, and the flexible flat cable 24 fixed to the upper surface of the head 21 are surrounded by the side walls 100*d*, 100*e* of the main case 100*a* of the head holder 100. Thus, when the lower surface (the nozzle supporting surface) of the recording head 21 is periodically wiped with a wiper, not shown, or the maintenance operation such as the air removing operation is carried out, the ink left on the lower surface of the recording head 21 or the lower surface of the accommodating portion 146 is prevented from entering the head holder 100. Therefore, the recording head 21 is surely freed of, e.g., an electric short circuit.

Next, a fourth embodiment of the present invention will be described by reference to FIG. 32. The fourth embodiment is obtained by modifying the three communication passages (ie., ink introducing passages) 50 of the damping device 13 of the ink jet printer shown in FIG. 8B. In the fourth embodiment, a damping device of an ink jet printer employs a case member 225 that has three ink introducing passages 250 in place of the three ink introducing passages 50. The three ink introducing passages 250 are located such that respective color inks (i.e., cyan, yellow, and magenta inks) introduced by those three passages 250 collide substantially perpendicularly against a substantially central portion of an upper flexible membrane 243 as a flexible sheet that closes respective upper open ends of three damping chambers 227 of the damping device. The central portion of the flexible membrane 243 is the most elastically deformable portion thereof. Respective upper open ends of the ink introducing passages 250 are located in the vicinity of the flexible membrane 243. Owing to this structure, the flexible membrane 243 can most effectively attenuate respective pressure changes of the color inks introduced by the passages 250.

In each of the first, second, and fourth embodiments, the direction in which the ink flows out of each ink introducing passage 50, 260, relative to the flexible membrane 43, 243, need not be around 90 degrees. It is, however, preferred that each ink flow have a considerably great normal-direction component relative to the flexible membrane 43, 243, more preferably, in the range of from about 45 degrees to about 90 degrees.

Figure 32:
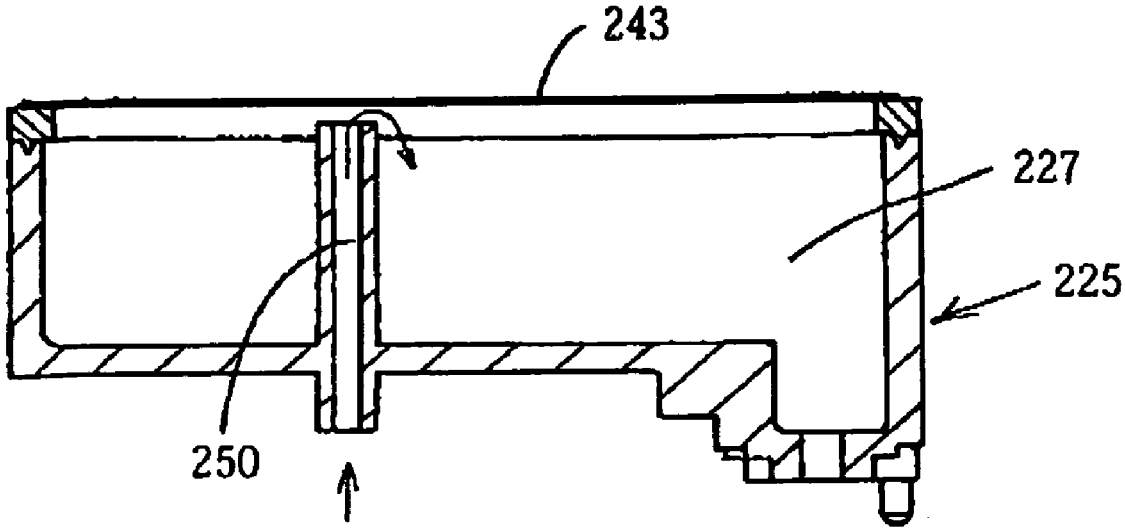
FIG. 32 is a cross-section view of an ink introducing passage of a damping device of another ink jet printer as a fourth embodiment of the present invention.

Another ink introducing passage 250 as shown in FIG. 32 may be employed to introduce a black ink into a black-ink damping chamber 227 of the damping device.

Next, a fifth embodiment of the present invention will be described by reference to FIGS. 33, 34A, and 34B. The fifth embodiment is obtained by replacing the air discharging valve device 26 shown in FIG. 8A, with an air discharging valve device 326 shown in FIG. 33. The same reference numerals as used in the first embodiment shown in FIG. 8A are used to designate the corresponding elements and parts of the fourth embodiment, and the description thereof is omitted. The air discharging valve 326 will be described in detail, below. An accommodating portion (i.e., an air-discharging-valve-device supporting portion) 34 as an integral portion of a lower case 32 has four substantially cylindrical valve holes 356 which correspond to four color inks and each of which is elongate in a vertical direction and has upper and lower open ends. One end portion of an upper case 31 of a case unit 25 is extended to a position where the end portion covers an upper end of the accommodating portion 34, such that respective ends of four air discharging passages 51 communicate with the respective upper open ends (i.e., the respective connection ports 52) of the four valve holes 356. The respective lower open ends of the four valve holes 356 define respective communication ports 356*c*.

Each of the valve holes 356 accommodates a valve member 357 which is displaceable in an axial direction thereof, and a spring member (e.g., a coil spring) 360 as a sort of biasing member that biases the valve member 357 toward the communication port 356*c*. The valve member 357 has a generally cylindrical shape, and includes an annular projection 357*a* which projects from an end surface thereof opposed to the communication port 356*c* and which surrounds the same 356*c*. The valve member 357 is formed, by molding, of an elastic material such as rubber and, when the annular projection 357*a* is elastically deformed to closely contact a bottom surface of the valve hole 356 that defines the communication port 356*c*, the valve member 357 closes the port 366*c*. When the four valve members 357 close the corresponding communication ports 356*c*, the air discharging valve device 326 is placed in its closed state.

When the valve members 357 are formed by molding of rubber, molding dies are used. Generally, a product armed by molding has an annular fin as another annular projection that corresponds to a plane along which respective contact surfaces of the molding dies are contacted with each other. In the present embodiment, each valve member 357 has a small size, for example, has a diameter of about 3 mm. In the case where a product having such a small size is formed by molding, it is not easy to modify molding dies so as to reduce the size of an annular fin relative to the product itself or to remove the fin from the product. This leads to increasing the production cost of the molding products. However, the present embodiment can employ valve members 357 that are formed by a common molding method. Therefore, each valve member 357 has an annular fin or projection 357*b* that projects, like an annular flange, outward from an upper end portion of an outer circumferential surface thereof that is remote from the communication port 356*c*.

Each of the four valve holes 356 has an inner circumferential surface opposed to the outer circumferential surface of the corresponding valve member 357. Each valve hole 356 includes a large-inner-diameter portion 356*a* and a small-inner-diameter portion 356*b*. The small-diameter portion 356*b* has an inner diameter smaller than that of the large-diameter portion 356*a*, is contactable with the valve member 357, and is nearer to the communication port 356*c* than the large-diameter portion 356*a*. A clearance 356*d* is left between the large diameter portion 356*a* and the valve member 357. The large-diameter portion 356*a* is opposed to the annular fin 357*b* of the valve member 357. More specifically described, the large-diameter portion 356 is at least partly defined by a portion of the inner circumferential surface of the valve hole 356 that is located between a first height position corresponding to the annular fin 357*b* of the valve member 357 held at its lowest position, and a second height position corresponding to the annular fin 357*b* of the valve member 357 held at its highest position. In the state in which the annular fin 357*b* of the valve member 357 is held at its highest position, that is, in the state in which the valve member 357 is held at an open position thereof *here the valve member 357 opens the communication port 356*c*, the outer circumferential surface of the valve member 357 is opposed to the inner circumferential surface of the small-diameter portion 356*b* of the valve hole 356 over an appropriate axial length that assures that a narrower clearance is provided between the valve member 357 and the small diameter portion 356*b* and accordingly air bubbles are sucked from a damping chamber 27 by a suction pump 74 via the wider clearance 356*d* and the communication port 356*c*.

Figure 34B:
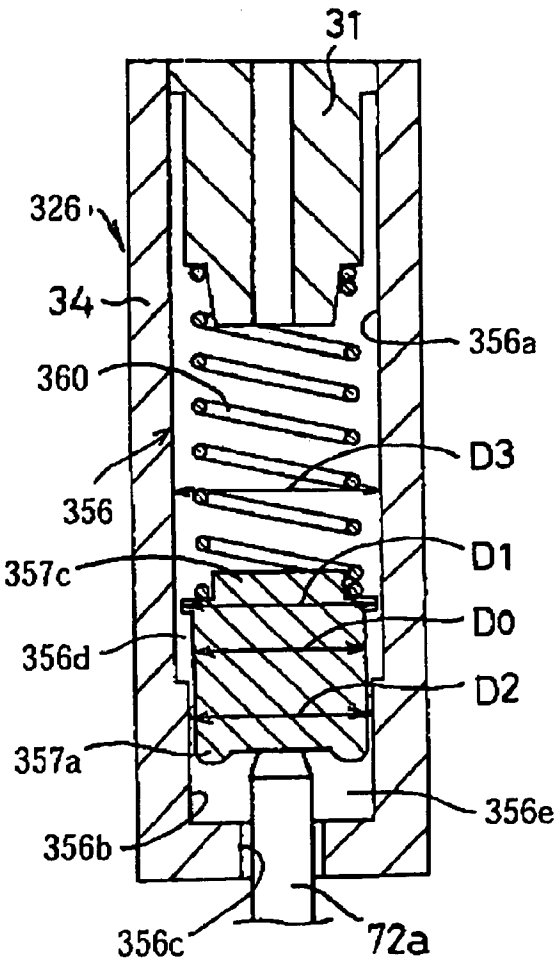
FIG. 34B is a cross-section view showing an open state of the air discharging valve device of FIG. 33.

As shown in FIG. 34B, each valve member 357, except the annular fin 357*b* thereof, has a diameter D0, and the annular fin 357*b* has a diameter D1 greater than the diameter D0, i.e., D1>D0. Providing that the respective inner diameters of the small-diameter portion 356*b* and the large-diameter portion 356*a* of each valve hole 356 are represented by D2 and D3, respectively, the following relationship is established: D0<D2<D1<D3, because the diameter D1 of the annular fin 357*b* is greater than the inner diameter D2 of the small-diameter portion 356*b*. The inner diameter D3 of the large-diameter portion 356*a* of the valve hole 356 is determined based on the diameter D1 of the annular fin 357*b* of the valve member 357. As shown in FIGS. 34 and 34B, each valve member 357 includes an engaging portion 357*c* that projects from an upper end thereof and engages one end of the spring member 60. However, the engaging portion 357*c* may have a different form than the projection shown in the figures.

Figure 33:
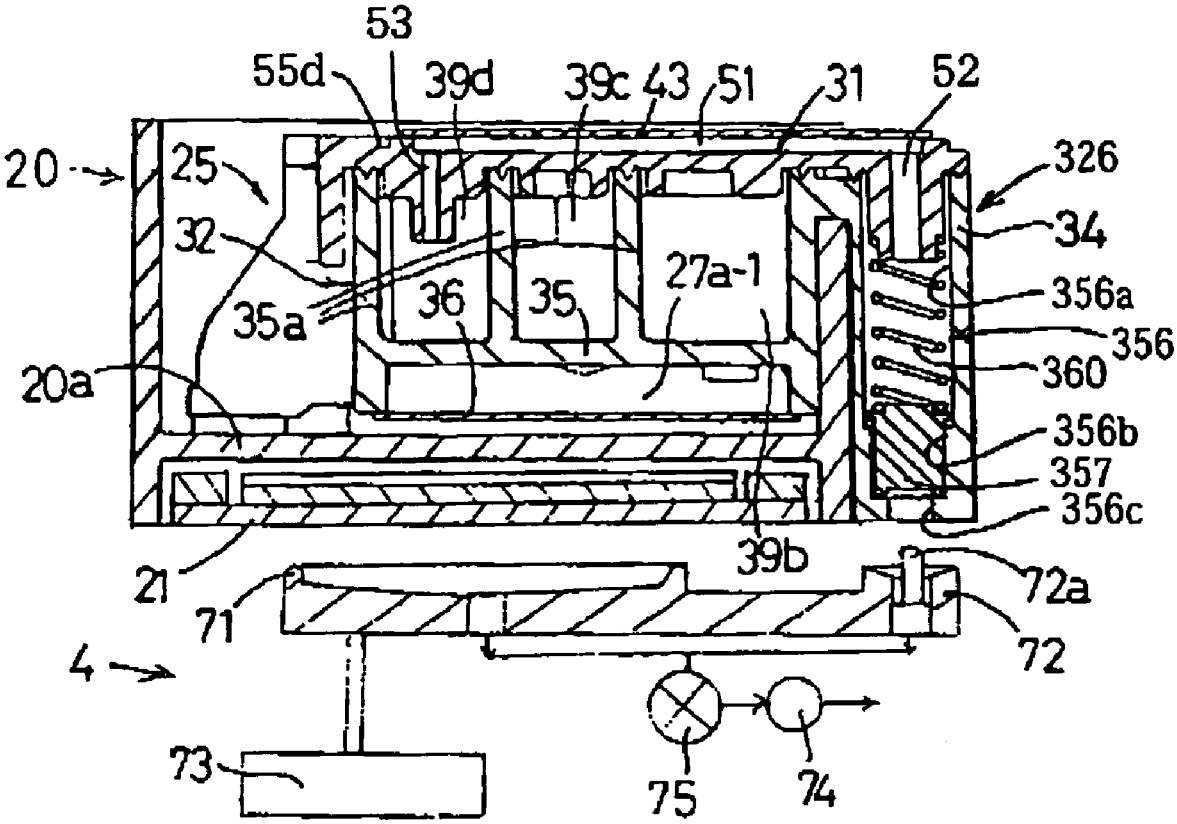
FIG. 33 is a cross-section view corresponding to FIG. 8A, showing an air discharging valve device of another ink jet printer as a fifth embodiment of the present invention.
Figure 34A:
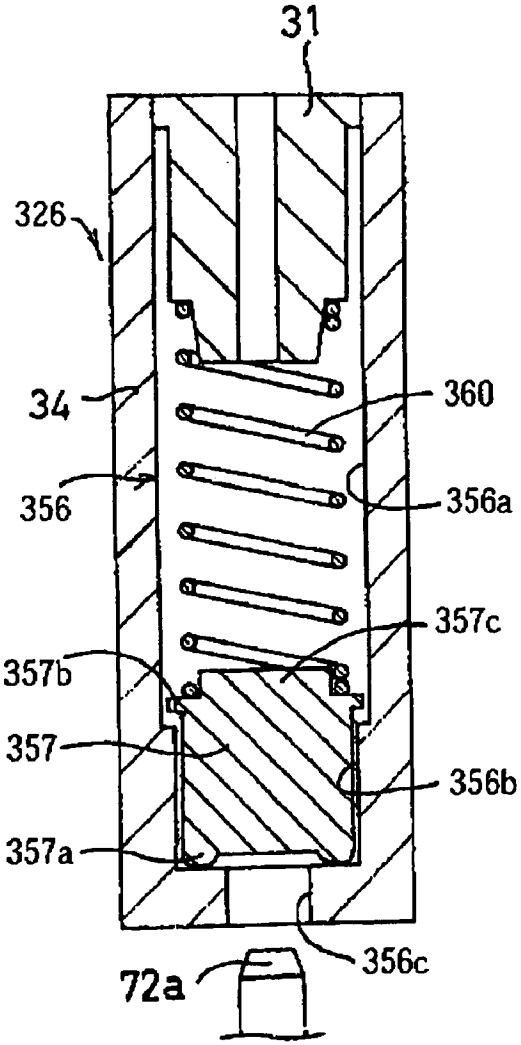
FIG. 34A is a cross-section view showing a closed state of the air discharging valve device of FIG. 33.

FIGS. 33 and 34A show the closed state of each valve member 357 in which the each valve member 357 is biased downward by the corresponding spring member 360 so as to close the corresponding communication port 356*c*; and FIG. 34B shows the open state of each valve member 357 in which the each valve member 357 is pushed upward by a projecting portion 72*a* of a corresponding small cap member 72 of a maintenance unit 4 so as to open the corresponding communication port 356*c*. The maintenance unit 4 has been described in detail in connection with the first embodiment shown in FIG. 8A. Thus, the respective projecting portions 72*a* of the four small cap members 72 of the maintenance unit 4 function as valve opening members which cooperate with each other to open and close the air discharging valve device 326.

In the fifth embodiment, when the recording head 21 is not positioned at the waiting position where the maintenance unit 4 is provided, that is, when the head 21 is ejecting droplets of inks toward the recording sheet P, the respective projecting portions 72*a* of the small cap members 72 are not inserted into the respective, communication ports 356*c* of the valve holes 356. Thus, the state in which the valve members 357 are sandwiched by the spring members 360 and the respective bottom surfaces of the valve holes 356 is maintained. Since the annular projection 357*a* of each valve member 357 is entirely pressed against the bottom spice defining the communication port 356*c*, and is elastically deformed around the same 356*c*, the annular projection 357*a* can closely contact the bottom surface and air-tightly close the port 356*c*. Thus, the inks and the air bubbles present in the damping chambers 27 cannot be discharged via the air discharging passages 61, and can be stably kept in the same 27.

Meanwhile, when the recording head 21 is positioned at the waiting position where the maintenance unit 4 is provided, and the respective projecting portions 72*a* of the small cap members 72 are inserted upward into the respective communication ports 356*c* of the valve holes 356, the valve members 357 are pushed, upward in the respective axial directions of the corresponding valve holes 356, away from the corresponding communication ports 356*c*, so that respective clearances 356*e* are produced between the respective annular projections 357*a*, and the respective lower surfaces, of the valve members 357, and the respective bottom surfaces defining the communication ports 356*c*.

As described above, the diameter D3 of the large-diameter portion 356*a* of each valve hole 356 is greater than the diameter D1 of the annular fin 357*b* of each valve member 357, ie., D3>D1, and accordingly the clearance 356*d* is left between the outer circumferential surface of each valve member 357 and the inner circumferential surface of the large-diameter portion 356*a*.

The above-indicated clearances 356*d*, 356*e* in each valve hole 356 cooperate with each other to define an air flow passage through which the air bubbles in the corresponding damping chamber 27 are reliably discharged by the suction of the suction pump 74 via the corresponding small cap member 72, communication port 356*c*, and air discharging passage 51.

When each valve member 357 is returned to its closed state, the valve member 357 is displaced downward by the corresponding spring member 360, while being guided by the small-diameter portion 356*b*. Thus, the valve member 357 can quickly close the corresponding communication port 356*c*.

In the fifth embodiment, each valve hole 356 includes the large-diameter portion 356*c* having the inner diameter D3 larger than the diameter D1 of the annular fin 357*b*, so as to prevent the annular fin 357*b* from contacting the inner surface of the portion 356*c*. Thus, the fin 357*b* is prevented from resisting the vertical sliding or moving of the valve member 357 in the valve hole 356, or narrowing the air flow passage defined in the same 356.

Thus, when the valve members 357 are produced, it is not needed to employ any means for reducing or eliminating the respective fins 357*b* of the valve members 357. Therefore, the production cost of the valve members 357 is not increased .

In the fifth embodiment, the valve members 357 are formed of an elastic material such as rubber. Thus, each valve member 357 functions as not only a valve member but also a sealing member. Thus, the total number of components or parts of the air discharging valve device 326 is reduced, which leads to lowering the production cost, the total weight, and the overall size, of the same 326.

In the illustrated embodiments, the damping device 13, 101 includes the lower flexible diaphragm 36, 124 which is opposed to the primary partition wall 35, 135 and liquid-tightly closes the black-ink damping chamber 27*a*, 113*a*, and the upper flexible sheet 43, 136 which is opposed to the primary partition wall and liquid-tightly closes the cyan-ink, yellow-ink, and magenta-ink damping chambers 27*b*, 27*c*, 27*d*, 113*b*, 113*c*, 113*d*. Each of the lower and upper flexible diaphragms may be constituted by a flexible sheet such as a film formed of, e.g., a resin, or an elastic membrane formed of, e.g. a rubber. Thus, each of the damping chambers has an open end having a large area closed by a corresponding one of the flexible membranes and, when the pressure of the ink in the each damping chamber changes, the corresponding flexible membrane can be flexed over the large area. Therefore, the damping device can enjoy the reduced size while exhibiting a sufficiently high pressure-change damping effect In the illustrated embodiments, the recording head 21 has the our ink supply channels, and the damping device 13, 101 has the four damping chambers 27, 113 which correspond to the four ink supply channels, respectively, and include the three damping chambers 27*b*, 27*c*, 27*d*, 113*b*, 113*c*, 113*d* separated by the primary partition wall 35, 116 from the black-ink damping chamber 27*a*, 113*a*, and the damping device further includes the secondary partition walls 30, 35*a*, 116 which separate the three damping chambers 27*b*, 27*c*, 27*d*, 113*b*, 113*c*, 113*d* from each other and which extends from the primary partition wall in a direction away therefrom. Thus, the three damper chambers 27*b*, 27*c*, 27*d*, 113*b*, 113*e*, 113*d* share the secondary partition walls. Therefore, the damping device having the four damping chambers can enjoy the still reduced size.

In the illustrated embodiments, the damping device 13, 101 includes the upper flexible membrane 43, 136 which liquid-tightly closes the three damping chambers 27*a*, 27*b*, 27*d*, 113*a*, 113*b*, 113*d*. Thus, the three damping chambers 27*a*, 27*b*, 27*d*, 113*a*, 113*b*, 113*d* whose respective upper ends open in the same, upper direction can be liquid-tightly closed by the single flexible membrane 43, 136. Therefore, the three damping chambers can be easily closed, which leads to reducing the production cost of the damping device 13, 101.

In the illustrated embodiments, the ink jet printer includes the air discharging passages 51, 145 communicating with the damping chambers 27, 113 of the damping device 13, 101, respectively, and the air discharging valve device 26, 102 having the valve holes 56, 147 each of which communicates with a corresponding one of the damping chambers 27, 113 via a corresponding one of the air discharging passages so as to discharge the air bubbles accumulated in the one damping chamber, into the atmosphere. Thus, a considerable amount of air bubbles can be separated from the ink that has flowed into each of the damping chambers, and the ink containing the reduced amount of air bubbles can be supplied to the recording head 21.

In the illustrated embodiments, the ink jet printer includes the damper case 26, 121 in which the air discharging passages 51, 145 are formed, and the air discharging valve device 26, 102 is integrally formed with the damping device 13, 101. Thus, the air discharging passages and the air discharging valve device that are all used to remove the air bubbles when a maintenance operation is carried out, are mounted on the carriage. Therefore, all those air discharging means can be provided in a small space. In particular, in the case where the air discharging passages are provided, in an outer surface of the damper case, in the form of respective grooves opening in the same direction in which the restive open ends of the damping chambers open, the damping chambers and the air discharging passages can be closed by the single flexible membrane 43, 136 adhered to the outer surface of the damper case. This leads to reducing the production cost of the ink jet printer.

In the illustrated embodiments, the four ink tanks 5*a*, 5*b*, 5*c*, 5*d* store the four sorts of inks, respectively, and each of the ink tanks supplies a corresponding one of the inks to a corresponding one of the ink supply channels of the recording head 21 via a corresponding one of the ink supply tubes 14, 14' and a corresponding one of the damping chambers 27, 113. Thus, the present ink jet printer can exhibit a high pressure change damping effect with respect to each of the color inks employed to record a fill-color image on a recording medium.

In the illustrated embodiments, the damping device 13, 101 including the damping chambers 27, 113 is provided above the recording head 21 including the ink supply channels, such that the primary partition wall 35, 115 of the damping device extends parallel to the direction in which the carriage 9, 3' is moved. Thus, the recording head and the damping device can be disposed together with each other in a reduced space on the carriage.

In the illustrated embodiments, the damper case 25, 121 has the primary partition wall 35, 115, and the damper case additionally has the ink flow inlets 47, 48, 137, 139, 140, 141 which are arranged along a first reference line and each of which communicates a corresponding one of the damping chambers 27, 113 with a corresponding one of the ink supply tubes 14, 14', and the ink flow outlets 41, 109 which are arranged along a second reference line and each of which communicates a corresponding one of the damping chambers with a corresponding one of the ink supply channels of the recording head 21. The damper case additionally has the communication passage 42, 44, 49, 50, 54, 127, 142, 143, 250 which communicates at least one of the ink flow inlets and the ink flow outlets, with at least one of the damping chambers, and which extends in the direction substantially perpendicular to the plane on which the primary partition wall 35, 115 extends. Each of the first and second reference lines may be a straight line, a curved line, or a bent line. Thus, the ii flow inlets and the ink flow outlets may be formed in the damper case, such that the inlets and the outlets are arranged in respective arrays. Therefore, the inlets and the outlets can be easily connected to the ink supply tubes and the ink supply channels of the recording head, respectively.

In the illustrated embodiments, the communication passages 49, 50, 142, 143 are formed along the side walls 37, 38 of the damper case 25. Thus, the communication passages can be easily formed, while each of the damping chambers enjoys a sufficiently large volume.

In the illustrated embodiments, the recording head 21 has the four ink supply inlets 107 which communicate with the ink supply channels thereof respectively, and which are arranged along one side thereof, the damper case 25, 121 has the ink flow outlets 41, 109 arranged in the array such that the ink flow outlets are opposed to, and communicate with, the ink supply inlets of the recording head, respectively. According to this feature, when the damper case is just placed on the recording head, the ink flow outlets of the damper case can be aligned with the ink supply inlets of the recording head that correspond to the ink supply channels thereof respectively. Thus, the ink flow outlets can be easily connected to the ink supply inlets, respectively.

In the first and second embodiments, the damper case 25 includes the lower case 32 having the upper open end and the lower open end, and the upper case 31 covering the upper open end of the lower case, the lower case 32 includes the air-discharging-valve-device supporting portion 34 which supports the air discharging valve device 26, and the damping-device supporting portion 33 which is integral with the air-discharging-valve-device supporting portion and which supports the damping device 13 having the damping chambers 27 and the primary partition wall 35, and the upper case includes the lid portion 29 which closes the upper open end of the damping-device supporting portion so as to define the second chambers 39*b*, 39*c*, 39*d* of the three damping chambers 27*b*, 27*c*, 27*d*, and the air discharging passages 51 are formed in the upper case and communicate the damping chambers of the damping device with the valve holes 56 of the air discharging valve device, respectively. Thus, the damper case can be easily obtained by combining the upper and lower cases with each other, after those cases are so armed as to have the complicated recesses, holes, and grooves corresponding to, e.g., the damping chambers, the air discharging passages, and the communication passages.

In the first and second embodiments, the respective contact surfaces of the upper case 31 and the lower case 32 of the damper case 25 are liquid-tightly fixed to each other. Thus, no sealing member needs to be provided at the contact surfaces of the upper and lower cases, while the degree of liquid tightness of those contact surfaces is improved.

In the first and second embodiments, the damping device 13 includes the lower flexible membrane 36 which is located opposite to the contact surface of the lower case 32 and liquid-tightly closes the lower open end of the damping-device supporting portion 33, and the upper flexible membrane 43 which is located opposite to the contact surface of the upper case 31 and liquid-tightly closes the upper open ends of the first chambers 27*b*-1, 27*c*-1, 27*d*-1 of the three damping chambers 27*b*, 27*c*, 27*d* that are located above the lid portion 29, and the respective upper openings of the air discharging passages 51 formed in the upper surface of the upper case. Thus, after the upper and lower cases are combined with each other, the first and second flexible membranes can be easily attached to the two cases, respectively.

In the first and second embodiments, the lower case 32 has the connection passages 48 each of which connects a corresponding one of the ink supply tubes 14 to a corresponding one of the damping chambers 27, and the each connection passage is defined by the groove formed in the lower surface of the lower case 32, the damping device 13 includes the lower flexible sheet 36 which liquid-tightly closes the respective openings of the respective grooves of the connection passages 48. Thus, the connection passages 48 can be easily formed in the lower case such that each of the connection passages has a desired shape.

In the first and second embodiments, each of the lower and upper flexible membranes 36, 43 extends parallel to the respective contact surfaces of the upper case 31 and the lower case 32. Thus, each of the two flexible membranes can be easily bonded to the upper and lower cases.

In the illustrated embodiments, the ink jet printer includes the head holder 20, 100 which supports, the recording head 21 such that the recording head is opposed to the recording sheet P, and which accommodates the damping device 13, 101, the sealing members 40, 110 which are provided between the ink flow outlets 41, 109 of the damping device 13, 101 and the ink supply inlets 107 of the recording head, and the air-discharging-valve-device supporting portion 341 146 which supports the air discharging valve device 26, 102 having the valve holes 56, 147 communicating with the air discharging passages 51, 145, respectively, and the air-discharging valve-device supporting portion is fixed to the head holder such that the ink flow outlets of the damping device are opposed to the ink supply inlets of the recording head, respectively, via the sealing members. Thus, when the damping device is fixed to the head holder supporting the recording head, the direction of fixing of the damping device coincides with the direction of sealing of the sealing members. Therefore, the reliability of liquid-tight sealing of the sealing members can be improved.

In the third embodiment, the ink jet printer includes the fixing device 161, 164 which fixes the air-discharging-valve-device supporting portion 146 and the head holder 100 to each other and which includes the pins 164 and the holes 161 in which the pin are fitted in the direction in which the ink flow outlets 109 are opposed to the ink supply inlets 107 of the recording head 21, respectively. According to this feature, since the pins and the holes are used as the fixing device, the reliability of liquid-tight sealing of the sealing members can be improved. In addition, in a particular case where the pins are thermally calked, the pins can be more easily fined to the holes than screws that are fastened. Since the thermally calked pins cannot come off the holes, the internal components of the damping device are effectively prevented from rattling, and the reliability of the recording head is improved.

In the third embodiment, the valve holes 147 of the air-discharging-valve-device supporting portion 146 open in the direction parallel to the direction in which the ink flow outlets 109 are opposed to the ink supply inlets 107 of the recording head 21, respectively, and the air-discharging-valve-device supporting portion 146 includes the two first arm portions 163, and the head holder 100 includes the two second arm portions 160 which are opposed to the two first arm portions, respectively. The fixing device 161, 164 includes the two pins 164 which are supported by the two first arm portions, respectively, and the two holes 161 which are formed in the two second arm portions, respectively. According to this feature, as the respective strengths of the first and second arm portions are increased, the air-discharging-valve-device supporting portion and the head holder can be more strongly fixed to each other. In addition, even if the supporting portion may be pushes during a maintenance operation, in the direction parallel to the direction in which the supporting portion is fixed to the head holder, the supporting portion cannot be easily deformed and accordingly the air discharging operation can be carried out with reliability.

In the illustrated embodiments, the head holder 20, 100 includes the side walls 100*d*, 100*e* which surrounds the recording head 21 and the damping device 13, 101, such that one low side wall 100*e* is provided between the air-discharging-valve-device supporting portion 34, 146, and the combination of the recording head and the damping device. Thus, the air-discharging-valve-device supporting portion is located outside the head holder that may have a box-like configuration, such that the supporting portion is separated by the one side portion of the head holder. Therefore, when the lower surface (i.e., the nozzle supporting surface) of the recording head 21 is periodically cleaned with a wiper, or during a maintenance operation or an air discharging operation, the ink adhered to the respective lower surfaces of the recording head and the air-discharging-valve-device supporting portion, and/or the ink leaking from the supporting portion are/is effectively prevented by the one side wall of the head holder from contaminating the internal elements of the head holder such as the recording head 21, or electric wirings of the flexible flat cable 24 that are used to transmit electric signals to the head 21, or causing an electric short-circuit of the recording head or the electric wirings.

In the illustrated embodiments, the valve holes 56, 147 of the air discharging valve device 26, 102 supported by the air-discharging-valve-device supporting portion 34, 146 communicate with the respective upper portions of the damping chambers 27, 113, and extend to respective positions which are near to the nozzle supporting surface of the recording head 21 that supports the ink ejection nozzles 22 and which are spaced from the nozzle supporting surface by the space 162, and the one side wall 100*e* of the head holder 20, 100 is located in this space 162. Thus, the air-discharging-valve-device supporting portion can be reliably separated from the recording head by the above-indicated space and side wall. Therefore, the ink adhered to the respective lower surfaces of the recording head and the air-discharging-valve-device supporting portion is effectively prevented from contaminating the internal elements of the head holder or causing the electric short-circuit of, e.g., the recording head.

In the first and second embodiments, the damper case 25 has the lid portion 29 as a partition wall that separates the damping chambers 27*b*, 27*c*, 27*d* into the first chambers 27*b*-1, 27*c*-1, 27*d*-1 as upstream-side portions located on the side of the upper flexible sheet 43, and the second chambers 39*b*, 39*c*, 39*d* as downstream-side portions, and the lid portion 29 includes, for each of the damping chambers 27*b*, 27*c*, 27*d*, the communication holes 44 as the flow restricting portion that restrict the flow of the corresponding ink therethrough. According to this feature, after the pressure change of the ink has been damped or absorbed by the flexible sheet 43, the ink flows from each of the first chambers 27-1 into the corresponding second chamber 39 through the communication holes 44. Therefore, the pressure change of the ink in each of the second chambers 39 is made small, and the ink ejection nozzles 22 of the recording head 21 is freed of the problem of pressure change of the ink. In a particular case where the damping chambers 27 and the communication holes 44 are simultaneously formed when the damper case 25 is produced, the production cost of the damping device 13 can be largely reduced.

In the first and second embodiments, the direction in which the ink flows from each of the ink introducing passages 49, 50, 250 toward the flexible sheet 43, 243, is opposite to the direction in which the ink flows from the flexible sheet toward the communication holes 44 as the flow restricting portion. According to this feature, the pressure change of the ink, propagated from each ink introducing passage to the corresponding damping chamber, is first absorbed by the flexible sheet, and is additionally absorbed by the flow restricting portion. Thus, the ink ejection nozzles 22 of the recording head 21 is freed of the problem of pressure change of the ink.

In the first and second embodiments, the lid portion 29 as the partition wall that has the communication holes 44 as the flow restricting portion extends substantially parallel to the upper flexible sheet 43. According to this feature, each of the damping chambers 27 can be formed to have a small dimension in a direction perpendicular to the partition wall, while having a first large area defined by the partition wall and a second large area defined by the flexible sheet. Thus, the damping device 13 can be firmed in a small size, while enjoying a high pressure-change damping effect.

In the first and second embodiments, the damping device 13 has the damping chambers 27*b*, 27*c*, 27*d* above the recording head 21, such that the lid portion 29 as the partition wall, and the upper flexible sheet 43 extend substantially parallel to the direction in which the carriage 9 is moved. According to this feature, the carriage can be provided in a small space.

In the first and second embodiments, the damping device 13 includes the damper case 25 which cooperates with the upper and lower flexible sheets 36, 43 each as the pressure-change damping portion to define the damping chambers 27, and the flexible sheets 36, 43 close the upper and lower open ends of the damper case to define the damping chambers. According to this feature, the pressure change of the ink, propagated from each of the ink flow inlets 47 to the corresponding damping chamber 27, is damped or absorbed by the deformation of the corresponding flexible sheet 36, 43 located on the upstream side of the communication holes 44 as the flow restricting portion. In addition, the flexible sheets 36, 43 can be easily attached to the damper case 25.

In the first and second embodiments, the damper case 25 has the lid portion 29 as the partition wall that separates the damping chambers 27 into the first chambers 27-1 located on the side of the ink flow inlets 47, 48, and the second chambers 39 located on the side of the ink flow outlets 41, and the lid portion 29 has the communication holes 44 as the flow restricting portion. According to this feature, the first and second chambers 27-1, 39 and the communication holes 44 can be formed when the damper case 25 is produced This leads to largely reducing the production cost of the damping device 13.

In the first and second embodiments, the direction in which the ink flows from each of the ink flow inlets 47, 48 toward the upper flexible sheet 43 as the pressure-change damping portion is opposite to the direction in which the ink flows from the upper flexible sheet 43 toward the communication holes 44 as the flow restricting portion. According to this feature, the pressure change of the ink, propagated from each of the ink flow inlets to the corresponding damping chamber, is it damped or absorbed by the pressure-change damping portion, and is additionally absorbed by the flow restricting portion when the ink flows through the same. Thus, the pressure change of the ink can be effectively controlled.

In the first and second embodiments, the lid portion 29 as the partition wall that has the, communication holes 44 as the flow restricting portion extends substantially parallel to the upper flexible sheet 43. According to this feature, the damping chambers 27 can be formed to have a small dimension in a direction perpendicular to the lid portion 29, while having a first large area defined by the lid portion 29 and a second large area defined by the flexible sheet 43. Thus, the damping device 13 can be formed in a small size, while enjoying a high pressure-change damping effect.

In the fifth embodiment, each of the valve members 357 is formed, by molding, of the elastic material. The elastic material may be rubber. According to this feature, the elastic deformation of each valve member 357 can be utilized to improve the function of the valve member to air-tightly close the communication port 356*c*. In addition, the valve member can function as not only a valve that opens and closes the communication port but also a sealing member that seals the same. This leads to decreasing the total number of components needed to produce the air discharging valve device 326. Moreover, since the valve member is formed by molding, the production cost thereof can be reduced.

In the fifth embodiment, the large-inner-diameter portion 356*a* of each of the four valve holes 356 is opposed to the annular fin 357*b* of the corresponding valve member 357. According to this feature, since the valve member 357 is formed by molding of the elastic material the valve member may have the annular fin along respective contact surfaces of two molding dies. Since, however, the valve hole includes the large-inner-diameter portion that is opposed to the annular fi of the valve member via a clearance, the fin can be prevented from disturbing the, flow of air in the valve hole or damaging the slideability of the valve member in the valve hole.

In the fifth embodiment, the air discharging valve device 326 further includes the four biasing members 360 each of which biases the corresponding valve member 357 toward the communication port 356*c*, and each of the four valve members includes the annular projection 357*a* which projects from the end surface thereof opposed to the communication port 356*c* and surrounds the same 356*c*. According to this feature, each valve member 357 can air-tightly close the corresponding communication port 356*c*, with reliability.

In the fifth embodiment, the ink jet printer includes the projection portions 72*a* as the valve-device opening members each of which is insertable from the outside space into the corresponding communication port 356*c* so as to displace the corresponding valve member 357 away from the communication port 356*c* and thereby open the air discharging valve device 326. According to this feature, each of the projection portions 72*a* can easily and reliably produce the clearance 356*e* between the valve member 357 and the communication port 356*c*, and thereby provide the air flow passage through which the air bubbles can be discharged from the air-bubble collecting chamber into the outside space.

In the first to fourth embodiments, each of the valve members 57 includes the elastic sealing portion 57*c* which is contactable with, and separable from, the corresponding valve seat 56*d*, and the contactable source of the valve seat 56*d* has the pre-selected roughness. According to this feature, the valve member 57 and the valve seat 56*d* can be well sealed to each other, while the valve member as a whole enjoys a high degree of rigidity. Thus, the valve member can be quickly and reliably operated.

In the first to fourth embodiments, the elastic sealing portion 57*c* of each valve member 57 has the type A deurometer hardness of not lower than A40/S (JIS). According to this feature, the valve member 57 and the valve seat 56*d* can be more easily separated from each other.

It is to be understood that the present invention may be applied to various sorts of ink jet printers.

It is also to be understood that the present invention may be embodied with other changes and improvements that may occur to a person skilled in the art, without departing from the spirit and scope of the invention defined in the appended claims.

What is claimed is:

1. An ink jet printer, comprising:

a housing;

a carriage which is movable in the housing relative thereto;

an ink jet recording head which is mounted on the carriage and which has a plurality of ink supply channels;

a damping device which is mounted on the carriage and which includes a plurality of damping chambers corresponding to the ink supply channels, respectively;

an ink-tank supporting portion which is provided in the housing and which supports a plurality of ink tanks; and a plurality of ink supply tubes each of which supplies an ink from a corresponding one of the ink tanks to a corresponding one of the ink supply channels of the ink jet recording head via a corresponding one of the ink supply tubes and a corresponding one of the damping chambers, wherein the damping device further includes:

a primary partition wall which separates at least one first damping chamber of the damping chambers, from at least one second damping chamber of the damping chambers;

at least one first flexible sheet which is opposed to the primary partition wall and liquid-tightly closes the at least one first damping chamber; and at least one second flexible sheet which is opposed to the primary partition wall and liquidly-tightly closes the at least one second damping chamber.

2. The ink jet printer according to claim 1, wherein the damping device has a plurality of ink flow inlets each of which communicates a corresponding one of the damping chambers with a corresponding one of the ink supply tubes, and a plurality of ink flow outlets each of which communicates a corresponding one of the damping chambers with a corresponding one of the ink supply channels of the ink jet recording head.

3. The ink jet printer according to claim 1, wherein the ink jet recording head has at least three ink supply channels, and the damping device includes at least three damping chambers which correspond to the at least three ink supply channels, respectively, and include at least two second damping chambers separated from the at least one first damping chamber by the primary partition wall, and wherein the damping device further includes at least one secondary partition wall which separates the at least two second damping chambers from each other and which extends from the primary partition wall in a direction away therefrom.

4. The ink jet printer according to claim 3, wherein the at least one second flexible sheet liquid-tightly closes the at least two second damping chambers.

5. The ink jet printer according to claim 1, further comprising:

a plurality of air discharging passages which communicate with the damping chambers of the damping device, respectively; and an air discharging valve device having a plurality of valve holes each of which communicates with a corresponding one of the damping chambers via a corresponding one of the air discharging passages so as to discharge air bubbles accumulated in the one damping chamber, into an atmosphere.

6. The ink jet printer according to claim 5, wherein the damping device further includes a damper case in which the air discharging passages are formed, and wherein the air discharging valve device is integrally assembled with the damping device.

7. The ink jet printer according to claim 6, wherein the damper case includes a lower case having an upper open end and a lower open end, and an upper case covering the upper open end of the lower case, wherein the lower case includes an air-discharging-valve-device supporting portion which supports the air discharging valve device, and a damping-device supporting portion which is integral with the air-discharging-valve-device supporting portion and which supports the damping device including the damping chambers and the primary partition wall, and wherein the upper case includes a lid portion which closes an upper open end of the damping-device supporting portion so as to define at least a portion of the at least one second damping chamber, and the air discharging passages are formed in the upper case and communicate the damping chambers of the damping device with the valve holes of the air discharging valve device, respectively.

8. The ink jet printer according to claim 7, wherein respective contact surfaces of the upper case and the lower case of the damper case are liquid-tightly fixed to each other.

9. The ink jet printer according to claim 8, wherein the at least one first flexible sheet is located opposite to the contact surface of the lower case and liquid-tightly closes a lower open end of the damping-device supporting portion, and wherein the at least one second flexible sheet is located opposite to the contact surface of the upper case and liquid-tightly closes an upper open end of a portion of the at least one second damping chamber that is located above the lid portion, and respective upper openings of the air discharging passages formed in an upper surface of the upper case.

10. The ink jet printer according to claim 7, wherein at least one of the upper case and the lower case has a plurality of connection passages each of which connects a corresponding one of the ink supply tubes to a corresponding one of the damping chambers, and at least a portion of the each connection passage is defined by a groove formed in a surface of the at least one of the upper case and the lower case, and wherein the damping device further includes at least one third flexible sheet which liquid-tightly closes respective openings of the respective grooves of the connection passages.

11. The ink jet printer according to claim 10, wherein each of the at least one first flexible sheet, the at least one second flexible sheet, and the at least one third flexible sheet extends parallel to respective contact surfaces of the upper case and the lower case that are liquid-tightly fixed to each other.

12. The ink jet printer according to claim 5, wherein the damping device has a plurality of ink flow inlets each of which communicates a corresponding one of the damping chambers with a corresponding one of the ink supply tubes, and a plurality of ink flow outlets each of which communicates a corresponding one of the damping chambers with a corresponding one of the ink supply channels of the ink jet recording head, wherein the ink jet recording head has a plurality of ink supply inlets which communicate with the ink supply channels thereof, respectively, and wherein the ink flow outlets of the damping device are opposed to, and communicate with, the ink supply inlets of the recording head, respectively.

13. The ink jet printer according to claim 12, wherein the ink jet recording head has a nozzle supporting surface which supports a plurality of ink ejection nozzles, wherein the ink jet printer further comprises:

a head holder which holds the ink jet recording head such that the nozzle supporting surface thereof faces outward and the ink ejection nozzles thereof open outward, and which accommodates the damping device;

at least one sealing member which is provided between the ink flow outlets of the damping device and the ink supply inlets of the ink jet recording head; and an air-discharging-valve-device supporting portion which supports the air discharging valve device having the valve holes communicating the air discharging passages, respectively, and wherein the air-discharging-valve-device supporting portion is fixed to the head holder such that the ink flow outlets of the damping device are opposed to the ink supply inlets of the recording head, respectively, via the at least one sealing member.

14. The ink jet printer according to claim 13, further comprising a fixing device which fixes the air-discharging-valve-device supporting portion and the head holder to each other and which includes at least one pin and at least one hole in which the at least one pin is fitted in a direction in which the ink flow outlets are opposed to the ink supply inlets, respectively.

15. The ink jet printer according to claim 14, wherein the valve holes of the air discharging valve device supported by the air-discharging-valve-device supporting portion open in a direction parallel to the direction in which the ink flow outlets are opposed to the ink supply inlets, respectively, wherein the air-discharging-valve-device supporting portion includes two first arm portions, and the head holder includes two second arm portions which are opposed to the two first arm portions, respectively, and wherein the fixing device includes two pins which are supported by the two first arm portions, respectively, and two holes which are formed in the two second arm portions, respectively.

16. The ink jet printer according to claim 12, wherein the ink jet recording head has a nozzle supporting surface which supports a plurality of ink ejection nozzles, wherein the ink jet printer further comprises:

a head holder which holds the ink jet recording head such that nozzle supporting surface thereof faces outward and the ink ejection nozzles thereof open outward, and which accommodates the damping device; and an air-discharging-valve-device supporting portion which supports the air discharging valve device having the valve holes communicating with the air discharging passages, respectively, and wherein the air-discharging-valve-device supporting portion is Fixed to the head holder such that the ink flow outlets of the damping device are opposed to the ink supply inlets of the recording head, respectively.

17. The ink jet printer according to claim 16, wherein the head holder includes a side wall which surrounds the ink jet recording head and the damping device, such that a portion of the side wall is provided between the air-discharging-valve-device supporting portion, and a combination of the recording head and the damping device.

18. The ink jet printer according to claim 17, wherein the valve holes of the air discharging valve device supported by the air-discharging-valve-device supporting portion communicate with respective upper portions of the damping chambers, and extend to respective positions which are near to the nozzle supporting surface of the ink jet recording head and which are spaced from the nozzle supporting surface by a space, and wherein the portion of the side wall of the head holder is located in the space.

19. The ink jet printer according to claim 1, wherein the ink tanks store a plurality of sorts of inks, respectively, and each of the ink tanks supplies a corresponding one of the inks to a corresponding one of the ink supply channels of the ink jet recording head via a corresponding one of the ink supply tubes and a corresponding one of the damping chambers of the damping device.

20. The ink jet printer according to claim 1, wherein the damping device including the damping chambers is provided above the ink jet recording head including the ink supply channels, such that the primary partition wall of the damping device extends parallel to a direction in which the carriage is moved.

21. The ink jet printer according to claim 1, wherein the damping device further includes a damper case having the primary partition wall, wherein the damper case further includes:

a plurality of ink flow inlets which are arranged along a first reference line and each of which communicates a corresponding one of the damping chambers with a corresponding one of the ink supply tubes, and a plurality of ink flow outlets which are arranged along a second reference line and each of which communicates a corresponding one of the damping chambers with a corresponding one of the ink supply channels of the ink jet recording head, and at least one communication passage which communicates at least one of the ink flow inlets and the ink flow outlets, with at least one of the damping chambers, and which extends in a direction substantially perpendicular to a plane along which the primary partition wall extends.

22. The ink jet printer according to claim 21, wherein at least a portion of the at least one communication passage is formed along a side wall of the damper case.

23. The ink jet printer according to claim 21, wherein the ink jet recording head has a plurality of ink supply inlets which communicate with the ink supply channels thereof, respectively, and which are arranged along one side thereof, and wherein the damper case has the ink flow outlets arranged along the second reference line such that the ink flow outlets are opposed to, and communicate with, the ink supply inlets of the recording head, respectively.

24. The ink jet printer according to claim 21, wherein the damper case has two opposite open ends which are located on either side of, and extend parallel to, the primary partition wall, and wherein the at least one first flexible sheet liquid-tightly closes one of the two opposite open ends and thereby closes the at least one first damping chamber and the at least one second flexible sheet liquid-tightly closes an other of the two opposite open ends and thereby closes the at least one second damping chamber.

25. The ink jet printer according to claim 21, wherein the ink jet recording head has at least three ink supply channels, and the damper case has at least three damping chambers which correspond to the at least three ink supply channels, respectively, and include at least two second damping chambers separated from the at least one first damping chamber by the primary partition wall, and wherein the damper case further includes at least one secondary partition wall which separates the at least two second damping chambers from each other and which extends from the primary partition wall in a direction away therefrom.

26. The ink jet printer according to claim 1, wherein the damping device includes a damper case having the at least one second damping chambers, wherein the at least one second flexible sheet is spaced from, and is opposed to, at least one wall surface of the damper case, so as to define the at least one second damping chamber having at least one ink flow inlet to which the ink is supplied from at least one of the ink supply tubes, and at least one ink flow outlet from which the ink is supplied to at least one of the ink supply channels of the ink jet recording head, and wherein the damping device has at least one ink introducing passage with which the at least one ink flow inlet communicates, which extends in a direction having a component perpendicular to the at least one second flexible sheet, and which opens in the at least one second damping chamber at a position nearer to the at least one second flexible sheet than the at least one wall surface of the damper case, so that the at least one second flexible sheet damps a change of pressure of the ink flowing from the at least one ink introducing passage into the at least one second damping chamber.

27. An ink jet printer, comprising:

a housing;

a carriage which is movable in the housing relative thereto;

an ink jet recording head which is mounted on the carriage and which has a plurality of ink supply channels;

a damping device which is mounted on the carriage and which includes a plurality of damping chambers corresponding to the ink supply channels, respectively;

an ink-tank supporting portion which is provided in the housing and which supports a plurality of ink tanks; and a plurality of ink supply tubes each of which supplies an ink from a corresponding one of the ink tanks to a corresponding one of the ink supply channels of the ink jet recording head via a corresponding one of the ink supply tubes and a corresponding one of the damping chambers, wherein the damping device further includes a primary partition wall which separates at least one first damping chamber of the damping chambers, from at least one second damping chamber of the damping chambers, wherein at least one of the damping chambers has at least one ink flow inlet to which the ink is supplied from at least one of the ink supply tubes, and at least one ink flow outlet from which the ink is supplied to at least one of the ink supply channels of the ink jet recording head, wherein the damping device further includes at least one pressure-change damping portion which at least partly defines the at least one damping chamber and which damps a change of pressure of the ink flowing from the at least one ink flow inlet into the at least one damping chamber, and at least one flow restricting portion which restricts a flow of the ink from the at least one ink flow inlet toward the at least one ink flow outlet, and wherein the at least one pressure-change damping portion is located on an upstream side of the at least one flow restricting portion in a direction of the flow of the ink from the at least one ink flow inlet toward the at least one ink flow outlet.

28. The ink jet printer according to claim 1, wherein the damping chambers comprise at least one air-bubble collecting chamber which collects air bubbles produced in at least one of the ink supply tubes, wherein the ink jet printer further comprises an air discharging valve device which discharges the air bubbles collected by the at least one air-bubble collecting chamber and which is mounted on the carriage, wherein the air discharging valve device includes at least one valve hole which has, at one of axially opposite ends thereof, a communication port via which the at least one air-bubble collecting chamber communicates with an outside space, and at least one valve member which is displaceable in the at least one valve hole in an axial direction thereof so as to open and close the communication port thereof, wherein the at least one valve hole includes a small-inner-diameter portion and a large-inner-diameter portion which are opposed to an outer circumferential surface of the at least one valve member, and wherein the small-inner-diameter portion is nearer to the communication port than the large-inner-diameter portion, and a first clearance between the at least one valve member and the small-inner-diameter portion is smaller than a second clearance between the at least one valve member and the large-inner-diameter portion, such that the small-inner-diameter portion guides the at least one valve member and the large-inner-diameter portion does not guide the at least one valve member.

29. The ink jet printer according to claim 1, wherein the damping chambers comprise at least one air-bubble collecting chamber which collects air bubbles produced in at least one of the ink supply tubes, wherein the ink jet printer further comprises an air discharging valve device which discharges the air bubbles collected by the at least one air-bubble collecting chamber and which is mounted on the carriage, wherein the air discharging valve device includes at least one valve seat which has a communication port via which the at least one air-bubble collecting chamber communicates with an outside space, and further includes at least one valve member which is contactable with, and separable from the at least one valve seat so as to open and close the communication port and which is biased in a direction to close the communication port, and wherein the at least one valve member and the at least one valve seat have respective contactable surfaces which are contactable with, and separable from, each other, the contactable surface of the at least one valve seat is formed of an acetal resin, and at least the contactable surface of the at least one valve member is formed of an elastic material.

30. The ink jet printer according to claim 1, wherein the damping chambers comprise at least one air-bubble collecting chamber which collects air bubbles produced in at least one of the ink supply tubes, wherein the ink jet printer further comprises an air discharging valve device which discharges the air bubbles collected by the at least one air-bubble collecting chamber and which is mounted on the carriage, wherein the air discharging valve device includes at least one valve seat which has a communication port via which the at least one air-bubble collecting chamber communicates with an outside space, and further includes at least one valve member which is contactable with, and separable from the at least one valve seat so as to open and close the communication port and which is biased in a direction to close the communication port, and wherein the at least one valve member and the at least one valve seat have respective contactable surfaces which are contactable with, and separable from, each other, at least the contactable surface of the at least one valve member is fonned of an elastic material, and the contactable surface of the at least one valve seat has a roughness Rz of not lower than 0.8 μm and not higher than 1.6 μm.

31. An ink jet printer, comprising:

a housing;

a carriage which is movable in the housing relative thereto;

an ink jet recording head which is mounted on the carriage and which has at least one ink supply channel;

a damping device which is mounted on the carriage and which includes a damper case having at least one damping chamber communicating with the at least one ink supply channel;

an ink-tank supporting portion which is provided in the housing and which supports at least one ink tank; and at least one ink supply tube which supplies an ink from the at least one ink tank to the at least one ink supply channel of the ink jet recording head via the at least one ink supply tube and the at least one damping chamber, wherein the damping device further includes at least one flexible sheet which is spaced from, and is opposed to, at least one wall surface of the damper case so as to define the at least one damping chamber having at least one ink flow inlet to which the ink is supplied from said at least one ink supply tube, and at least one ink flow outlet from which the ink is supplied to the at least one ink supply channel of the ink jet recording head, wherein the damping device has at least one ink introducing passage with which the at least one ink flow inlet communicates, which extends in a direction having a component perpendicular to the at least one flexible sheet, and which opens in the at least one damping chamber at a first position opposed to the at least one flexible sheet, so that the at least one flexible sheet damps a change of pressure of the ink flowing from the at least one ink introducing passage into the at least one damping chamber, wherein the damper case has at least one partition wall which separates the at least one damping chamber into at least one upstream-side portion which is located on a side of the at least one flexible sheet and which communicates with the at least one ink flow inlet, and at least one downstream-side portion into which the ink flows from the at least one upstream-side portion and which communicates with the at least one ink flow outlet, and wherein the at least one partition wall includes at least one flow restricting portion having a plurality of communication holes which open in the at least one upstream-side portion at a second position remoter from the at least one flexible sheet than the first position, through which the ink flows, and which restrict the flow of the ink therethrough.

32. The ink jet printer according to claim 31, wherein the at least one ink introducing passage extends in a direction substantially perpendicular the at least one flexible sheet.

33. The ink jet printer according to claim 31, wherein a direction in which the ink flows from the at least one ink introducing passage toward the at least one flexible sheet is opposite to a direction in which the ink flows from the at least one flexible sheet toward the at least one flow restricting portion of the at least one partition wall.

34. The ink jet printer according to claim 31, wherein the at least one partition wall including the at least one flow restricting portion extends substantially parallel to the at least one flexible sheet.

35. The ink jet printer according to claim 31, wherein the at least one damping chamber of the damping device is located above the ink jet recording head, such that the at least one partition wall and the at least one flexible sheet extend substantially parallel to a direction in which the carriage is moved.

36. The ink jet printer according to claim 31, wherein the ink jet recording head has a plurality of the ink supply channels, and the damping device has a plurality of the damping chambers which communicate with the ink supply channels, respectively, and which are separated from each other in the damper case.

37. An ink jet printer, comprising:

a housing;

a carriage which is movable in the housing relative thereto;

an ink jet recording head which is mounted on the carriage and which has at least one ink supply channel;

a damping device which is mounted on the carriage and which includes at least one damping chamber communicating with the at least one ink supply channel;

an ink-tank supporting portion which is provided in the housing and which supports at least one ink tank; and at least one ink supply tube which supplies an ink from the at least one ink tank to the at least one ink supply channel of the ink jet recording head via the at least one ink supply tube and the at least one damping chamber, wherein the at least one damping chamber has at least one ink flow inlet to which the ink is supplied from the at least one ink supply tube, and at least one ink flow outlet from which the ink is supplied to the at least one ink supply channel of the ink jet recording head, wherein the damping device further includes at least one pressure-change damping portion which at least partly defines the at least one damping chamber and which damps a change of pressure of the ink flowing from the at least one ink flow inlet into the at least one damping chamber, and at least one flow restricting portion which restricts a flow of the ink from the at least one ink flow inlet toward the at least one ink flow outlet, and wherein the at least one pressure-change damping portion is located on an upstream side of the at least one flow restricting portion in a direction of the flow of the ink from the at least one ink flow inlet toward the at least one ink flow outlet.

38. The ink jet printer according to claim 37, wherein the at least one flow restricting portion is immovable relative to the at least one damping chamber.

39. The ink jet printer according to claim 37, wherein the damping device further includes a damper case which cooperates with the at least one pressure-change damping portion to define the at least one damping chamber, and wherein the at least one pressure-change damping portion comprises at least one flexible sheet which closes at least one open end of the damper case to define the at least one damping chamber.

40. The ink jet printer according to claim 39, wherein the damper case includes at least one partition wall which separates the at least one damping chamber into at least one upstream-side chamber located on a side of the at least one ink flow inlet, and at least one downstream-side chamber located on a side of the at least one ink flow outlet, and wherein the at least one partition wall includes the at least one flow restricting portion having a plurality of communication holes through which the ink flows from the at least one upstream-side chamber into the at least one downstream-side chamber.

41. The ink jet printer according to claim 40, wherein the at least one partition wall including the at least one flow restricting portion extends substantially parallel to the at least one flexible sheet.

42. The ink jet printer according to claim 37, wherein a direction in which the ink flows from the at least one ink flow inlet toward the at least one pressure-change damping portion is opposite to a direction in which the ink flows from the at least one pressure-change damping portion toward the at least one flow restricting portion.

43. The ink jet printer according to claim 37, wherein the damping device has at least one ink introducing passage with which the at least one ink flow communicates, which extends in a direction having a component perpendicular to the at least one pressure-change damping portion, and opens in the at least one damping chamber at a position opposed to the at least one pressure-change damping portion, so that the at least one pressure-change damping portion damps a change of pressure of the ink flowing from the at least one ink introducing passage into the at least one damping chamber.

* * * * *